US009210966B2

(12) United States Patent
Bell et al.

(10) Patent No.: US 9,210,966 B2
(45) Date of Patent: Dec. 15, 2015

(54) DECOUPLED FOOT STABILIZER SYSTEM

(71) Applicant: Nike, Inc., Beaverton, OR (US)

(72) Inventors: Thomas G. Bell, Portland, OR (US); Bryan N. Farris, North Plains, OR (US); Olivier Henrichot, Lake Oswego, OR (US)

(73) Assignee: NIKE, Inc., Beaverton, OR (US)

( * ) Notice: Subject to any disclaimer, the term of this patent is extended or adjusted under 35 U.S.C. 154(b) by 257 days.

(21) Appl. No.: 14/032,373

(22) Filed: Sep. 20, 2013

(65) Prior Publication Data

US 2014/0075782 A1 Mar. 20, 2014

Related U.S. Application Data

(62) Division of application No. 12/839,079, filed on Jul. 19, 2010, now Pat. No. 8,578,632.

(51) Int. Cl.

| | |
|---|---|
| ***A43B 7/14*** | (2006.01) |
| ***A43B 23/07*** | (2006.01) |
| ***A43B 1/00*** | (2006.01) |
| ***A43B 9/02*** | (2006.01) |
| ***A43B 19/00*** | (2006.01) |

(Continued)

(52) U.S. Cl.

CPC ..... *A43B 7/14* (2013.01); *A43B 1/0072* (2013.01); *A43B 7/1495* (2013.01); *A43B 9/02* (2013.01); *A43B 19/00* (2013.01); *A43B 23/025* (2013.01); *A43B 23/0235* (2013.01); *A43B 23/047* (2013.01); *A43B 23/07* (2013.01); *A43C 1/04* (2013.01)

(58) Field of Classification Search

CPC ..... A43B 7/14; A43B 7/1495; A43B 23/07
USPC ..... 36/88, 89, 90, 91, 92, 93, 10, 55
See application file for complete search history.

(56) References Cited

U.S. PATENT DOCUMENTS

| | | | |
|---|---|---|---|
| 1,137,807 | A | 5/1915 | Teehan |
| 2,798,309 | A | 7/1957 | Wustemann |

(Continued)

FOREIGN PATENT DOCUMENTS

| | | |
|---|---|---|
| CN | 1370481 | 9/2002 |
| CN | 1947610 | 4/2007 |

(Continued)

OTHER PUBLICATIONS

Office Action dated Nov. 17, 2014 in Chinese Patent Application No. 2011800449781, and English translation thereof.

(Continued)

*Primary Examiner* — Marie Bays
(74) *Attorney, Agent, or Firm* — Plumsea Law Group, LLC

(57) ABSTRACT

An article of footwear includes a decoupled foot stabilizer system. The foot stabilizer system is decoupled from a mid-foot region of the article of footwear. The foot stabilizer system includes a plurality of strap members. The foot stabilizer system may optionally include a bootie. The plurality of strap members extend underneath a portion of a foot of a wearer. The plurality of strap members are configured to receive a lace at one end. A lace running through the ends of the strap members pulls on the strap members when the lace is tightened and causes the foot stabilizer system to conform to the wearer's foot.

26 Claims, 47 Drawing Sheets

(51) Int. Cl.

| | |
|---|---|
| ***A43B 23/02*** | (2006.01) |
| ***A43B 23/04*** | (2006.01) |
| ***A43C 1/04*** | (2006.01) |

(56) References Cited

U.S. PATENT DOCUMENTS

| | | | | |
|---|---|---|---|---|
| 2,850,813 | A | 9/1958 | Williamee | |
| 3,323,232 | A | 6/1967 | Danowsky | |
| 3,837,098 | A | 9/1974 | Rathmell | |
| 4,342,161 | A | 8/1982 | Schmohl | |
| 4,510,699 | A | 4/1985 | Nakamura et al. | |
| 4,550,511 | A | 11/1985 | Gamm | |
| 4,592,154 | A | 6/1986 | Oatman | |
| 4,603,493 | A | 8/1986 | Eston | |
| 4,794,706 | A | 1/1989 | Puckhaber et al. | |
| 4,811,500 | A | 3/1989 | Maccano | |
| 4,924,605 | A | 5/1990 | Spademan | |
| 4,926,569 | A | 5/1990 | Bunch | |
| 5,167,084 | A | 12/1992 | Flammier | |
| 5,259,126 | A | 11/1993 | Rosen | |
| 5,323,549 | A | 6/1994 | Segel et al. | |
| 5,566,475 | A * | 10/1996 | Donnadieu | 36/55 |
| 5,692,320 | A | 12/1997 | Nichols | |
| 5,704,138 | A | 1/1998 | Donnadieu | |
| 5,729,918 | A | 3/1998 | Smets | |
| 5,819,439 | A | 10/1998 | Sanchez | |
| 5,896,608 | A | 4/1999 | Whatley | |
| 5,933,987 | A * | 8/1999 | Demarchi | 36/115 |
| 5,940,990 | A | 8/1999 | Barret | |
| 5,950,335 | A * | 9/1999 | Okajima | 36/115 |
| 5,992,057 | A * | 11/1999 | Monti | 36/89 |
| 6,237,254 | B1 * | 5/2001 | Rork et al. | 36/88 |
| 6,286,233 | B1 | 9/2001 | Gaither | |
| 6,393,733 | B1 | 5/2002 | London et al. | |
| 6,427,362 | B2 | 8/2002 | Rork et al. | |
| 6,505,424 | B2 | 1/2003 | Oorei et al. | |
| 6,718,656 | B2 | 4/2004 | Houser et al. | |
| 6,925,734 | B1 * | 8/2005 | Schaeffer | 36/50.1 |
| 7,086,181 | B2 | 8/2006 | Farys | |
| 7,131,219 | B2 | 11/2006 | Chen et al. | |
| 7,159,340 | B2 | 1/2007 | Borsoi | |
| 7,243,444 | B2 | 7/2007 | Selner | |
| 7,343,701 | B2 | 3/2008 | Pare et al. | |
| 7,543,398 | B2 | 6/2009 | Hsaio et al. | |
| 7,870,681 | B2 | 1/2011 | Meschter | |
| 8,312,645 | B2 | 11/2012 | Dojan et al. | |
| 8,312,646 | B2 | 11/2012 | Meschter et al. | |
| 8,418,380 | B2 | 4/2013 | Dojan et al. | |
| 8,578,632 | B2 | 11/2013 | Bell et al. | |
| 2002/0148142 | A1 * | 10/2002 | Oorei et al. | 36/129 |
| 2002/0174568 | A1 | 11/2002 | Neiley | |
| 2003/0066207 | A1 | 4/2003 | Gaither | |
| 2003/0079376 | A1 | 5/2003 | Oorei et al. | |
| 2004/0074110 | A1 * | 4/2004 | Borsoi | 36/50.5 |
| 2004/0172848 | A1 * | 9/2004 | Hirayama | 36/10 |
| 2006/0117606 | A1 * | 6/2006 | Chen et al. | 36/50.1 |
| 2007/0271822 | A1 | 11/2007 | Meschter | |
| 2008/0110048 | A1 | 5/2008 | Dua et al. | |
| 2008/0289222 | A1 | 11/2008 | Candrian et al. | |
| 2009/0071041 | A1 | 3/2009 | Hooper | |
| 2009/0090027 | A1 * | 4/2009 | Baudouin | 36/93 |
| 2009/0293310 | A1 | 12/2009 | Bruce et al. | |
| 2010/0199406 | A1 | 8/2010 | Dua et al. | |
| 2011/0308110 | A1 * | 12/2011 | Berns et al. | 36/89 |
| 2012/0011744 | A1 * | 1/2012 | Bell et al. | 36/91 |

FOREIGN PATENT DOCUMENTS

| | | |
|---|---|---|
| CN | 101674741 | 3/2010 |
| CN | 103153109 | 6/2013 |
| EP | 2595500 | 5/2013 |
| FR | 614343 | 12/1926 |
| GB | 512449 | 9/1939 |
| WO | 2009156625 | 12/2009 |
| WO | 2012012332 | 1/2012 |

OTHER PUBLICATIONS

Response to Written Opinion filed Jul. 25, 2013 in European Patent Application No. 11749964.0.

Response filed Apr. 2, 2015 in Chinese Patent Application No. 201180044978.2, and English translation thereof.

Invitation to Pay Additional Fees and, Where Applicable, Protest Fee mailed Jan. 9, 2012 in International Application No. PCT/US2011/044357.

International Search Report and Written Opinion mailed May 3, 2012 in International Application No. PCT/US2011/044357.

International Preliminary Report on Patentability (including Written Opinion of the ISA) mailed Jan. 31, 2013 in International Application No. PCT/US2011/044357.

Office Action Response filed Sep. 18, 2015 in Chinese Patent Application No. 201180044978.2, and English translation thereof.

* cited by examiner

DECOUPLED FOOT STABILIZER SYSTEM

CROSS-REFERENCE TO RELATED APPLICATION

This application is a division of U.S. application Ser. No. 12/839,079, entitled "Decoupled Foot Stabilizer System", filed on Jul. 19, 2010, and allowed on Jul. 10, 2013, the disclosure of which application is hereby incorporated by reference in its entirety.

BACKGROUND

The present invention relates generally to an article of footwear, and, in particular, to an article of footwear with a foot stabilizer system.

Conventional articles of footwear include two primary elements, an upper and a sole structure. The upper provides a covering for the foot that comfortably receives and securely positions the foot with respect to the sole structure. The sole structure is secured to a lower portion of the upper and is generally positioned between the foot and the ground. In addition to attenuating ground reaction forces, the sole structure may provide traction, control foot motions (e.g., by resisting pronation), and impart stability, for example. Accordingly, the upper and the sole structure operate cooperatively to provide a comfortable structure that is suited for a wide variety of activities.

Articles of athletic footwear are designed with a particular purpose in mind. Some articles of athletic footwear are designed to withstand jarring impact. Others are designed to withstand lateral impact. Some are designed to enhance stability. Others are designed to provide enhanced cushioning. The purpose for which a shoe will be used informs the design choices made by the designers.

Some athletic activities in particular may require frequent and quick lateral bodily movements. Sports including tennis and basketball are examples of athletic activities which require such dynamic lateral movements. The lateral movements require a secure foot plant to maintain stability. Without a secure footing, injuries can occur. Therefore, footwear which will provide lateral constraint for the foot during such lateral movements can be designed for performing such athletic activities.

While lateral constraint is one factor to be considered in designing athletic footwear, another factor is the weight and comfort of the athletic footwear. In general, athletic footwear is designed to be lightweight and to provide a comfortable fit.

Therefore, there exists a need in the art for an article of footwear that provides a customized fit to a wearer's foot and allows the wearer to move in a desired direction while also providing a level of stability.

SUMMARY

In one aspect, the invention provides an article of footwear, comprising: a sole structure; a base portion attached to the sole structure; a foot stabilizer system including a bootie and a plurality of strap members, the foot stabilizer system being attached to the base portion at an attachment area that extends longitudinally along the base portion; wherein the foot stabilizer system is further attached to the base portion at a heel region and a forefoot region; and wherein the foot stabilizer system is decoupled from the base portion at a lateral side and a medial side of a midfoot region.

In another aspect, the invention provides an article of footwear, comprising: a sole structure; a base portion attached to the sole structure; a foot stabilizer system including a bootie and a plurality of strap members, the foot stabilizer system being attached to the base portion at an attachment area that extends longitudinally along the base portion; wherein the foot stabilizer system is further attached to the base portion on a lateral side of a heel region and a lateral side of a forefoot region; and wherein the foot stabilizer system is decoupled from the base portion at a medial side of the forefoot region and a medial side of the heel region.

In another aspect, the invention provides an article of footwear, comprising: a sole structure; a base portion attached to the sole structure; a foot stabilizer system including a plurality of strap members, the foot stabilizer system being attached to the base portion at an attachment area that extends longitudinally along the base portion; wherein the foot stabilizer system is further attached to the base portion on a medial side of a heel region and a medial side of a forefoot region; and wherein the foot stabilizer system is decoupled from the base portion at a lateral side of the forefoot region and a lateral side of the heel region.

In another aspect, the invention provides an article of footwear, comprising: a sole structure; a base portion attached to the sole structure; a foot stabilizer system including a plurality of strap members, the foot stabilizer system being attached to the base portion at an attachment area that extends longitudinally along the base portion; wherein the foot stabilizer system is further attached to the base portion at a heel region and at a forefoot region; and wherein the foot stabilizer system is decoupled from the base portion at a midfoot region.

In another aspect, the invention provides an article of footwear, comprising: an upper having a plurality of slits; a sole structure; a base portion attached to the sole structure; a foot stabilizer system including a plurality of strap members, the foot stabilizer system being disposed in an interior of the upper and being attached to the base portion at an attachment area that extends longitudinally along the base portion; wherein the plurality of strap members extend out from the interior of the upper through the plurality of slits; and wherein the foot stabilizer system is decoupled from the base portion at a midfoot region.

In another aspect, the invention provides an article of footwear, comprising: an upper having a plurality of slits; a sole structure; a base portion attached to the sole structure; a foot stabilizer system including a bootie and a plurality of strap members, the foot stabilizer system being disposed in an interior of the upper; wherein the plurality of strap members extend out from the interior of the upper through the plurality of slits; and wherein at least one of the plurality of strap members is decoupled from the base portion at a midfoot region to allow movement of the at least one of the plurality of strap members to conform the bootie to an arch of a wearer.

In another aspect, the invention provides an article of footwear, comprising: an upper having a plurality of cut-outs defining articulated regions; a sole structure; a base portion attached to the sole structure; a foot stabilizer system including a plurality of strap members, the foot stabilizer system being disposed in an interior of the upper and being attached to the base portion at an attachment area that extends longitudinally along the base portion; a plurality of support members disposed under the foot stabilizer system and extending out from the interior of the upper; wherein one or more of the plurality of support members are attached to one or more of the plurality of strap members and a portion of the upper; and wherein the foot stabilizer system is decoupled from the base portion at a midfoot region.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
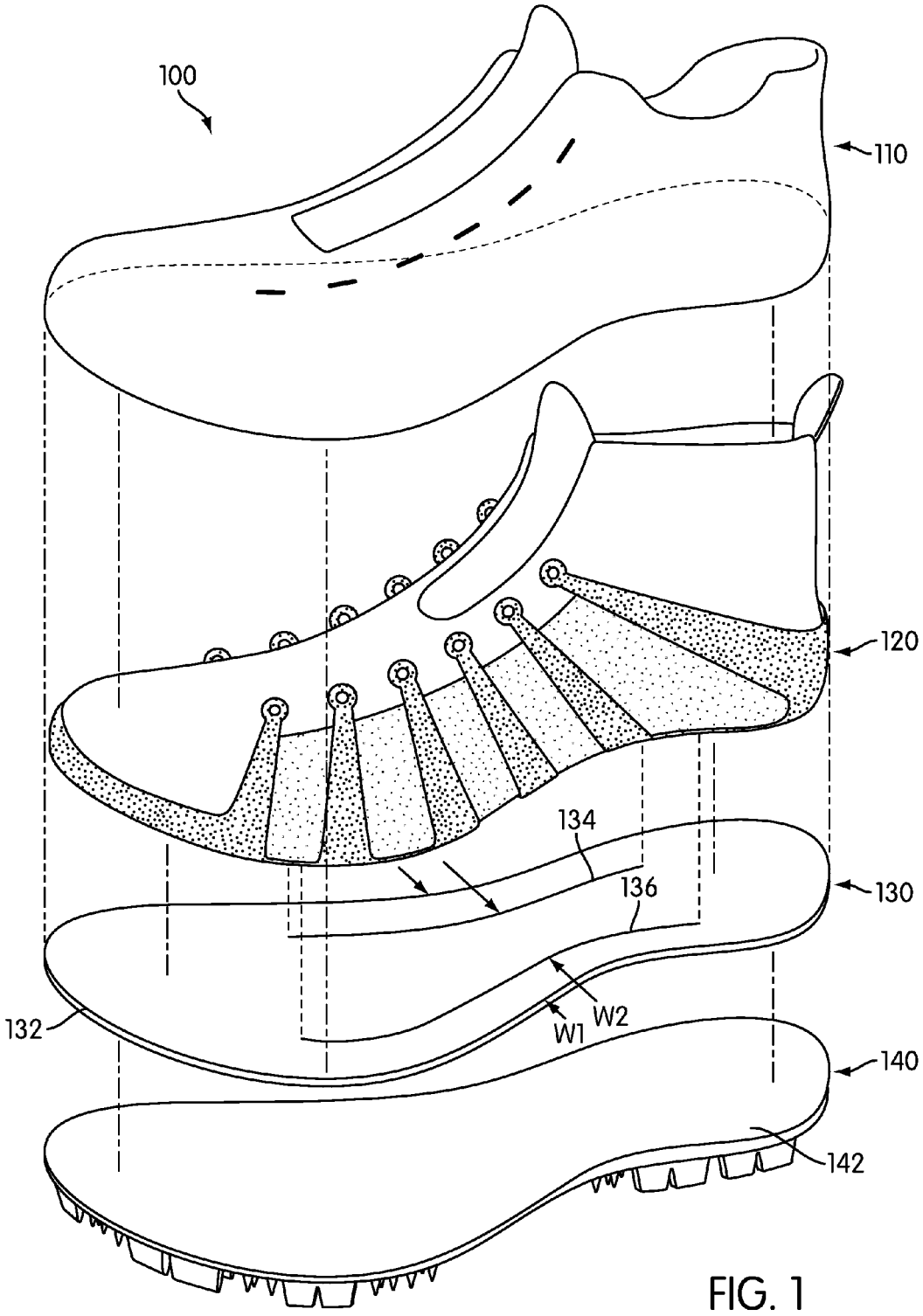
FIG. 1 is an exploded view of an exemplary embodiment of an article of footwear including a decoupled foot stabilizer system.

The Figures disclose various exemplary embodiments of an article of footwear, also referred to simply as article, with a decoupled foot stabilizer system. A foot stabilizer system may be incorporated into any style of footwear including, for example, athletic footwear. A foot stabilizer system may be configured to provide lateral support to the foot of a user in sports requiring dynamic movement. For clarity, the following detailed description discusses articles of athletic footwear in the form of shoes associated with various sports, including, but not limited to: baseball, basketball, football, running, soccer, tennis, and other sports and activities where movement may be aided by an article of footwear provided with a foot stabilizer system. However, it should be noted that in other embodiments any other type of footwear could be used including, but not limited to: hiking boots, sneakers, as well as other kinds of shoes. Articles of footwear used with a foot stabilizer system may also take the form of any non-athletic shoe, including, but not limited to: dress shoes, loafers, sandals, and boots. An individual skilled in the relevant art will appreciate, therefore, that the concepts disclosed herein apply to a wide variety of footwear styles, in addition to the specific style discussed in the following material and depicted in the accompanying figures.

Additionally, while a single article of footwear is shown in the current embodiments, the same principles taught in this detailed description could be applied to a second, complementary article of footwear.

For consistency and convenience, directional adjectives are employed throughout this detailed description corresponding to the illustrated embodiments. The term "longitudinal" as used throughout this detailed description and in the claims refers to a direction extending a length or major axis of an article. In some cases, the longitudinal direction may extend from a forefoot region to a heel region of the article. Also, the term "lateral" as used throughout this detailed description and in the claims refers to a direction extending a width or minor axis of an article. In other words, the lateral direction may extend between a medial side and a lateral side of an article. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. In addition, the term "proximal" refers to a portion of a footwear component that is closer to a portion of a foot when an article of footwear is worn. Likewise, the term "distal" refers to a portion of a footwear component that is further from a portion of a foot when an article of footwear is worn. It will be understood that each of these directional adjectives may be applied to individual components of an article, including an upper and/or a sole structure.

For purposes of general reference, an article of footwear may be divided into three regions: forefoot region 10, midfoot region 12, and heel region 14. Forefoot region 10 may be generally associated with the toes and joints connecting the metatarsals with the phalanges. Midfoot region 12 may be generally associated with the arch of a foot. Likewise, heel region 14 may be generally associated with the heel of a foot, including the calcaneus bone. In addition, an article of footwear may include lateral side 16 and medial side 18. In particular, lateral side 16 and medial side 18 may be opposing sides of the article. Lateral side 16 and medial side 18 may be located on either side of a longitudinal axis 20 bisecting the article. Furthermore, both lateral side 16 and medial side 18 may extend through forefoot region 10, midfoot region 12, and heel region 14.

It will be understood that forefoot region 10, midfoot region 12, and heel region 14 are only intended for purposes of description and are not intended to demarcate precise regions of an article of footwear. For example, in some cases, one or more of the regions may overlap. Likewise, lateral side 16 and medial side 18 are intended to represent generally two sides, rather than precisely demarcating an article of footwear into two halves. In addition, forefoot region 10, midfoot region 12, and heel region 14, as well as lateral side 16 and medial side 18, may also be applied to individual components of an article of footwear, including a foot stabilizer system, a sole structure, an upper, and/or any other component associated with the article.

FIGS. 1 through 10 illustrate an exemplary embodiment of an article of footwear 100 with a decoupled foot stabilizer system 120. Referring to FIG. 1, article of footwear 100 is shown in an exploded view. In some embodiments, article 100 may include a number of individual components. In this embodiment, article 100 includes decoupled foot stabilizer system 120. Article 100 additionally may include an upper 110 and a sole structure 140. Generally, upper 110 provides a covering for the foot that comfortably receives and securely positions the foot with respect to sole structure 140. Upper 110 may be made from any suitable material, including but not limited to, for example, nylon, natural leather, synthetic leather, natural rubber, or synthetic rubber. In some cases, upper 110 may be made of any suitable knitted, woven or non-woven material.

Sole structure 140 may be generally positioned between a foot of a wearer and the ground. In some embodiments, sole structure 140 may include one or more of an outsole, a midsole, a single piece sole, and/or any number of additional components associated with a conventional sole. In other embodiments, sole structure 140 may include one or more tread elements for engaging with the ground. While FIGS. 1 through 10 illustrate sole structure 140 having one or more tread elements, including a cleat, it should be understood that article 100 may include sole structure 140 as described herein without limitation to any specific type of tread element.

In some embodiments, sole structure 140 may further include a portion associated with a recess or a housing. In an exemplary embodiment, a recess or housing in a portion of sole structure 140 may be provided for receiving an electronic module, e.g., for sensing physical and/or physiological characteristics associated with use of the footwear or other devices.

In some embodiments, article 100 may include a base portion 130. Base portion 130 may be generally positioned between the foot of a wearer and sole structure 140. In some embodiments, base portion 130 may be secured to a lower portion of upper 110 and an upper portion of sole structure 140. In this embodiment, base portion 130 may be secured to a lower portion of upper 110 along an outer periphery 132. Additionally, in this embodiment, base portion 130 may be secured to a top surface 142 of sole structure 140. In different embodiments, base portion 130 may include one or more of a midsole, strobel, and/or a portion of upper 110 that is configured to be attached to sole structure 140.

In some embodiments, base portion 130 may be disposed between foot stabilizer system 120 and sole structure 140. In one embodiment, foot stabilizer system 120 may be secured to base portion 130. In an exemplary embodiment, foot stabilizer system 120 may be secured to base portion 130 in a manner such that foot stabilizer system 120 is selectively decoupled from one or more portions of article 100. As shown in FIG. 1, foot stabilizer system 120 may be selectively decoupled from a midfoot region of article 100 by securing foot stabilizer system 120 to base portion 130 along an attachment area having a narrower width than the width of base portion 130.

In this embodiment, base portion 130 may be associated with a first width W1 at a midfoot region. First width W1 generally corresponds to the width of article 100 at the midfoot region. In this embodiment, foot stabilizer system 120 may be attached to base portion 130 along an attachment area at the midfoot region defined by first attachment portion 134 and a second attachment portion 136. In other embodiments, foot stabilizer system 120 may be secured to base portion 130 at additional attachment portions located in other regions of article 100. In one embodiment, foot stabilizer system 120 optionally may be attached to a forefoot region and/or a heel region of base portion 130.

In one embodiment, first attachment portion 134 and second attachment portion 136 may be associated with a second width W2 at the midfoot region. In an exemplary embodiment, second width W2 is smaller than first width W1. In other embodiments, second width W2 may be substantially smaller than first width W1. By securing foot stabilizer system 120 along an attachment area that is narrower than base portion 130, a foot disposed inside article 100 may move foot stabilizer system 120 relative to the other components of article 100. With this arrangement, foot stabilizer system 120 may be selectively decoupled from one or portions of article 100.

In some embodiments, first attachment portion 134 and second attachment portion 136 may be disposed approximately similar distances from outer periphery 132 of base portion 130 on a medial side and a lateral side. In other embodiments, first attachment portion 134 and/or second attachment portion 136 may be associated with second width W2 disposed at dissimilar distances from outer periphery 132. In some cases, first attachment portion 134 may be located closer to outer periphery 132 on medial side. In other cases, second attachment portion 136 may be located closer to outer periphery 132 on lateral side. With this arrangement, foot stabilizer system 120 may be selectively decoupled in greater degree on a medial side or a lateral side of article 100.

In different embodiments, any one or more of the width of the attachment area and the number and location of attachment portions may be varied to provide different amounts of decoupling to foot stabilizer system 120 relative to base portion 130 and article 100.

Figure 2:
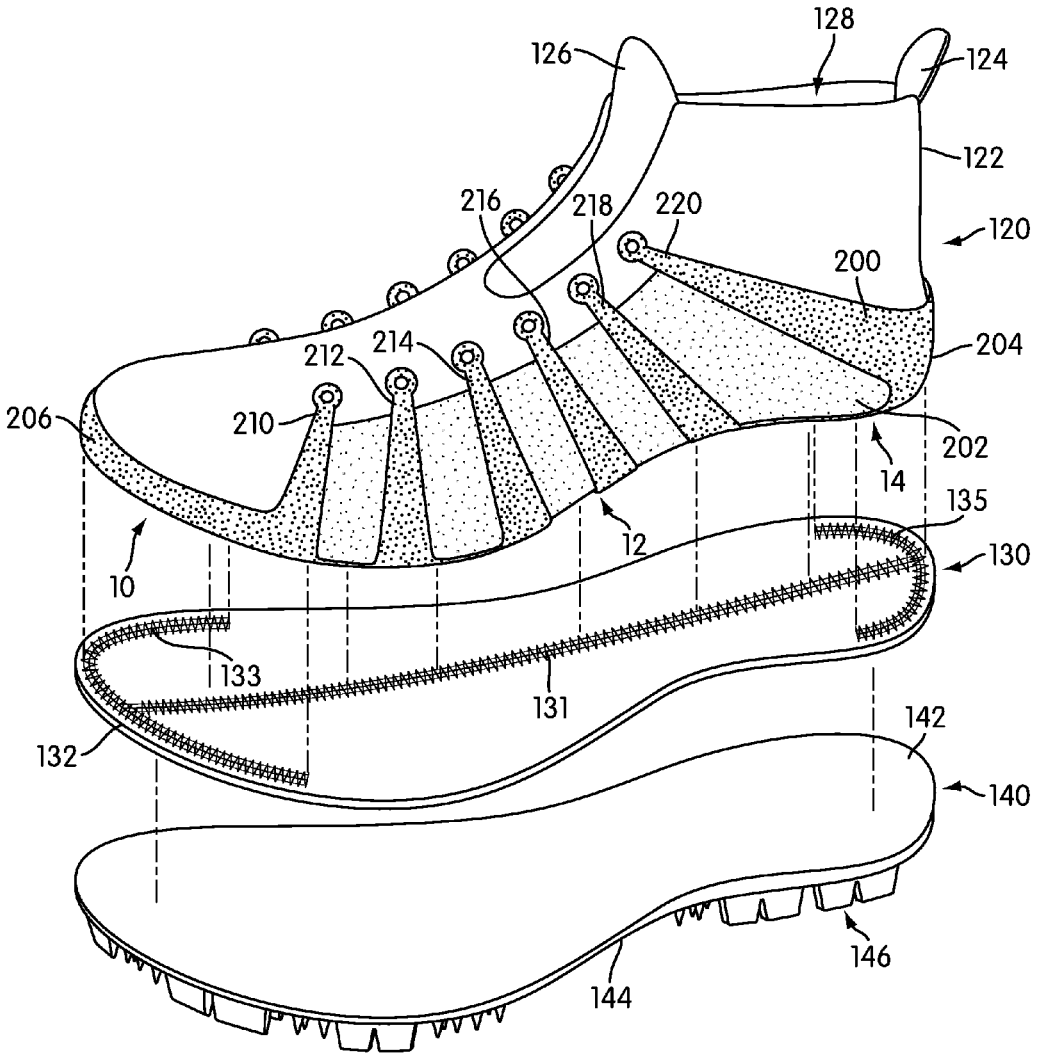
FIG. 2 is an exploded view of an exemplary embodiment of a decoupled foot stabilizer system attached to a base portion.

Referring now to FIG. 2, article 100 is illustrated without upper 110. In some embodiments, foot stabilizer system 120 may include a number of components for providing support and/or stability to a foot of a wearer. In an exemplary embodiment, foot stabilizer system 120 may include a bootie 122. In some embodiments, bootie 122 may include a sleeve for surrounding a foot of a wearer of article of footwear 100. In an exemplary embodiment, bootie 122 may include a throat hole or opening 128 for receiving a foot of a wearer into the interior of foot stabilizer system 120. In some embodiments bootie 122 also may include a heel tab 124 and/or tongue tab 126. Heel tab 124 and/or tongue tab 126 may be used by a wearer to assist with placing a foot into throat opening 128 of bootie 122. In an exemplary embodiment, bootie 122 may be made from an elastic material. In different embodiments, bootie 122 may be made from any one or a combination of elastic or stretchable materials, including, but not limited to: woven synthetic fibers, polyurethane, nylon, cotton, spandex, neoprene, and other natural and synthetic materials.

In some embodiments, foot stabilizer system 120 may include a plurality of strap members 200. In an exemplary embodiment, plurality of strap members 200 may be configured to provide stability and/or support to foot stabilizer system 120. In an exemplary embodiment, plurality of strap members 200 may be configured to support a foot of a wearer. In one embodiment, foot stabilizer system 120 may include plurality of strap members 200 on opposite sides. In an exemplary embodiment, plurality of strap members 200 may be positioned on a lateral side and a medial side of foot stabilizer system 120. In the embodiment shown in FIG. 2, foot stabilizer system 120 may include plurality of strap members 200 disposed over an outside surface of bootie 122.

Referring again to FIG. 2, in this embodiment, plurality of strap members 200 may include a first strap member 210, a second strap member 212, a third strap member 214, a fourth strap member 216, a fifth strap member 218, and a sixth strap member 220 disposed on a lateral side of foot stabilizer system 120. Similarly, plurality of strap members 200 may include a corresponding number of strap members disposed on the medial side of foot stabilizer system 12. In some cases, plurality of strap members 200 may be made of a substantially flexible material. In other cases, plurality of strap members 200 may be made of a substantially rigid material. In still other cases, plurality of strap members 200 may be made of a material that is inelastic in one direction and elastic in another direction. In different embodiments, plurality of strap members 200 may be made of any suitable material that provides sufficient support while still allowing some flexibility, including, but not limited to: polymers, rubbers, plastics, elastomeric materials, and other materials.

In some embodiments, one or more portions of foot stabilizer system 120 including one or more strap members, may be made of thread structural elements. In some cases, one or more portions of a foot stabilizer system, including one or more strap members, may be made of the thread structural elements disclosed in copending and commonly owned U.S. Pat. No. 7,870,681, currently U.S. patent application Ser. No. 11/441,924, entitled "Article of Footwear Having An Upper With Thread Structural Elements", and filed on May 25, 2006; U.S. Pat. No. 8,312,645, currently U.S. patent application Ser. No. 12/505,740, entitled "Material Elements Incorporating Tensile Strands", and filed on Jul. 20, 2009; U.S. Pat. No. 8,312,646, currently U.S. patent application Ser. No. 12/546,017, entitled "Article Of Footwear Incorporating A Tensile Element", and filed on Aug. 24, 2009; and U.S. Pat. No. 8,418,380, currently U.S. patent application Ser. No. 12/546,019, entitled "Article Of Footwear Having An Upper Incorporating A Tensile Strand With A Cover Layer", and filed on Aug. 24, 2009, all of which are incorporated herein by reference in their entirety.

In some embodiments, foot stabilizer system 120 may include plurality of strap members 200 associated with one or more of forefoot region 10, midfoot region 12, and heel region 14. In an exemplary embodiment, first strap member 210 and/or second strap member 212 may be associated with forefoot region 10, third strap member 214, fourth strap member 216, and/or fifth strap member 218 may be associated with midfoot region 12, and sixth strap member 220 may be associated with heel region 14. In different embodiments, various numbers of strap members may be associated with each of forefoot region 10, midfoot region 12, and heel region 14. In other embodiments, foot stabilizer system 120 may include more or less strap members. In some cases, the plurality of strap members may be disposed in pairs on opposite sides of foot stabilizer system 120. In other cases, the plurality of strap members may be disposed asymmetrically. In other cases, one or more strap members may be disposed along one side of foot stabilizer system 120.

In some embodiments, the plurality of strap members may be connected to each other using a webbing material. As shown in FIG. 2, a webbing 202 may connect the plurality of strap members along the lateral side of foot stabilizer system 120. In this embodiment, webbing 202 is disposed between first strap member 210, second strap member 212, third strap member 214, fourth strap member 216, fifth strap member 218, and sixth strap member 220. Similarly, foot stabilizer system 120 may include a webbing material for connecting the plurality of strap members along the medial side. In some cases, webbing 202 may be disposed between fewer strap members. In other cases, webbing material may be disposed between two or more strap members on a single side of foot stabilizer system 120. In different embodiments, webbing material may be disposed between two or more strap members associated with one or more of forefoot region 10, midfoot region 12, and heel region 14.

In different embodiments, webbing 202 may be made of any one or a combination of elastic or stretchable materials, including, but not limited to: woven synthetic fibers, polyurethane, nylon, cotton, spandex, neoprene, and other natural and synthetic materials. In some embodiments, webbing 202 may be formed together with one or more portions of foot stabilizer system, including one or more strap members. In some embodiments, webbing 202 may include thread structural elements, as disclosed above. In some cases, one or more portions of an article, including webbing 202, may be made of the textile material disclosed in copending and commonly owned U.S. Patent Application Publication 2010/0199406, currently U.S. patent application Ser. No. 12/367,274, entitled "Thermoplastic Non-Woven Textile Elements", and filed on Feb. 6, 2009, which application is incorporated herein by reference in its entirety.

In some embodiments, foot stabilizer system 120 may include components configured to protect and/or provide stability and support to various portions of a foot of a wearer. In some embodiments, foot stabilizer system 120 may include one or more components associated with the toes of a foot of a wearer. In an exemplary embodiment, plurality of strap members 200 may include a raised toe portion 206. Raised toe portion 206 may be disposed in an area of forefoot region 10 that generally corresponds to the toes of a wearer. Raised toe portion 206 may be shaped to engage and stabilize the front of the wearer's foot including the toes. In some embodiments, raised toe portion 206 may be sized and dimensioned so as to extend a height and a width sufficient to support the toes of a wearer. Raised toe portion 206 may be formed integrally with one or more strap members located on a lateral side and/or a medial side. In some embodiments, raised toe portion 206 may extend along forefoot region 10 between first strap member 210 and a corresponding strap member on the opposing side. In other embodiments, raised toe portion 206 may extend between more or less of plurality of strap members 200. In some cases, raised toe portion 206 may extend along a portion of an outer periphery of bootie 122. In other cases, raised toe portion 206 also may extend over a portion of top surface and/or bottom surface of bootie 122 in forefoot region 10.

In some embodiments, foot stabilizer system 120 may include one or more components associated with the heel of a foot of a wearer. In some embodiments, plurality of strap members 200 may include a heel counter 204. Heel counter 204 may be disposed in an area of heel region 14 that generally corresponds to the heel of a wearer. Heel counter 204 may be shaped to engage and stabilize the heel of the wearer. In some embodiments, heel counter 204 may be sized and dimensioned so as to extend a height and a width sufficient to support a heel of a wearer. Heel counter 204 may be formed integrally with one or more strap members located on a lateral side and/or a medial side. In some embodiments, heel counter 204 may be formed by a pair of strap members disposed on either side of foot stabilizer system 120. In the exemplary embodiment shown in FIG. 2, heel counter 204 may extend along heel region 14 between sixth strap member 220 and a corresponding strap member disposed on the opposing side. In other embodiments, heel counter 204 may extend between more or less of the plurality of strap members. In some cases, heel counter 204 may extend along a portion of an outer periphery of bootie 122. In other cases, heel counter 204 also may extend over a portion of bottom surface of bootie 122 in heel region 14.

Referring again to FIG. 2, plurality of strap members 200 may be configured to conform to the shape of a foot. In some embodiments, plurality of strap members 200 may be sized and dimensioned so as to substantially enclose the foot of a wearer. In an exemplary embodiment, plurality of strap members 200 extend initially laterally away from a longitudinal axis and then curve upward and inward. In other embodiments, plurality of strap members 200 may be shorter and terminate lower but still be long enough so that adequate lateral support is provided.

In some embodiments, plurality of strap members 200 may extend to a position that is substantially above the top of the foot. In the exemplary embodiment illustrated in FIG. 2, first strap member 210, second strap member 212, third strap member 214, fourth strap member 216, fifth strap member 218, and sixth strap member 220 terminate at distal ends located above the surface of bootie 122 along the lateral side. Lateral side may include a corresponding arrangement of plurality of strap members 200. In this way, plurality of strap members 200 may substantially enclose the foot. In different embodiments, plurality of strap members 200 may be various combinations of sizes, widths, curvatures, thicknesses, and/or stiffnesses.

In some embodiments, plurality of strap members 200 may extend to an underside of foot stabilizer system 120, such that a portion of plurality of strap members 200 will underlie or extend underneath the foot of a wearer when disposed within foot stabilizer system 120. In some embodiments, one or more strap members of the plurality of strap members 200 extending to the underside of foot stabilizer system 120 may be joined to each other at a joined region corresponding approximately to a longitudinal axis. In other embodiments, plurality of strap members 200 extending to the underside of foot stabilizer system 120 may be integrally formed. In some embodiments, raised toe portion 202 and/or heel counter 204 may be joined and/or integrally formed with one or more strap members on the underside of foot stabilizer system 120.

In some embodiments, plurality of strap members 200 may be configured to provide support to different regions of a foot of a wearer. In some embodiments, plurality of strap members 200 may be arranged so as to substantially support the foot of a wearer. In an exemplary embodiment, plurality of strap members 200 may be configured to support regions of a foot of a wearer generally corresponding to forefoot region 10, midfoot region 12, and heel region 14. In some embodiments, midfoot region 12 may be associated with an arch of the foot. In the exemplary embodiment of FIG. 5, one or more of first strap member 210 and/or second strap member 212 may be configured as a forefoot member to provide support to forefoot region 12 of the wearer's foot. In this embodiment, one or more of third strap member 214, fourth strap member 216, and/or fifth strap member 218 may be configured as an arch member to provide support to midfoot region 12 of the wearer's foot. In some embodiments, an arch member may extend underneath the foot of a wearer to support the arch of the foot. In some embodiments, sixth strap member 220 may be configured as a heel member to provide support to heel region 14 of the wearer's foot.

In some embodiments, foot stabilizer system 120 including plurality of strap members 200 may be secured to base portion 130. In an exemplary embodiment, foot stabilizer system 120 may be attached to base portion 130 in a manner such that foot stabilizer system 120 may be decoupled from article 100 at one or more portions of midfoot region 12. In one embodiment, portions of foot stabilizer system 120 may be secured to base portion 130 at one or more of toe region 10, midfoot region 12, and/or heel region 14. In an exemplary embodiment, foot stabilizer system 120 may be attached to base portion 130 at an attachment area. In one embodiment, the attachment area may include a central attachment portion 131. In some embodiments, foot stabilizer system 120 additionally may be secured to base portion at attachment areas corresponding to one or more of a forefoot attachment portion 133 and/or a heel attachment portion 135.

Figure 3:
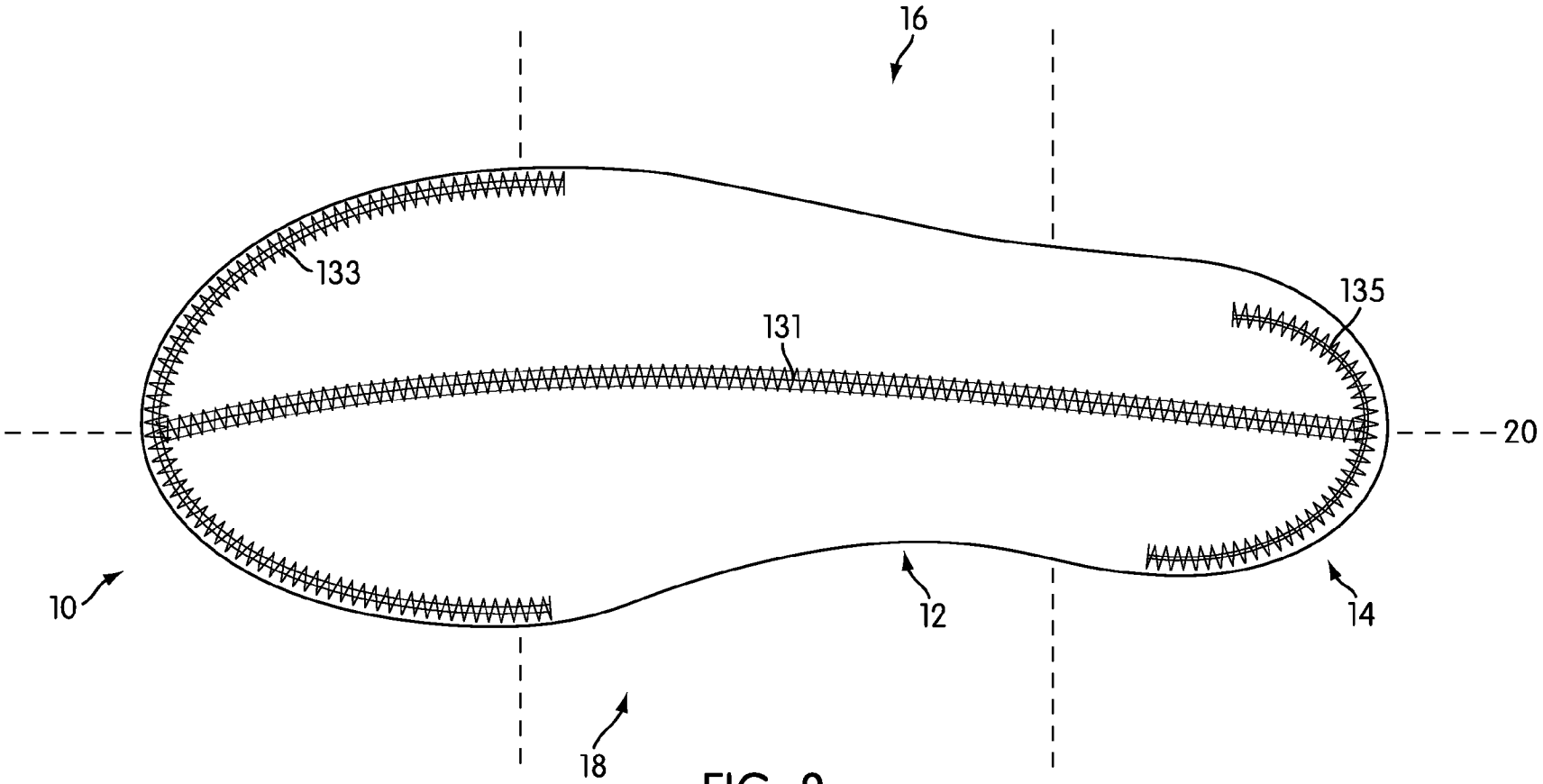
FIG. 3 is a bottom view of an exemplary embodiment of a decoupled foot stabilizer system attached to a base portion.

Referring now to FIG. 3, in some embodiments, foot stabilizer system 120 may be attached to base portion 130 at one or more attachment areas. In this embodiment, foot stabilizer system 120 may be attached to base portion 130 at a central attachment portion 131 that extends substantially along longitudinal axis 20. In some embodiments, central attachment portion 131 may extend essentially from heel region 14 to forefoot region 10. In some cases, central attachment portion 131 may extend through a portion of midfoot region 12 of base portion 130. In other cases, central attachment portion 131 may not extend through a portion of midfoot region 12.

In some embodiments, foot stabilizer system 120 may be secured to base portion 130 at one or more of toe region 10 and/or heel region 14. With this arrangement, portions of foot stabilizer system 120 associated with the toes and/or heel of a foot of a wearer may be secured to base portion 130 of article 100 while portions of foot stabilizer system 120 associated with midfoot region 12 may be decoupled from base portion 130 and article 100. In some embodiments, foot stabilizer system 120 may be attached to base portion 130 at a forefoot attachment portion 133. Forefoot attachment portion 133 may extend along a portion of base portion 130 near the periphery of forefoot region 10. In some cases, forefoot attachment portion 133 may extend along a portion of forefoot region 10 of base portion 130 associated with lateral side 16 and medial side 18. In other cases, forefoot attachment portion 133 may extend along a portion of forefoot region 10 of base portion 130 associated with only one of lateral side 16 and medial side 18.

In some embodiments, foot stabilizer system 120 may be attached to base portion 130 at a heel attachment portion 135. Heel attachment portion 135 may extend along a portion of base portion 130 near the periphery of heel region 14. In some cases, heel attachment portion 135 may extend along a portion of heel region 14 of base portion 130 associated with lateral side 16 and medial side 18. In other cases, heel attachment portion 135 may extend along a portion of heel region 14 of base portion 130 associated with only one of lateral side 16 and medial side 18. In other embodiments, heel attachment portion 135 and/or forefoot attachment portion 133 also may extend through one or more portions of midfoot region 12 of base portion.

In an exemplary embodiment, central attachment portion 131, forefoot attachment portion 133, and/or heel attachment portion 135 securely attaches foot stabilizer system 120 to base portion 130 using stitching. Generally, any kind of stitching may be used to accomplish the attachment of foot stabilizer system 120 to base portion 130. In some cases, simple stitches may be used. In other cases, more complex stitches may be used. Examples of various stitches that may be used include, but are not limited to: backstitches, basting stitches, blind stitches, buttonhole stitches, chain stitches, cross-stitches, embroidery stitches, feather stitches, hemming stitches, lock stitches, padding stitches, running stitches, slip stitches, stretch stitches, top stitches, whip stitches, zigzag stitches as well as any other types of machine or manual stitches.

In different embodiments, central attachment portion 131, forefoot attachment portion 133, and/or heel attachment portion 135 may include various attachment mechanisms for attaching foot stabilizer system 120 to base portion 130, including, but not limited to: adhesive, stitching, hook and loop fasteners, and other methods of fixed and/or removable attachment. In addition, while central attachment portion 131, forefoot attachment portion 133, and/or heel attachment portion 135 are illustrated as having a width of a single stitch, it should be understood that each attachment portion may include one or more additional attachment portions that define an attachment area of any width less than the width of base portion 130.

In some embodiments, base portion 130 may be associated with sole structure 140. In one embodiment, base portion 130 may be secured to top surface 142 of sole structure 140. Top surface 142 may be configured to attach base portion 130 to sole structure 140. In an exemplary embodiment, base portion 130 may be attached to top surface 142 of sole structure 140 using adhesive. In other embodiments, base portion 130 may be attached to top surface 142 of sole structure 140 using any suitable attachment mechanism, including, but not limited to one or more of adhesive, heat, pressure, stitching, and other methods of attachment.

In some embodiments, sole structure 140 may include one or more components. In one embodiment, sole structure 140 may include an outsole 144. Outsole 144 may be any conventional outsole used with an article of footwear. In an exemplary embodiment, outsole 144 of sole structure 140 may include one or more tread elements 146 for engaging with the ground. Tread elements 146 may be any conventional tread elements used with an article of footwear, including, but not limited to a cleat. In other embodiments, sole structure 140 may not include tread elements 146.

Figure 4:
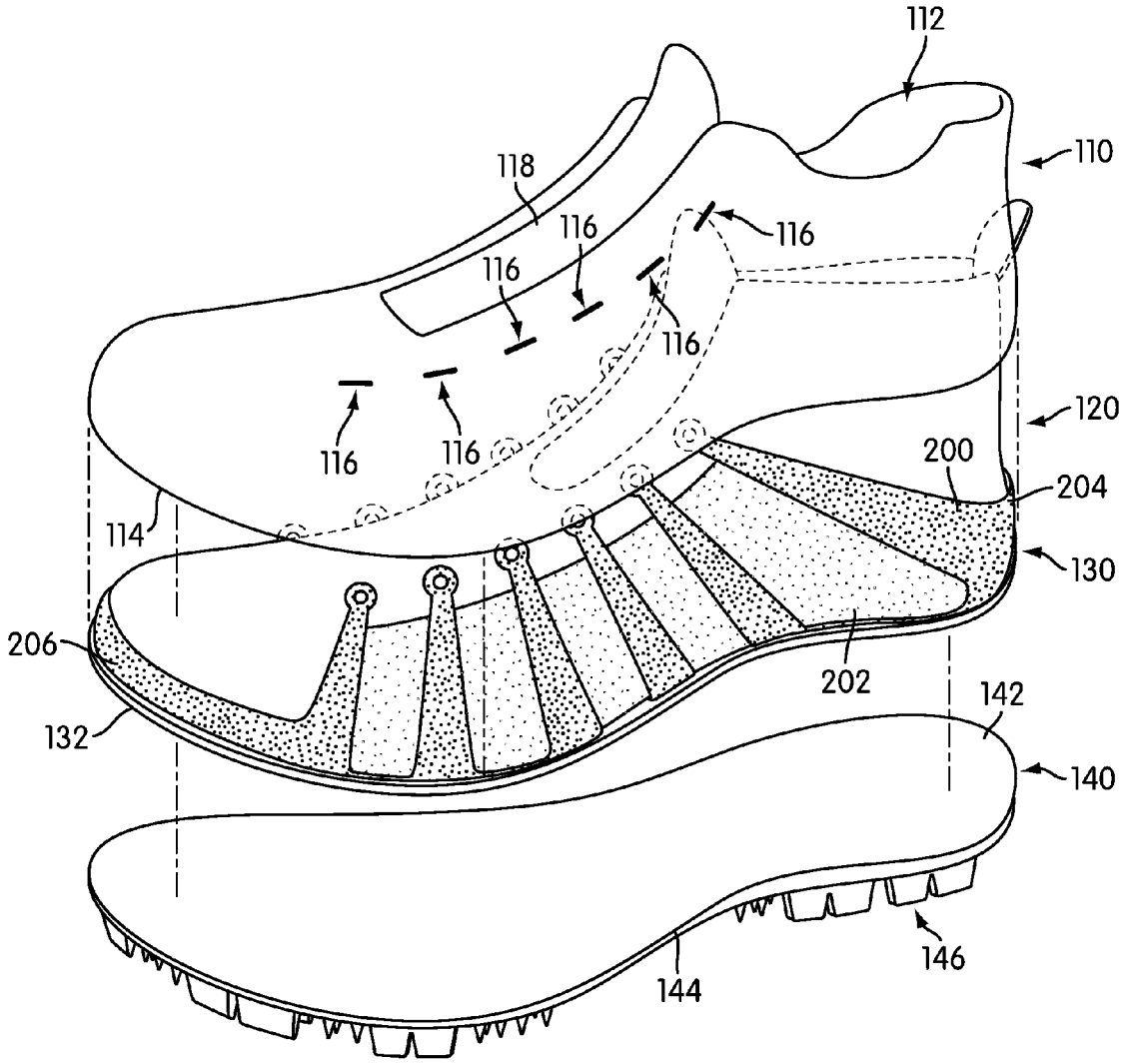
FIG. 4 is an exploded view of an exemplary embodiment of an article of footwear including a decoupled foot stabilizer system attached to a base portion.

FIG. 4 illustrates an exploded view of an exemplary embodiment of article of footwear 100 incorporating foot stabilizer system 120. In this embodiment, upper 110 is illustrated being secured to foot stabilizer system 120 attached to base portion 130. It should be understood that the order of the steps to assemble article 100 are merely exemplary and may be performed in any order. In some embodiments, upper 110 may be secured to base portion 130 prior to foot stabilizer system 120 being attached to base portion 130.

In some embodiments, upper 110 may include one or more components. Typically, upper 110 may be configured to receive a foot of a wearer. In some embodiments, upper 110 may include an entry hole or throat opening 112 configured to receive a foot of a wearer. With this arrangement, entry hole or throat opening 112 may allow a foot to be inserted into an interior article 100.

Referring again to FIG. 4, upper 110 may include a plurality of openings 116 for receiving the distal ends of plurality of strap members 200. In some embodiments, lacing holes associated with the distal ends of plurality of strap members 200 of foot stabilizer system 120 may extend out from the interior of article of footwear 100 through plurality of openings 116 in upper 110. In an exemplary embodiment, plurality of openings 116 may include slits. In other embodiments, plurality of openings 116 may be any type of opening in upper 110 that allows plurality of strap members 200 to extend out from the interior of article 100. In some cases, each of the plurality of openings 116 may be associated with a single strap member of foot stabilizer system 120. In other cases, multiple strap members may be associated with each opening. In some cases, plurality of openings 116 may be sized and dimensioned so as to allow the distal ends of plurality of strap members 200 to pass through. In other cases, plurality of openings 116 may be sized and dimensioned so as to allow movement of plurality of strap members 200 within openings 116. In some cases, openings 116 may be configured to prevent the distal ends of plurality of strap members 200 to slip back into the interior of article of footwear 100.

In an exemplary embodiment, upper 110 also may include a tongue area 118. In this embodiment, tongue area 118 may include a portion of upper 110 that may be tightened around a foot of a wearer. In some embodiments, tongue area 118 may include opposing sides of upper 110 that may be pulled together using laces. In some cases, tongue area 118 may include a tongue and a tongue opening. In other cases, tongue area 118 may include an elastic or stretchable region of upper 110.

In some embodiments, upper 110 may be secured to base portion 130. In this embodiment, upper 110 may be attached to base portion 130 including foot stabilizer system 120 so as to enclose foot stabilizer system 120 in the interior of article 100. In some cases, upper 110 and base portion 130 may be attached by stitching. In one embodiment, a lower periphery 114 of upper 110 may be strobel stitched to outer periphery 132 of base portion 130. In other embodiments, other types of stitching may be used to attach upper 110 and base portion 130. In other cases, upper 110 and base portion 130 may be secured using other attachment mechanisms, including, but not limited to: adhesive, heat bonding, pressure, and any other method of attachment. In other embodiments, more or less of upper 110 may be secured to base portion 130.

In some embodiments, base portion 130 attached to upper 110 and/or foot stabilizer system 120 may be secured to sole structure 140 to assemble article 100. In an exemplary embodiment, top surface 142 may be configured to attach base portion 130 to sole structure 140, as described above. In one embodiment, base portion 130 may be attached to top surface 142 of sole structure 140 using adhesive. In other embodiments, base portion 130 may be attached to top surface 142 of sole structure 140 using any suitable attachment mechanism, including, but not limited to one or more of adhesive, heat, pressure, stitching, and other methods of attachment.

Figure 5:
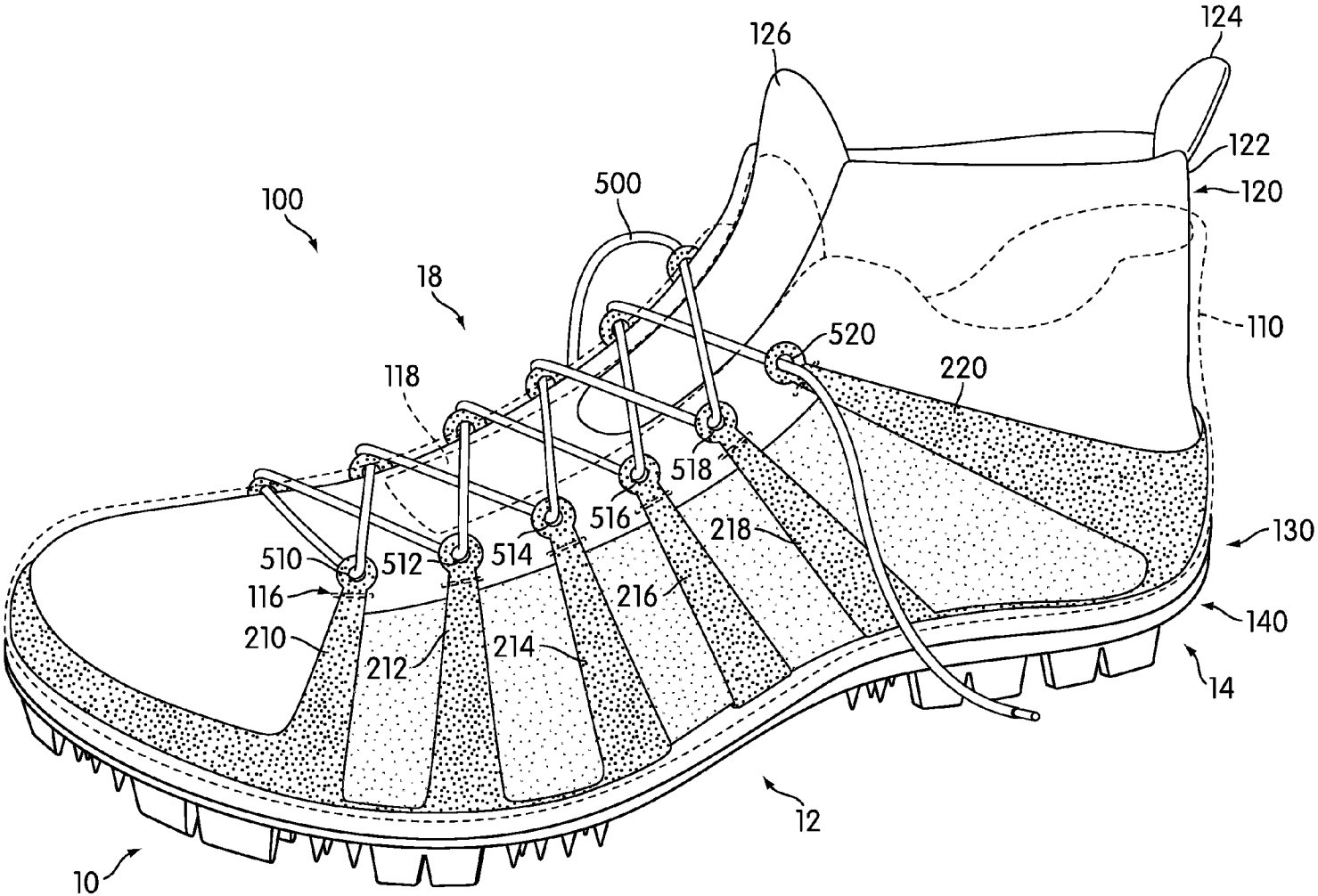
FIG. 5 is an isometric view of an exemplary embodiment of an article of footwear including a decoupled foot stabilizer system.

FIG. 5 illustrates an exemplary embodiment of article 100 including decoupled foot stabilizer system 120. In this embodiment, upper 110 is illustrated in an outline view to reveal the arrangement of foot stabilizer system 120 within the interior of article 100. In some embodiments, foot stabilizer system 120 may be configured with a mechanism for tightening foot stabilizer system 120 around a foot of a wearer. In one embodiment, foot stabilizer system 120 may include one or more portions of plurality of strap members 200 associated with tongue area 118 of upper 110 that may be tightened around a foot of a wearer. In some cases, plurality of strap members 200 may extend out from the interior of article 100 to tongue area 118 through openings 116 in upper 110. In other embodiments, upper 110 may include other openings configured to allow plurality of strap members 200 to extend out to tongue area 118.

In some embodiments, each of the plurality of strap members 200 associated with tongue area 118 of upper 110 may be configured to receive a lace 500. In one embodiment, each of the plurality of strap members 200 may include a lacing hole disposed at the distal end of the strap member. As shown in FIG. 5, a first lacing hole 510 is disposed at a distal end of first strap member 210, and a second lacing hole 512, a third lacing hole 514, a fourth lacing hole 516, a fifth lacing hole 518, and a sixth lacing hole 520 are, respectively, associated with second strap member 212, third strap member 214, fourth strap member 216, fifth strap member 218, and sixth strap member 220. Similarly, one or more lacing holes may be associated with the distal ends of corresponding strap members located on the opposing side of article 100.

In some embodiments, the lacing hole may be an eyelet. In some cases, the lacing hole may be die-cut or stamped in the strap member. In other cases, the lacing hole may include a grommet. In other embodiments, the lacing hole may be a tab formed by attaching a folded over end of a strap member to itself. In different embodiments, the lacing hole may be any opening for receiving a lace or cord.

In some embodiments, article of footwear 100 may include lace 500. In this embodiment, lace 500 runs through the plurality of lacing holes extending out through openings 116 in upper 110. In some embodiments, lace 500 may be disposed in tongue area 118 of upper 110. In some embodiments, lace 500 allows the article of footwear 100 to tighten around the foot of a wearer. In other embodiments, lace 500 allows one or more of plurality of strap members 200 to conform foot stabilizer system 120 to a portion of the wearer's foot.

In some embodiments, article of footwear 100 may include foot stabilizer system 120 with bootie 122. In the exemplary embodiment of FIG. 5, bootie 122 may extend a height above upper 110. In some embodiments, bootie 122 may be substantially the same height as or shorter than upper 110. In other embodiments, bootie 122 may be sized and dimensioned so as to support an ankle of a wearer. As described above, in some embodiments, bootie 122 may include one or more of tongue tab 126 and heel tab 124.

Figure 6:
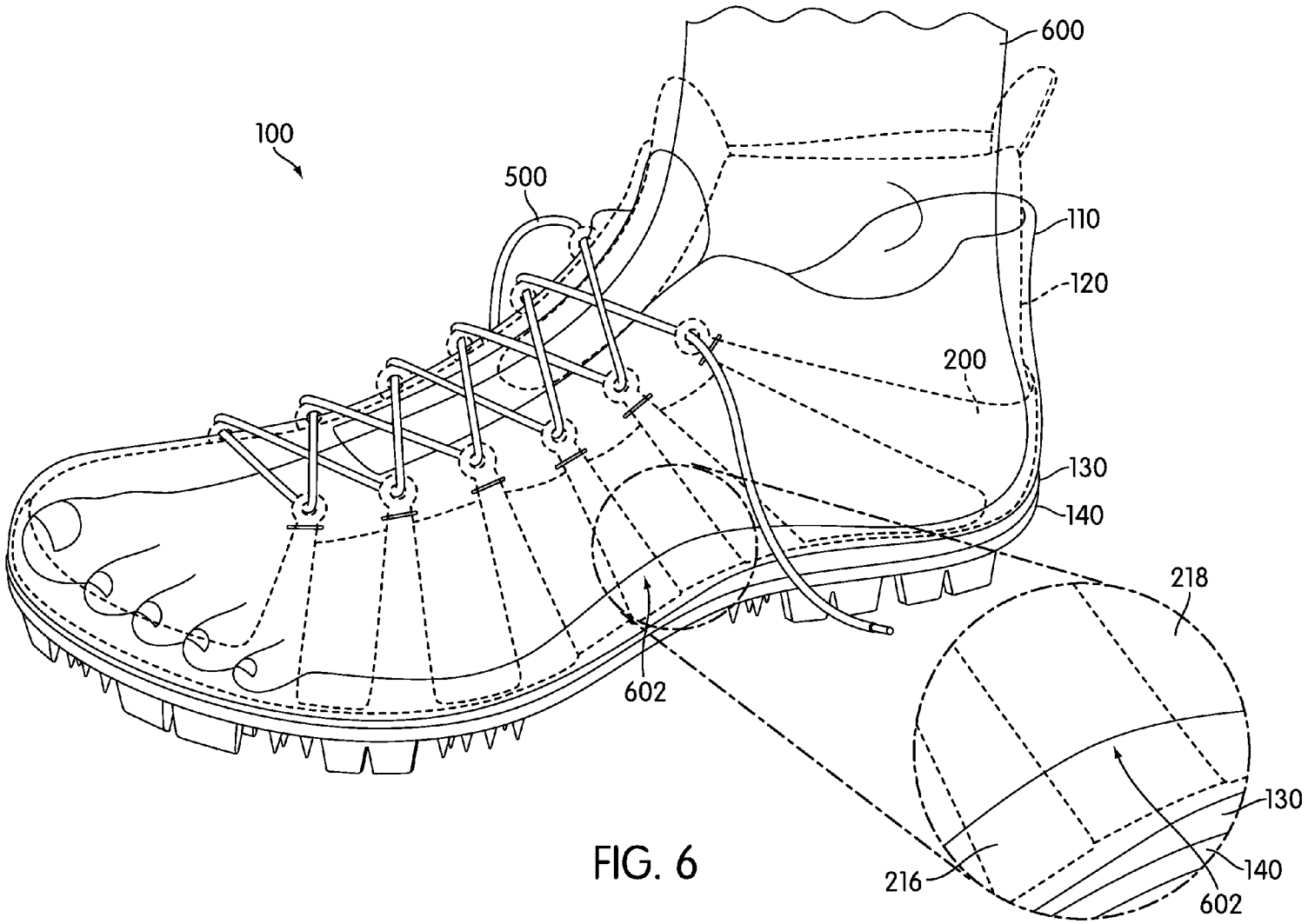
FIG. 6 is an interior view of an exemplary embodiment of an article of footwear including a decoupled foot stabilizer system with a foot.

FIG. 6 illustrates an exemplary embodiment of article of footwear 100 incorporating foot stabilizer system 120 with foot 600 disposed within the interior of article 100. As shown in FIG. 6, foot stabilizer system 120 may be in a loosened position around an arch 602 of foot 600. In some embodiments, the loosened position may correspond generally to resting along a portion of base portion 130 in midfoot region 12. In an exemplary embodiment, foot stabilizer system 120 may be loosely fitted around foot 600 when lace 500 is unfastened. As shown in the close up view illustrated in FIG. 6, a gap or space may be disposed between arch 602 and foot stabilizer system 120 in the loosened position.

Figure 7:
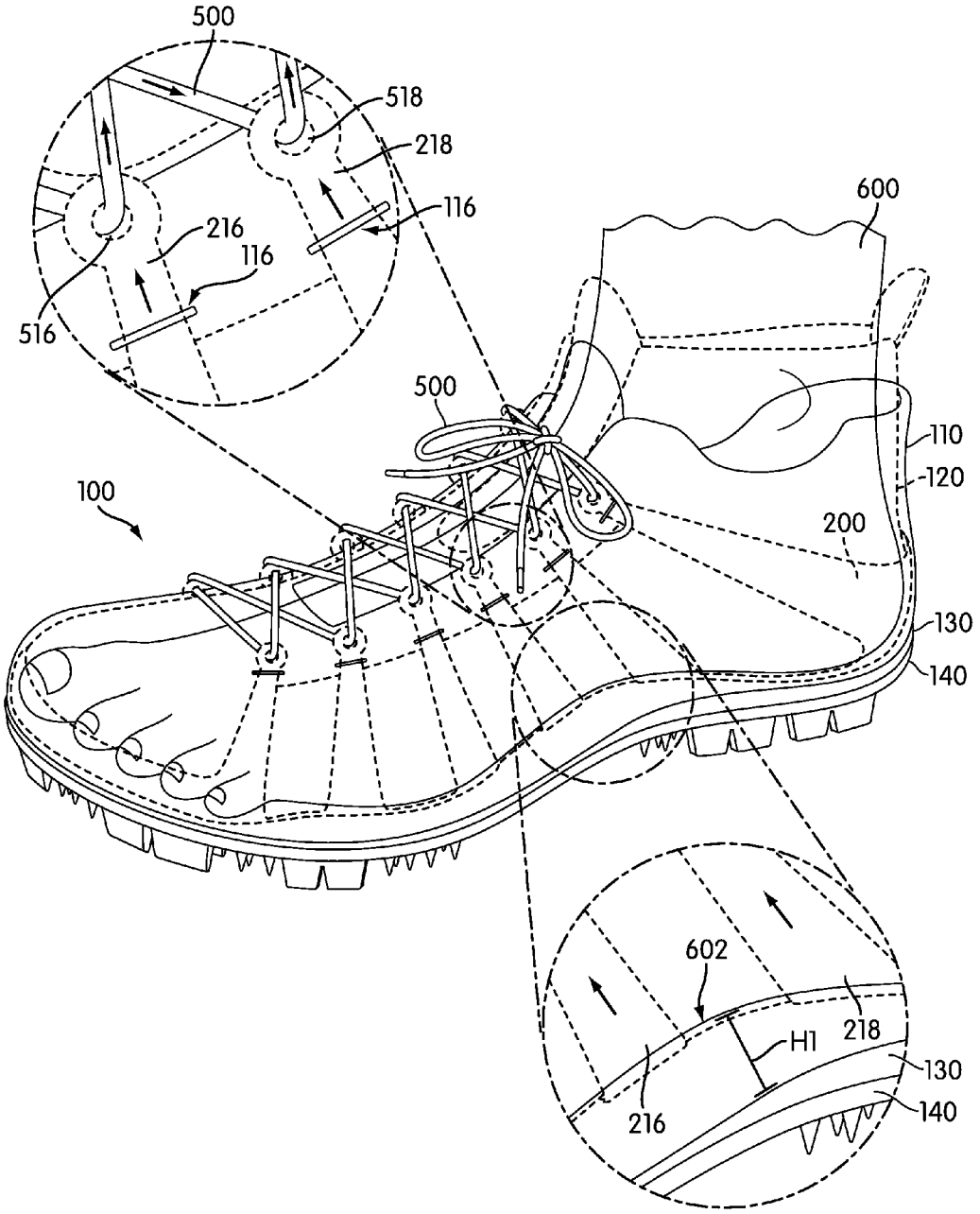
FIG. 7 is a close up and an interior view of an exemplary embodiment of an article of footwear including a decoupled foot stabilizer system conforming to an arch of a foot.

FIG. 7 illustrates an exemplary embodiment of tightening foot stabilizer system 120 to conform to a shape of foot 600 of a wearer. In this embodiment, when lace 500 is pulled tight, including by fastening or tying, foot stabilizer system 120 may tighten around foot 600. In some embodiments, plurality of strap members 200 may be pulled in an upward direction by lace 500. In one embodiment, lace 500 may be configured to run through one or more lacing holes located at the distal ends of plurality of strap members 200 to pull plurality of strap members 200 in an upward direction. As shown in FIG. 7, lace 500 runs through fourth lacing hole 516 at the distal end of fourth strap member 216 and fifth lacing hole 518 at the distal end of fifth strap member 218. In this embodiment, the distal ends including fourth lacing hole 518 and fifth lacing hole 518 may extend out from the interior of article 100 through plurality of openings 116 in upper 110. In this embodiment, lace 500 may exert an upward force on fourth strap member 216 and fifth strap member 218 when lace 500 is pulled tight.

As shown in FIG. 7, fourth strap member 216 and fifth strap member 218 may move in an upward direction tightening foot stabilizer system 120 against foot 600 and conforming bootie 122 to the shape of foot 600. In this embodiment, the upward force caused by lace 500 as it is pulled tight lifts fourth strap member 216 and fifth strap member 218 and moves foot stabilizer system 120 from the loosened position generally resting along base portion 130 as described above, to a tightened position a height H1 above base portion 130. As shown in FIG. 7, the tightened position of foot stabilizer system 120 corresponds generally to resting along arch 602 of foot 600 at midfoot region 12. With this configuration, a gap or space between arch 602 and foot stabilizer system 120 may be closed by tightening lace 500 and a customized fit may be provided to a wearer. In some embodiments, lace 500 may exert an upward force on one or more of the plurality of strap members 200 associated with forefoot region 10, midfoot region 12, and/or heel region 14. In different embodiments, foot stabilizer system 120 may tighten around and/or conform to the shape of foot 600 at one or portions of foot 600, including forefoot region 10, midfoot region 12, and/or heel region 14. In other embodiments, foot stabilizer system 120 and/or plurality of strap members 200 may tighten around and/or conform to the shape of foot 600 on one or both of lateral side 16 and medial side 18.

Figure 8:
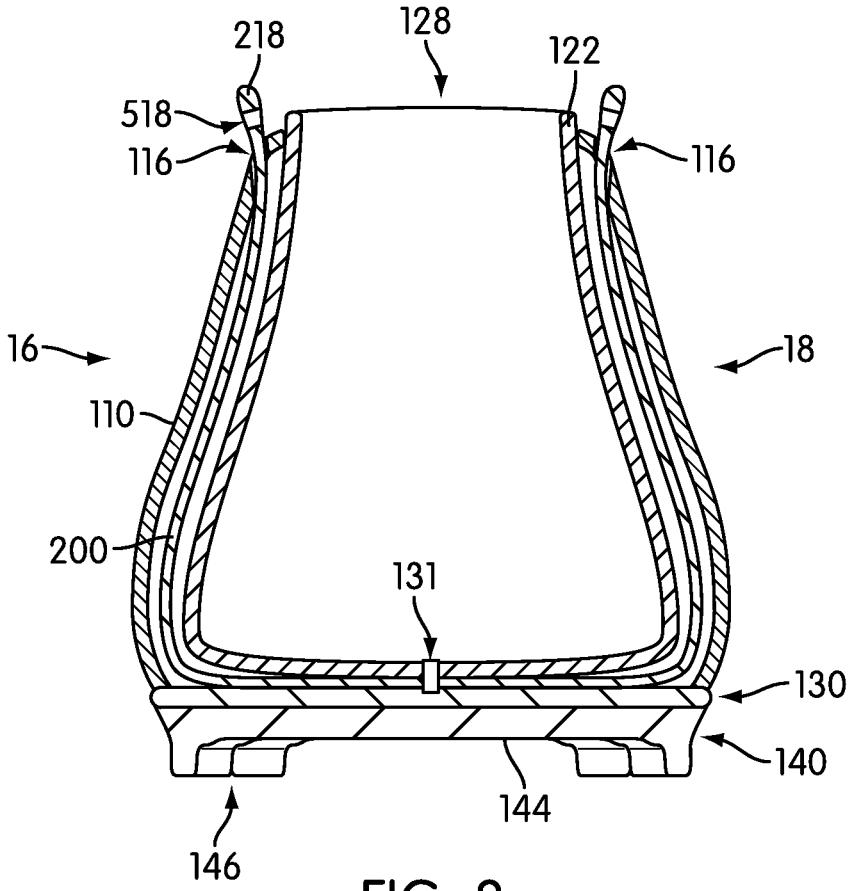
FIG. 8 is a cross-sectional view of an exemplary embodiment of an article of footwear including a decoupled foot stabilizer system.
Figure 9:
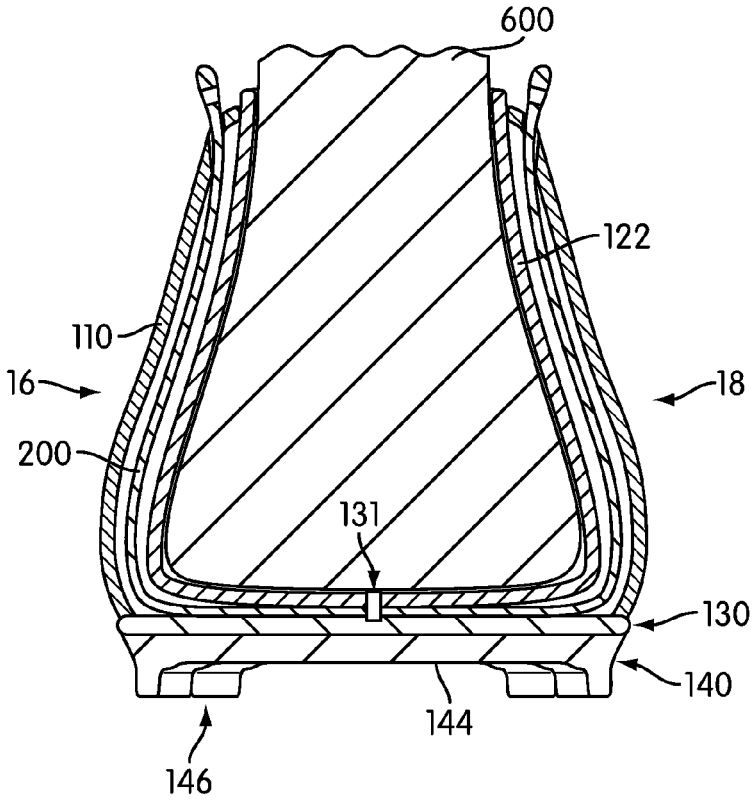
FIG. 9 is a cross-sectional view of an exemplary embodiment of an article of including a decoupled foot stabilizer system with a foot disposed within.
Figure 10:
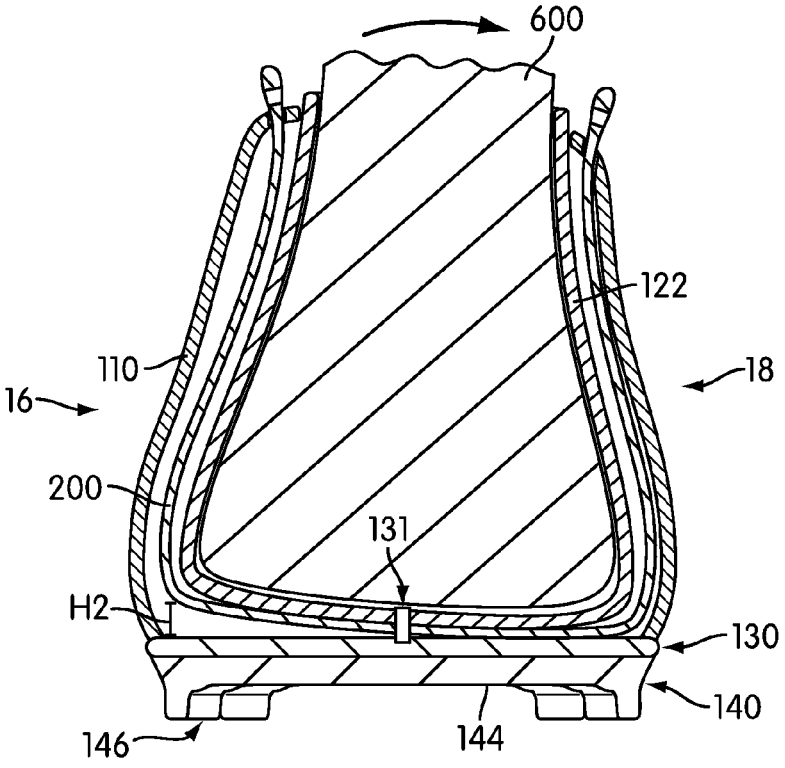
FIG. 10 is a cross-sectional view of an exemplary embodiment of an article of including a decoupled foot stabilizer system with a foot disposed within applying a lateral force.

FIGS. 8 through 10 illustrate a cross-sectional view of an exemplary embodiment of article of footwear 100 incorporating decoupled foot stabilizer system 120. As shown in FIG. 8, bootie 122 may be disposed within the interior of upper 110. In this embodiment, fifth strap member 218 and a corresponding strap member on the opposing side are disposed between bootie 122 and upper 110. In some embodiments, strap members may extend out from the interior of upper 110 through one or more openings. As shown in FIG. 8, fifth strap member 218 and the corresponding strap member on the opposing side may extend out from the interior of article 100 through plurality of openings 116 in upper 110.

In some embodiments, foot stabilizer system 120 may be attached to base portion 130. In this embodiment, foot stabilizer system 120, including bootie 122 and plurality of strap members 200, may be secured to base portion 130 along central attachment portion 131. In this embodiment, central attachment portion 131 extends through bootie 122, plurality of strap members 200, and base portion 130. In different embodiments, other attachment portions may be included to secure foot stabilizer system 120 to base portion, as described herein. In one embodiment, upper 110 may be secured to base portion 130. In this embodiment, upper 110 may be attached to base portion 130 along an outer periphery of base portion 130. In an exemplary embodiment, base portion 130 may be secured to sole structure 140. In some cases, sole structure may include one or more of an insole, midsole, and/or outsole.

Referring now to FIG. 9, a cross-sectional view of an exemplary embodiment of article of footwear 100 including decoupled foot stabilizer system 120 is shown with a foot 600 of a wearer disposed within. In some embodiments, bootie 122 may have one or more of plurality of strap members 200 disposed on an outside surface that together with bootie 122 surround and substantially conform to the shape of foot 600. In an exemplary embodiment, foot stabilizer system 120 may be decoupled from base portion 130 at midfoot region 12. In different embodiments, various portions of foot stabilizer system 120 may be decoupled from base portion 130 in one or more of forefoot region 10, midfoot region 12, and/or heel region 14.

As shown in FIG. 9, the decoupling of foot stabilizer system 120 from base portion 130 at midfoot region 12 may allow foot 600 to have a degree of freedom of motion relative to article 100. In some cases, the decoupling of foot stabilizer system 120 may assist a wearer with a change in the direction of travel, including by "cutting" quickly to one side. For example, a wearer may cut to the right by pushing hard on his left foot.

FIG. 10 illustrates a cross-sectional view of the exemplary embodiment of FIG. 9 in the case where a wearer is making a cutting move. In this exemplary embodiment, foot stabilizer system 120 is decoupled from base portion 130 at midfoot region 12. In this embodiment, bootie 122, fifth strap member 218 and a corresponding strap member on the opposing side may stabilize foot 600 within upper 110 during lateral movements. With this configuration, foot 600 may rotate inward towards medial side 18 when a wearer makes a cut to his right.

As shown in FIG. 10, foot stabilizer system 120 may allow foot 600 to have freedom of motion to rotate towards medial side 18, while keeping sole structure 140 of article 100 in contact with the ground. In an exemplary embodiment, central attachment portion 131 may provide decoupling to foot stabilizer system 120 such that foot stabilizer system 120 may move a second height H2 relative to interior of article 100 when a wearer makes a lateral cutting move. In various embodiments, second height H2 may be larger or smaller in correspondence to the proximity of the attachment area to the outer periphery of article 100. In this embodiment, second height H2 may be larger than other embodiments where central attachment portion 131 has a larger width and/or where wider attachment areas are used to secure foot stabilizer system 120 and base portion 130, including, but not limited to a horseshoe shaped attachment area and/or an hourglass shaped attachment area, described below.

In other embodiments, one or more portions of foot stabilizer system 120 may provide additional stability for making lateral movements. In some cases, raised toe portion 206 and/or heel counter 204 may provide support to foot 600 of a wearer during cutting movements. In other cases, foot stabilizer system 120 and/or one or more of raised toe portion 206 and heel counter 204 may provide stability to foot 600 during other movements, including, but not limited to: moving in a forward or rearward direction, running, jumping and other athletic movements.

Figure 11:
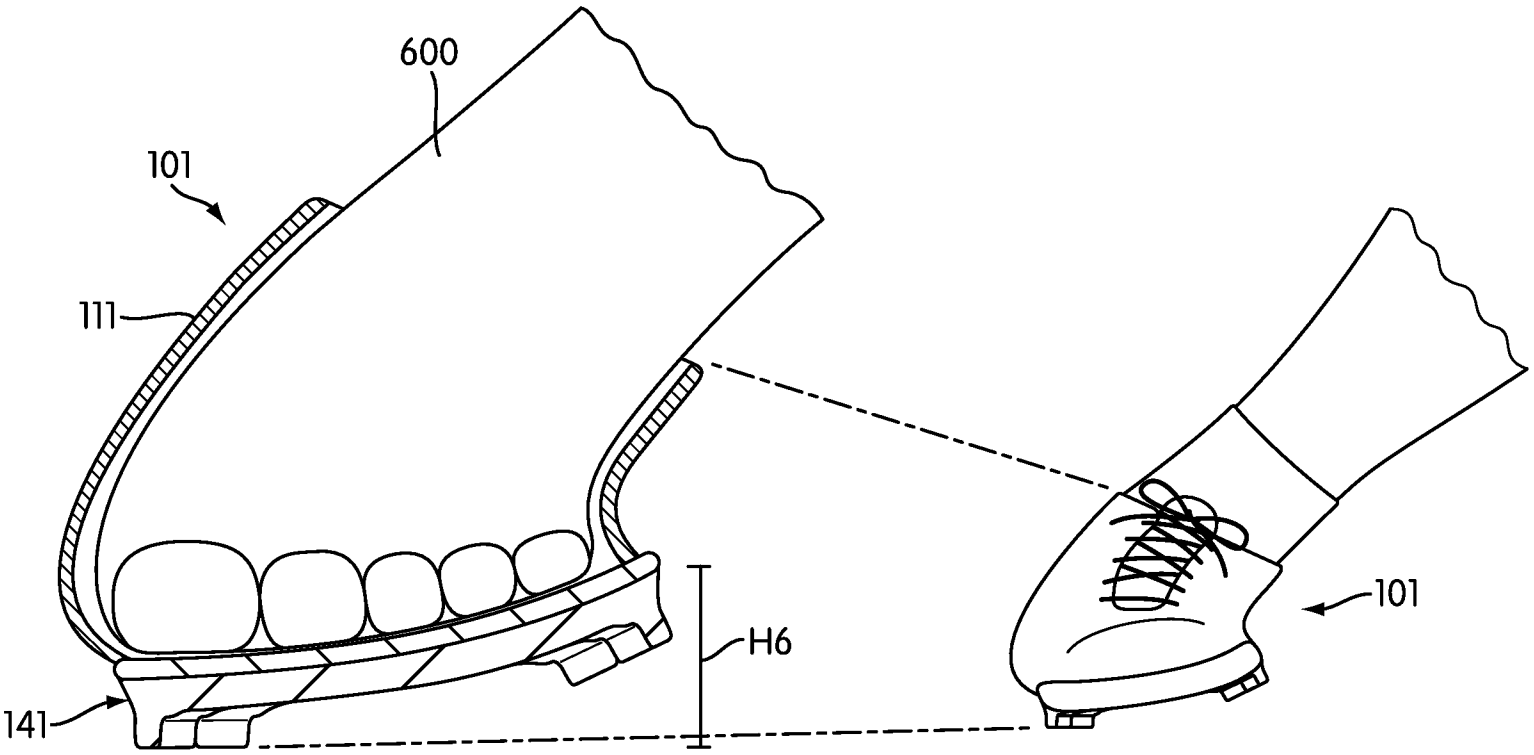
FIG. 11 is a schematic view of a conventional article of footwear during a lateral movement.
Figure 12:
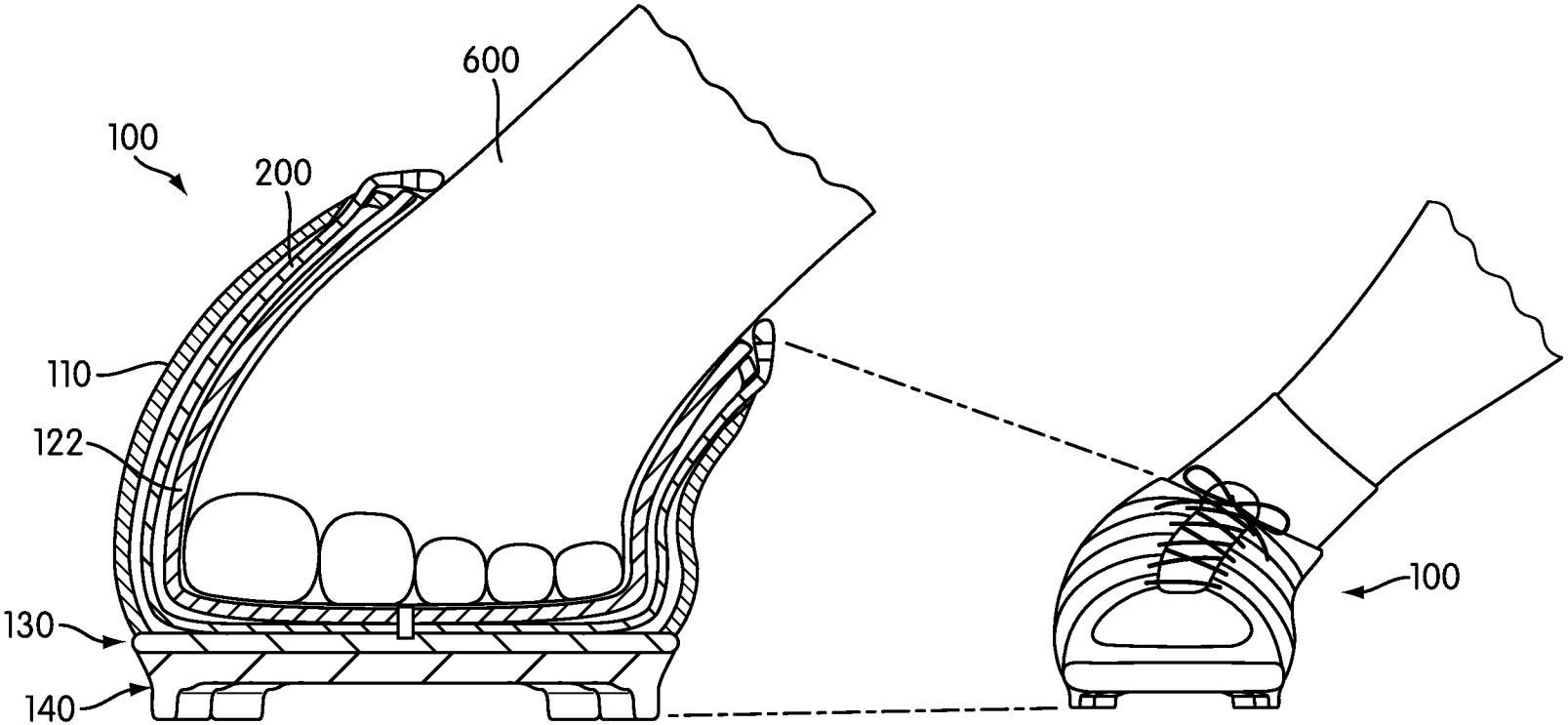
FIG. 12 is a schematic view of an exemplary embodiment of an article of footwear including a foot stabilizer system during a lateral movement.

FIGS. 11 and 12 illustrate comparative views of lateral stability between a conventional article of footwear and an article of footwear with a foot stabilizer system according to the present embodiments described herein. Referring now to FIG. 11, a conventional article of footwear 101 is illustrated being worn on a foot 600 of a wearer. As the wearer makes a lateral movement, foot 600 shifts within conventional article 101, forming a bulge on one side of an upper 111 of conventional article 101. Additionally, the lateral movement by the wearer may cause an outsole 141 of conventional article 101 to become displaced from contact with a ground surface. As shown in FIG. 11, the lateral movement of foot 600 within conventional article 101 may cause outsole 141 to lift a height H6 from the ground surface on one side of conventional article 101. Accordingly, during lateral movements, conventional article 101 may not provide sufficient lateral stability to foot 600 of a wearer.

Referring now to FIG. 12, an exemplary embodiment of an article of footwear 100 including a foot stabilizer system is illustrated being work on foot 600 of a wearer. In this embodiment, article 100 is the exemplary embodiment shown in FIGS. 1-10 and described above. It should be understood, however, that other exemplary embodiments of articles of footwear including foot stabilizer systems described herein may provide substantially similar lateral stability as illustrated with respect to article 100 in FIG. 12.

In this embodiment, article 100 includes a foot stabilizer system comprising bootie 122 and strap members 200, as described above. Foot 600 of a wearer is supported by bootie 122 and strap members 200 within upper 110 of article 100. Additionally, as described above, the foot stabilizer system is attached to base portion 130 at a central attachment portion. With this arrangement, article 100 may allow foot 600 of a wearer to remain substantially parallel to a ground surface when the wearer is making a lateral movement. As shown in FIG. 12, the foot stabilizer system inside upper 110 provides support and lateral stability to foot 600 to prevent foot 600 from bulging out on one side of article 100. In addition, in contrast with conventional article 101 shown in FIG. 11, the foot stabilizer system of article 100 allows sole structure 140 to remain substantially in contact with the ground surface. As a result, article 100 does not lift above the ground surface to a height H6 as in the case with conventional article 101. With this arrangement, article 100 provides lateral stability to foot 600 of a wearer during lateral movements.

Figure 13:
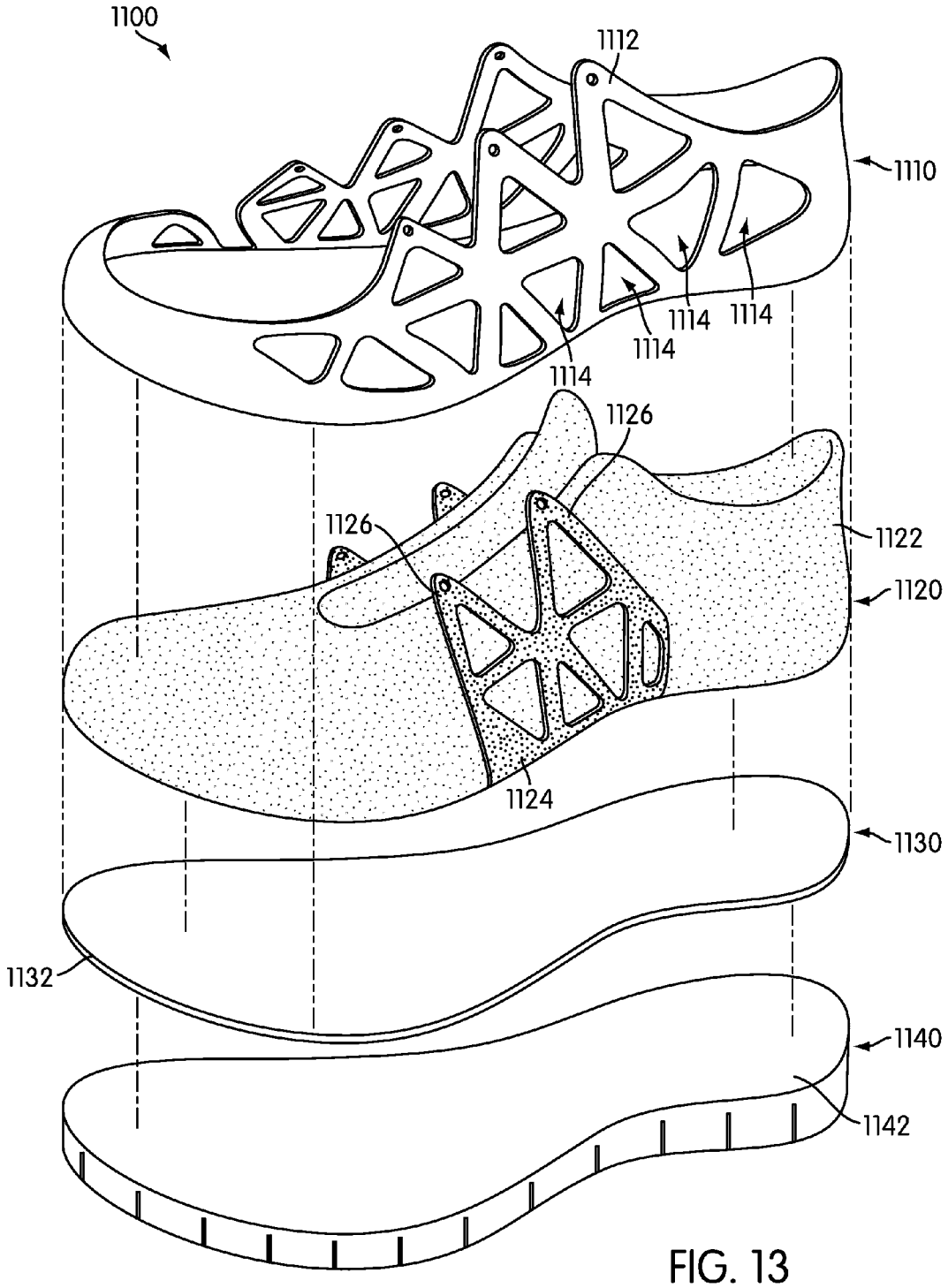
FIG. 13 is an exploded view of an alternate embodiment of an article of footwear including a decoupled foot stabilizer system.

FIGS. 13 through 18 illustrate an alternate exemplary embodiment of an article of footwear including a decoupled foot stabilizer system 120. In some embodiments, one or more components associated with an article of footwear may be configured for various sports and/or activities. In an exemplary embodiment, an article of footwear including a decoupled foot stabilizer system may be configured for running. FIG. 13 illustrates an exploded view of an alternate exemplary embodiment of an article of footwear 1100. In this embodiment, article 1100 may include a decoupled foot stabilizer system 1120. In some embodiments, foot stabilizer system 1120 may include a sock liner 1122. In an exemplary embodiment, sock liner 1122 may be similar to bootie 122 described above. In one embodiment, sock liner 1122 may be configured to extend to a height below an ankle of a wearer. In an exemplary embodiment, sock liner 1122 may be made of a lightweight elastic material. In other embodiments, sock liner 1122 may be made of any suitable material, including any one or more materials described above for bootie 122.

In some embodiments, foot stabilizer system 1120 may include a strap system 1124. In an exemplary embodiment, strap system 1124 may be similar to plurality of strap members 200 described above. In one embodiment, strap system 1124 may be associated with only midfoot region 12 of article 1100. In other embodiments, strap system 1124 may be associated with additional portions of article 1100, including forefoot region 10 and/or heel region 14. In this embodiment, strap system 1124 may include one or more strap members 1126. In an exemplary embodiment, strap members 1126 may be configured to provide stability and/or support to foot stabilizer system 1120. In some embodiments, strap members 1126 may have a triangular shape. In an exemplary embodiment, strap members 1126 having a triangular shape may be configured to distribute the load associated with supporting a foot of a wearer. In other embodiments, strap members 1126 may have other shapes, including a substantially similar shape as plurality of strap members 200 described above.

In an exemplary embodiment, strap members 1126 may be configured to support an arch of a foot of a wearer. In one embodiment, strap system 1124 may include a number of strap members 1126 on opposite sides. In an exemplary embodiment, strap members 1126 may be positioned on a lateral side and a medial side of foot stabilizer system 1120. In the embodiment shown in FIG. 13, foot stabilizer system 1120 may include strap system 1124 having four strap members 1126 disposed over an outside surface of sock liner 1122. In other embodiments, foot stabilizer system 1120 may include strap system 1124 having more or less strap members.

In some embodiments, strap members 1126 may be attached to sock liner 1122. In some cases, strap members 1126 may be attached to sock liner 1122 on an underside of sock liner 1122. In other cases, strap members 1126 additionally may be attached to a portion of a side of sock liner 1122. In one embodiment, strap members 1126 may be attached to an underside of sock liner 1122 and unattached on the sides of sock liner 1122 to provide freedom of motion for strap system 1124 relative to sock liner 1122. With this arrangement, foot stabilizer system 1120 may be configured to provide a customized fit to a foot of a wearer. In different embodiments, strap members 1126 may be attached to each other and/or attached to sock liner 1122 using a various attachment mechanisms, including, but not limited to: adhesive, stitching, and other methods of fixed attachment. In other embodiments, a removable attachment mechanism may be used, including, but not limited to: hook and loop fasteners and other methods of removable attachment.

In some embodiments, article 1100 may include an upper 1110. Generally, upper 1110 provides a covering for the foot that comfortably receives and securely positions the foot with respect to a sole structure 1140. In some embodiments, upper 1110 may be configured to be lightweight. In one exemplary embodiment, upper 1110 may have material removed from portions of upper to provide a "skeletonized" upper 1110. In current embodiment shown in FIG. 13, upper 1110 may include one or more portions where material has been removed forming gaps or cut-outs 1114. With this arrangement, plurality of gaps or cut-outs 1114 in upper 1110 may allow upper 1110 to be lightweight. In other embodiments, portions of upper 1110, including one or more of plurality of gaps or cut-outs 1114 in upper 1110, may include a layer of mesh material or other suitable lightweight and/or elastic material. In some cases, one or more portions of an upper, including one or more gaps or cut-outs, may be made of the material disclosed in copending and commonly owned U.S. Patent Application Publication 2010/0199406, currently U.S. patent application Ser. No. 12/367,274, entitled "Thermoplastic Non-Woven Textile Elements", and filed on Feb. 6, 2009, which application is incorporated herein by reference in its entirety.

In some embodiments, upper 1110 may include one or more lacing strap members 1112. In this embodiment, plurality of lacing strap members 1112 may be provided on upper 1110 in an area corresponding generally to a lacing area of article 1100. In one embodiment, the distal ends of lacing strap members 1112 may be provided with a mechanism for receiving a lace. With this arrangement, a lace or similar structure may be provided to tighten article 1100 around a foot of a wearer. In an exemplary embodiment, plurality of lacing strap members 1112 may have a substantially similar shape as strap members 1126 of strap system 1124. In one embodiment, plurality of lacing strap members 1112 may have a triangular shape. In some cases, the triangular shape of plurality of lacing strap members 1112 may be configured to assist foot stabilizer system 1120 with distributing the load associated with supporting a foot of a wearer. In other embodiments, plurality of lacing strap members 1112 may have other shapes, including any shape associated with plurality of strap members 200 described above.

In some embodiments, article 1100 may include sole structure 1140. Sole structure 1140 may be generally positioned between a foot of a wearer and the ground. In some embodiments, sole structure 1140 may include one or more of an outsole, a midsole, a single piece sole, and/or any number of additional components associated with a conventional sole. In an exemplary embodiment, sole structure 1140 may include an articulated sole structure for engaging with the ground. While FIGS. 13 through 17 illustrate sole structure 1140 having an articulated sole structure, it should be understood that article 1100 may include any conventional type of sole structure 1140. Additionally, sole structure 1140 may optionally include one or more tread elements as described herein or known in the art.

In some embodiments, article 1100 may include a base portion 1130. Base portion 1130 may be generally positioned between the foot of a wearer and sole structure 1140. In some embodiments, base portion 1130 may be secured to a lower portion of upper 1110 and an upper portion of sole structure 1140. In this embodiment, base portion 1130 may be secured to a lower portion of upper 1110 along an outer periphery 1132. Additionally, in this embodiment, base portion 1130 may be secured to a top surface 1142 of sole structure 1140. In different embodiments, base portion 1130 may include one or more of a midsole, strobel, and/or a portion of upper 1110 that is configured to be attached to sole structure 1140.

In some embodiments, base portion 1130 may be disposed between foot stabilizer system 1120 and sole structure 1140. In one embodiment, foot stabilizer system 1120 may be secured to base portion 1130. In an exemplary embodiment, foot stabilizer system 1120 may be secured to base portion 1130 in a manner such that foot stabilizer system 1120 is selectively decoupled from one or more portions of article 1100. In different embodiments, foot stabilizer system 1120 may be decoupled from base portion 1130 using various attachment portions as described herein. In one embodiment, foot stabilizer system 1120 may be attached to base portion 1130 using a similar arrangement as described above in regard to foot stabilizer system 120 and base portion 130. In other embodiments, foot stabilizer system 1120 may be attached to base portion 1130 using a horseshoe or hourglass shaped attachment portion, as more fully described in the embodiments below.

Figure 14:
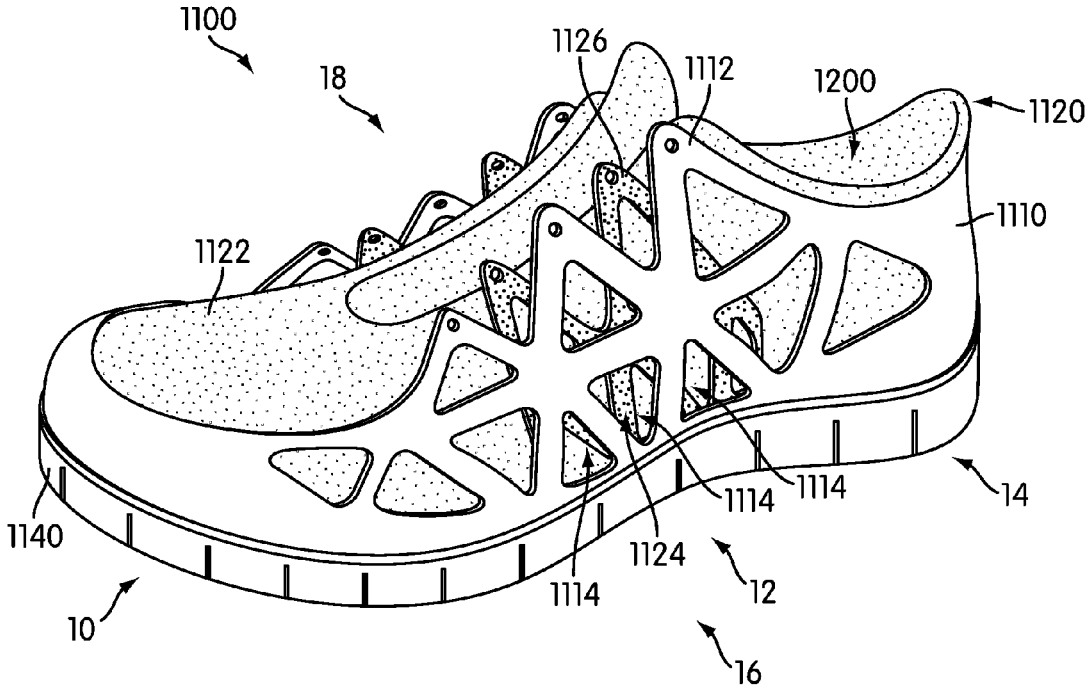
FIG. 14 is an isometric view of an alternate embodiment of an article of footwear including a decoupled foot stabilizer system.

FIG. 14 illustrates alternate exemplary embodiment of article 1100 assembled with decoupled foot stabilizer system 1120. In this embodiment, skeletonized upper 1110 may be disposed over foot stabilizer system 1120, including sock liner 1122 and strap system 1124. As shown in FIG. 14, one or more portions of skeletonized upper 1110 may be removed such that sock liner 1122 is exposed. In one embodiment, a portion of upper 1110 associated with forefoot region 10 and extending over a top of article 1100 into midfoot region 12 may be removed to expose sock liner 1122. Additionally, as shown in this embodiment, upper 1110 may include a number of gaps or cut-outs 1114 disposed on lateral side 16 of article 1100 such that strap system 1124 is exposed. It should be understood that article 1100 may include a similar arrangement on medial side 18 of upper 1110. In other embodiments, gaps or cut-outs 1114 may include a mesh material or other suitable material to provide protection to a foot of a wearer from debris that may enter into interior of article 1100 through gaps or cut-outs 1114.

Figure 15:
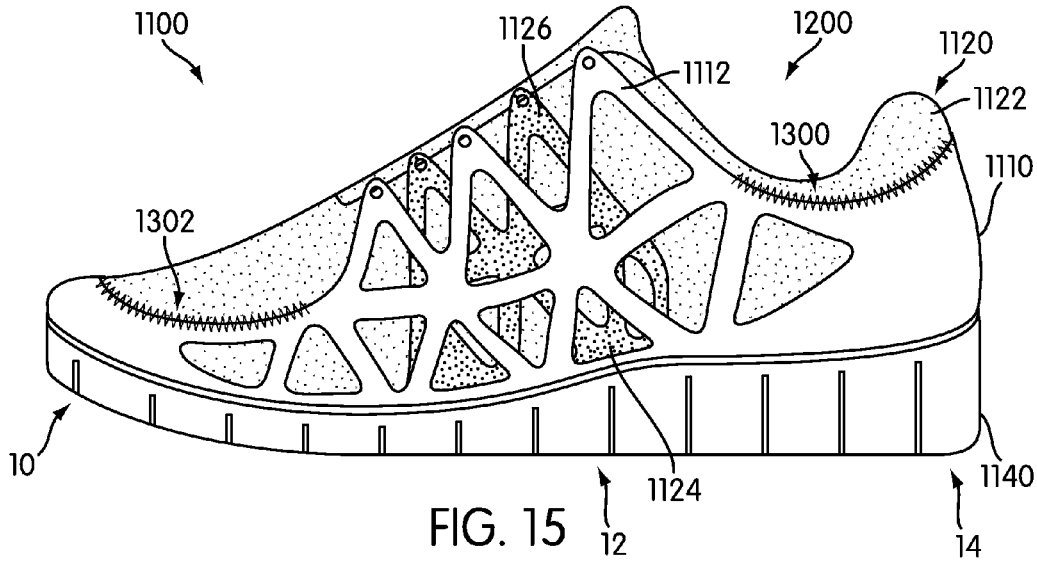
FIG. 15 is a lateral side view of an alternate embodiment of an article of footwear including a decoupled foot stabilizer system.

In some embodiments, one or more portions of upper 1110 may be secured to portions of foot stabilizer system 1120. In an exemplary embodiment, portions of upper 1110 and sock liner 1122 may be securely attached at forefoot region 10 and/or heel region 14 of article 1100. In one embodiment, upper 1110 and sock liner 1122 may be attached by stitching at one or more portions located at forefoot region 10 and/or heel region 14 of article 1100. Referring now to FIG. 15, lateral side 16 of article 1100 is illustrated, including upper 1110 and foot stabilizer system 1120. In this embodiment, sock liner 1122 may be attached to upper 1110 at heel region 14 at a first upper heel attachment portion 1300. In some cases, first upper heel attachment portion 1300 may extend a length along a top portion of upper 1110 and sock liner 1122 sufficient to securely attach upper 1110 and sock liner 1122 at an area adjacent to a throat opening 1200 of article 1100. In some embodiments, sock liner 1122 also may be attached to upper 1110 at forefoot region 10 at a first upper forefoot attachment portion 1302. In some cases, first upper forefoot attachment portion 1302 may extend a length along a top portion of upper 1110 and sock liner 1122 sufficient to securely attach upper 1110 and sock liner 1122 at an area corresponding to the toes of a foot of a wearer.

Figure 16:
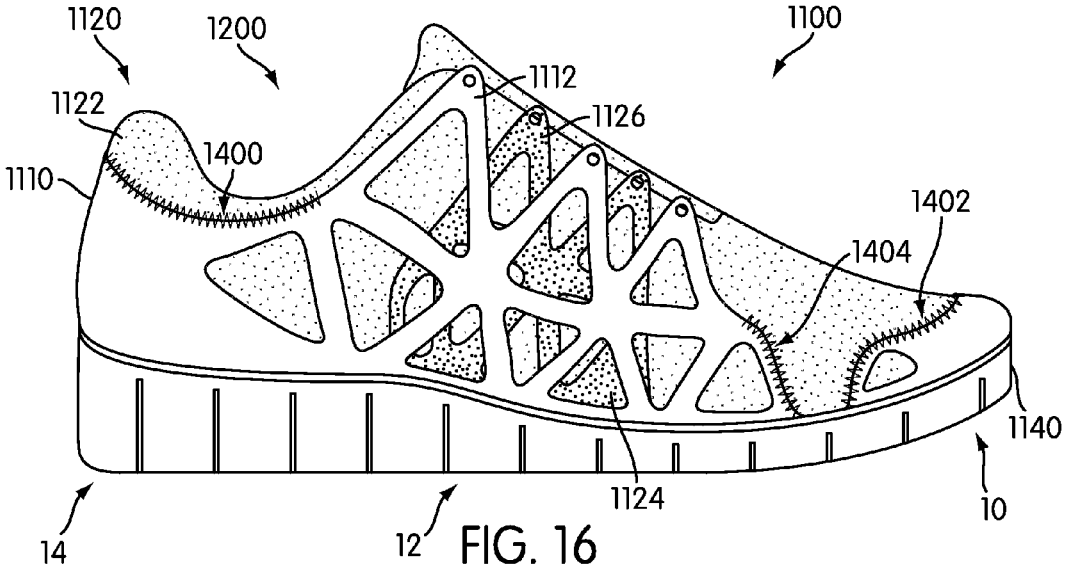
FIG. 16 is a medial side view of an alternate embodiment of an article of footwear including a decoupled foot stabilizer system.

Referring now to FIG. 16, medial side 18 of article 1100 is illustrated, including upper 1110 and foot stabilizer system 1120. In this embodiment, sock liner 1122 may be attached to upper 1110 at heel region 14 at a second upper heel attachment portion 1400. In some cases, second upper heel attachment portion 1400 may extend a length along a top portion of upper 1110 and sock liner 1122 sufficient to securely attach upper 1110 and sock liner 1122 at an area adjacent to a throat opening 1200 of article 1100. In other cases, second upper heel attachment portion 1400 and first upper heel attachment portion 1300 may each extend a length on medial side 18 and lateral side 16, respectively, so as to be substantially continuous around heel region 14.

In some embodiments, sock liner 1122 also may be attached to upper 1110 at forefoot region 10 at a second upper forefoot attachment portion 1402. In some cases, second upper forefoot attachment portion 1402 may extend a length along a top portion of upper 1110 and sock liner 1122 sufficient to securely attach upper 1110 and sock liner 1122 at an area corresponding to the toes of a foot of a wearer. In other cases, second upper forefoot attachment portion 1402 and first upper forefoot attachment portion 1302 may each extend a length on medial side 18 and lateral side 16, respectively, so as to be substantially continuous around forefoot region 10.

In the current embodiment shown in FIG. 16, second upper forefoot attachment portion 1402 may further extend in a downward direction toward sole structure 1140. In some embodiments, upper 1110 may include a discontinuous portion corresponding to an area associated with the toes of a wearer. In this embodiment, second upper forefoot attachment portion 1402 may secure a front edge of the discontinuous portion of upper 1110 to sock liner 1122. In an exemplary embodiment, sock liner 1122 also may be attached to upper 1110 at forefoot region 10 at a third upper forefoot attachment portion 1404. In some cases, third upper forefoot attachment portion 1404 may extend a length along a rear edge of the discontinuous portion of upper 1110 from an area adjacent to sole structure 1140 towards midfoot region 12 of article 1100. In this embodiment, third upper forefoot attachment portion extends a length sufficient to securely attach upper 1110 and sock liner 1122 at an area corresponding to the toes of a foot of a wearer. With this arrangement, discontinuous portion of upper 1110 bounded by second upper forefoot attachment portion 1402 on the front edge and third upper forefoot attachment portion 1404 on the rear edge may be configured to allow greater bending of article 1100 at an area associated with the toes of a wearer. In other embodiments, discontinuous portion of upper 1110 may be omitted and upper 1110 on medial side 18 may be similar to upper 1110 on lateral side 16.

Figure 17:
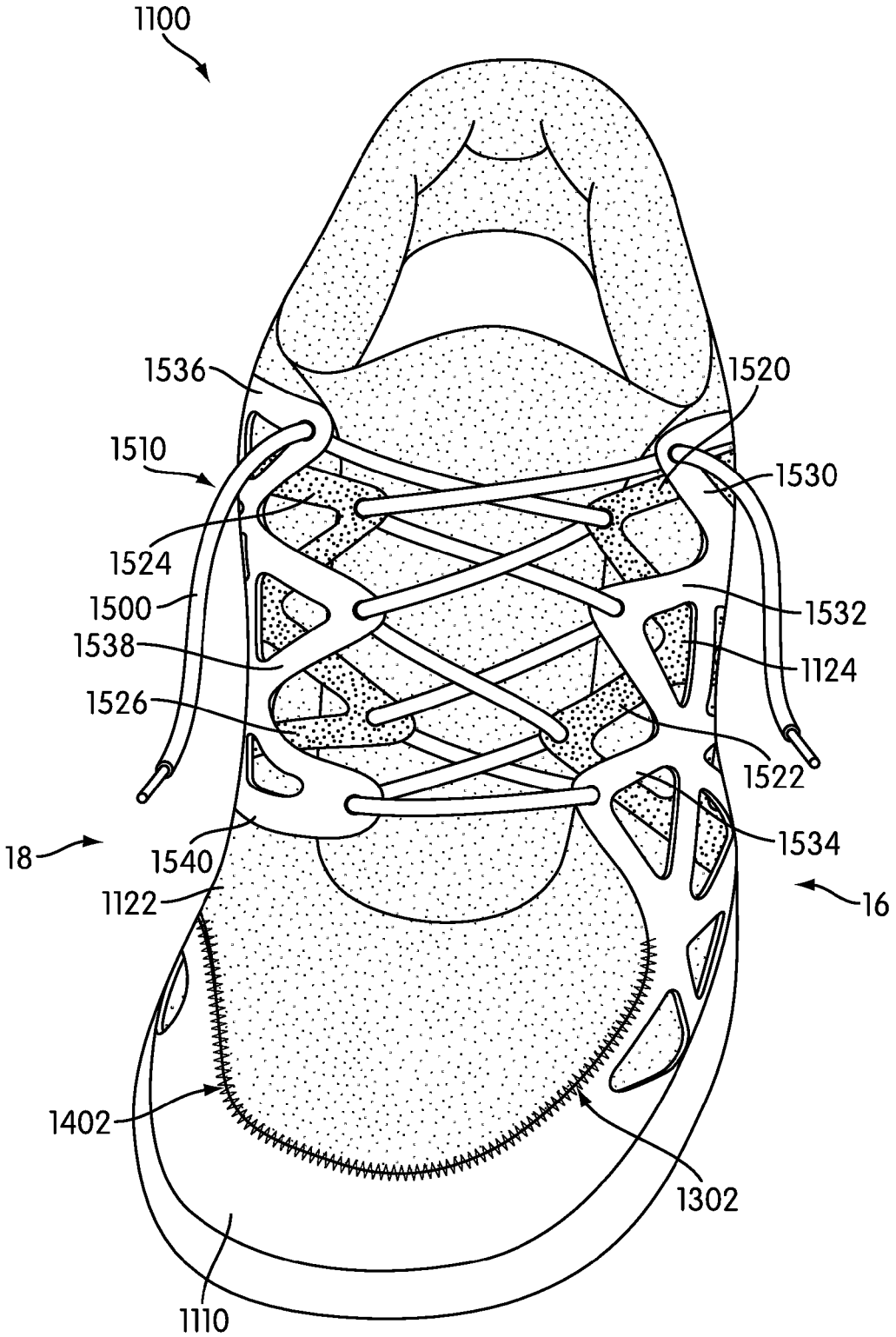
FIG. 17 is a front view of an alternate embodiment of an article of footwear including a decoupled foot stabilizer system.

Referring now to FIG. 17, a front view of alternate exemplary embodiment of article 1100 is illustrated. In some embodiments, one or more portions of foot stabilizer system 1120 and upper 1110 may be releasably attached at one or more regions of article 1100. In one embodiment, portions of foot stabilizer system 1120 and upper 1110 associated with midfoot region 12 of article 1100 may be configured to be releasably attached using a lace 1500. In this embodiment, one or more strap members of strap system 1124 of foot stabilizer system 1120 may be associated with one or more lacing strap members of upper 1110 in a lacing area 1510 of article 1100. With this arrangement, lace 1500 may be run through one or more strap members of strap system 1124 and/or lacing strap members of upper 1110 to releasably attach foot stabilizer system 1120 and upper 1110 at lacing area 1510.

In one embodiment, lacing area 1510 may include alternating strap members associated with each of strap system 1124 and upper 1110. In this embodiment, lacing area 1510 may include a first strap member 1520 and a second strap member 1522 associated with strap system 1124 of foot stabilizer system 1120 on lateral side 16 of article 1100. Lacing area 1510 may also include a first lacing strap member 1530, a second lacing strap member 1532, and/or a third lacing strap member 1534 associated with upper 1110 on lateral side 16 of article 1100. Similarly, medial side 18 may include a third strap member 1524 and a fourth strap member 1526 associated with strap system 1124 of foot stabilizer system 1120 and a fourth lacing strap member 1536, a fifth lacing strap member 1538, and/or a sixth lacing strap member 1540 associated with upper 1110.

Figure 18:
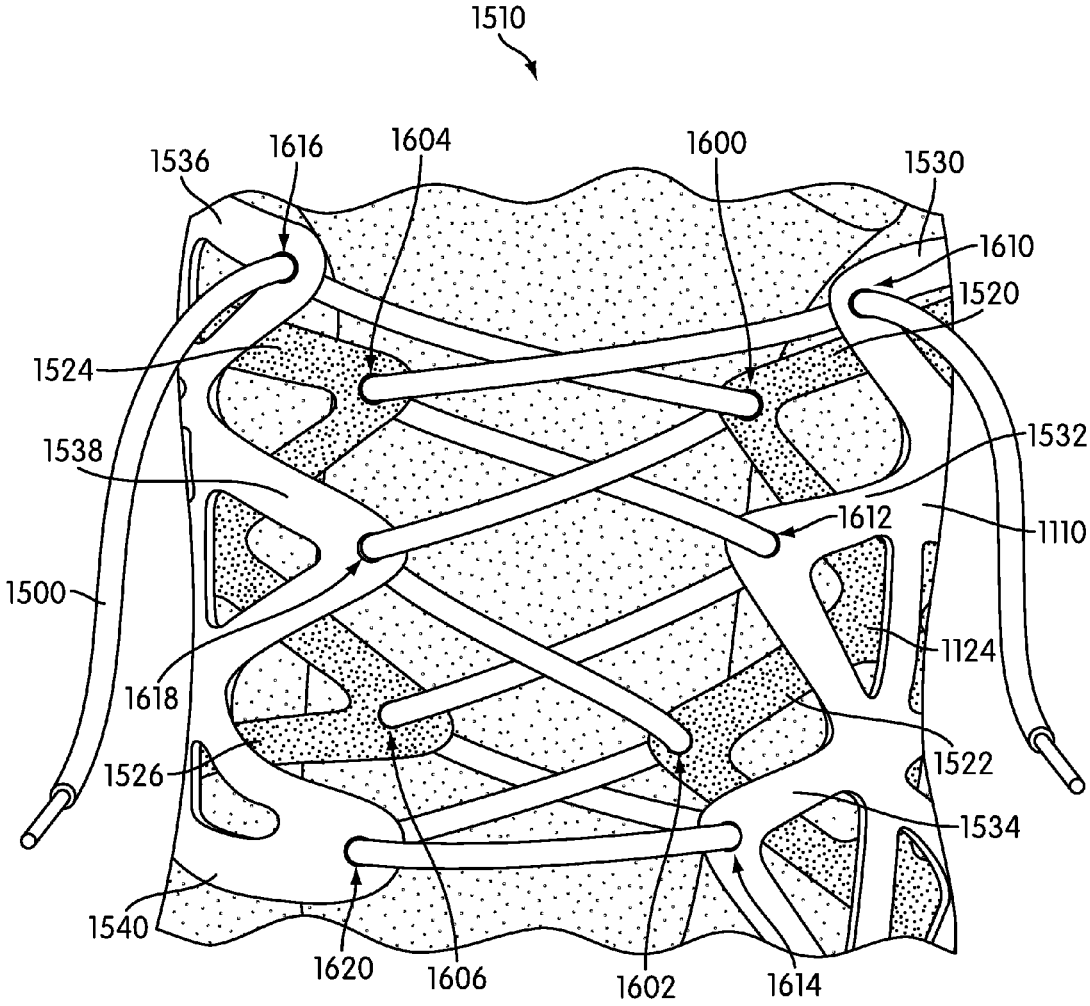
FIG. 18 is a close-up view of a lacing area of an alternate embodiment of an article of footwear including a decoupled foot stabilizer system.

FIG. 18 illustrates a close up view of lacing area 1510. In this embodiment, lace 1500 may be configured to run through lacing holes disposed at the distal ends of the strap members associated with strap system 1124 and the lacing strap members associated with upper 1110. As shown in FIG. 18, first strap member 1520 may include a first lacing hole 1600. Similarly, second strap member 1522, third strap member 1524, and/or fourth strap member 1526 may include, respectively, a second lacing hole 1602, a third lacing hole 1604, and/or a fourth lacing hole 1606. Lacing strap members associated with upper 1110 also may also include a fifth lacing hole 1610 disposed at the distal end of first lacing strap member 1530, a sixth lacing hole 1612 disposed at the distal end of second lacing strap member 1532. In addition, each of third lacing strap member 1534, fourth lacing strap member 1536, fifth lacing strap member 1538, and sixth lacing strap member 1540, may include, respectively, a seventh lacing hole 1614, an eighth lacing hole 1616, a ninth lacing hole 1618, and a tenth lacing hole 1620.

In an exemplary embodiment, foot stabilizer system 1120 may be configured to be releasably attached to upper 1110 at lacing area 1510 by interdigitating lace 1500 through alternating lacing holes associated with each of strap system 1124 and upper 1110. In the current embodiment, starting from the top of lacing area 1510 on medial side 18, lace 1500 alternately runs through eighth lacing hole 1616 associated with fourth lacing strap member 1536, first lacing hole 1600 associated with first strap member 1520, ninth lacing hole 1618 associated with fifth lacing strap member 1538, second lacing hole 1602 associated with second strap member 1522, tenth lacing hole 1620 associated with sixth lacing strap member 1540, and continuing in a similar manner until lace 1500 runs through fifth lacing hole 1610 associated with first lacing strap member 1530 on lateral side 16. It should be understood that the lacing order illustrated in FIG. 18 is merely exemplary and the exact order of alternating lacing holes used to interdigitate foot stabilizer system 1120 and upper 1110 may vary.

Figure 19:
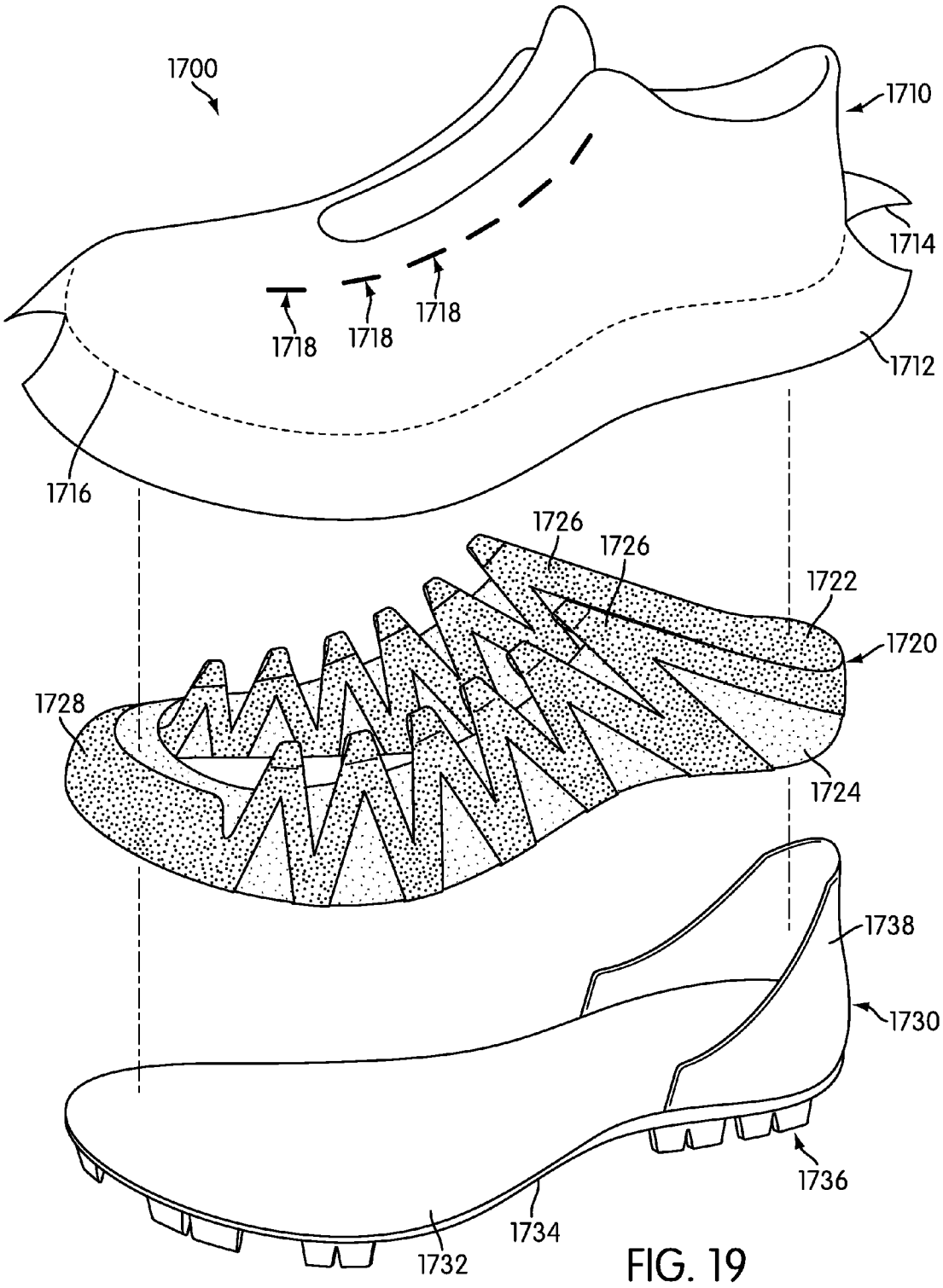
FIG. 19 is an exploded view of an alternate embodiment of an article of footwear including a decoupled foot stabilizer system.

FIGS. 19 through 27 illustrate an alternate exemplary embodiment of an article of footwear including a decoupled foot stabilizer system. In some embodiments, one or more components associated with an article of footwear may be configured for various sports and/or activities. In an exemplary embodiment, an article of footwear including a decoupled foot stabilizer system may be configured for soccer, football, baseball or other sports using footwear with ground-engaging elements. FIG. 19 illustrates an exploded view of an alternate exemplary embodiment of an article of footwear 1700. In this embodiment, article 1700 may include a decoupled foot stabilizer system 1720. In this embodiment, foot stabilizer system 1720 does not include a separate bootie or sock liner component, as included in previous embodiments. It should be understood, however, that foot stabilizer system 1720 may optionally include a bootie and/or sock liner. In one embodiment, foot stabilizer system 1720 may be configured to extend to a height below an ankle of a wearer.

In some embodiments, foot stabilizer system 1720 may include a strap system 1722. In an exemplary embodiment, strap system 1722 may include a plurality of strap members 1726. In an exemplary embodiment, plurality of strap members 1726 may be configured to provide stability and/or support to foot stabilizer system 1720. In one embodiment, strap members 1726 may have a triangular shape. In an exemplary embodiment, strap members 1726 having a triangular shape may be configured to distribute the load associated with supporting a foot of a wearer. In other embodiments, strap members 1726 may have other shapes, including a substantially similar shape as plurality of strap members 200 described above.

In an exemplary embodiment, strap members 1726 may be configured to support a foot of a wearer. In one embodiment, strap system 1722 may include a number of plurality of strap members 1726 on opposite sides. In an exemplary embodiment, plurality of strap members 1726 may be positioned on a lateral side and a medial side of foot stabilizer system 1720. In the embodiment shown in FIG. 19, foot stabilizer system 1720 may include strap system 1722 having six strap members 1726 disposed on each side of article 1700. In other embodiments, foot stabilizer system 1720 may include strap system 1722 having more or less strap members 1726.

In some embodiments, plurality of strap members 1726 may be connected to each other using a webbing material 1724. Webbing material 1724 may be substantially similar to webbing 202 described above. As shown in FIG. 19, webbing material 1724 may connect plurality of strap members 1726 along the sides of foot stabilizer system 1720. In some cases, webbing material 1724 may be disposed between fewer strap members. In other cases, webbing material 1724 may be disposed between two or more strap members on a single side of foot stabilizer system 1720. In different embodiments, webbing material 1724 may be disposed between two or more strap members associated with one or more of forefoot region 10, midfoot region 12, and heel region 14 of article 1700.

In some embodiments, foot stabilizer system 1720 may include components configured to protect and/or provide stability and support to various portions of a foot of a wearer. In some embodiments, foot stabilizer system 1720 may include one or more components associated with the toes of a foot of a wearer. In an exemplary embodiment, strap system 1722 may include a covered toe portion 1728. Covered toe portion 1728 may be disposed in an area of forefoot region 10 that generally corresponds to the toes of a wearer. Covered toe portion 1728 may be shaped to engage and stabilize the front of the wearer's foot including the toes. In some embodiments, covered toe portion 1728 also may be shaped to cover and enclose at least a portion of the wearer's toes. In some embodiments, covered toe portion 1728 may be sized and dimensioned so as to extend a height and a width sufficient to support and/or protect the toes of a wearer. Covered toe portion 1728 may be formed integrally with one or more strap members located on a lateral side and/or a medial side. In some embodiments, covered toe portion 1728 may extend along forefoot region 10 between strap members on opposing sides of strap system 1722. In some cases, covered toe portion 1728 may extend along a portion of an outer periphery of foot stabilizer system 1720. In other cases, covered toe portion 1728 also may extend over a portion of bottom surface of foot stabilizer system 1720 in forefoot region 10.

In some embodiments, foot stabilizer system 1720 may include one or more components associated with the heel of a foot of a wearer. In some embodiments, strap system 1722 may include a heel counter formed by a pair of strap members disposed on either side of foot stabilizer system 1720. In an exemplary embodiment, the heel counter may be substantially similar to heel counter 204 disclosed above.

In some embodiments, article 1700 may include an upper 1710. Generally, upper 1710 provides a covering for the foot that comfortably receives and securely positions the foot with respect to a sole structure 1730. In some embodiments, one or more portions of upper 1710 may be configured to fold under the top of upper 1710 to provide a surface for attaching to sole structure 1730. In exemplary embodiment, upper 1710 may be provided with extra material on a medial side and a lateral side for forming a bottom surface to be secured to sole structure 1730. In one embodiment, upper 1710 may include a first folding portion 1712 and a second folding portion 1714 located at the bottom of opposing sides of upper 1710. In this embodiment, each of first folding portion 1712 and second folding portion 1714 may be folded along an outer periphery 1716 of upper 1710 to form a bottom surface and enclose upper 1710.

In some embodiments, upper 1710 may include a plurality of openings 1718 for receiving the distal ends of plurality of strap members 1726. In some embodiments, lacing holes associated with the distal ends of plurality of strap members 1726 of foot stabilizer system 1720 may extend out from the interior of article of footwear 1700 through plurality of openings 1718 in upper 1710. In an exemplary embodiment, plurality of openings 1718 may include slits. In other embodiments, plurality of openings 1718 may be any type of opening in upper 1710 that allows plurality of strap members 1726 to extend out from the interior of article 1700.

In some embodiments, article 1700 may include sole structure 1730. Sole structure 1730 may be generally positioned between a foot of a wearer and the ground. In some embodiments, sole structure 1730 may include one or more of an outsole, a midsole, a single piece sole, and/or any number of additional components associated with a conventional sole. In other embodiments, sole structure 1730 may include one or more tread elements for engaging with the ground. In some embodiments, sole structure 1730 may include one or more components. In one embodiment, sole structure 1730 may include an outsole 1734. Outsole 1734 may be any conventional outsole used with an article of footwear. In an exemplary embodiment, outsole 1734 of sole structure 1730 may include one or more tread elements 1736 for engaging with the ground. Tread elements 1736 may be any conventional tread elements used with an article of footwear, including, but not limited to a cleat. In other embodiments, sole structure 1730 may not include tread elements 1736. While FIGS. 19 through 27 illustrate sole structure 1730 having one or more tread elements, including a cleat, it should be understood that article 1700 may include sole structure 1730 as described herein without limitation to any specific type of tread element.

In some embodiments, sole structure 1730 may optionally include a heel cup 1738. In an exemplary embodiment, heel cup 1738 may be made of a rigid material to firmly support the heel of a foot of a wearer.

Figure 20:
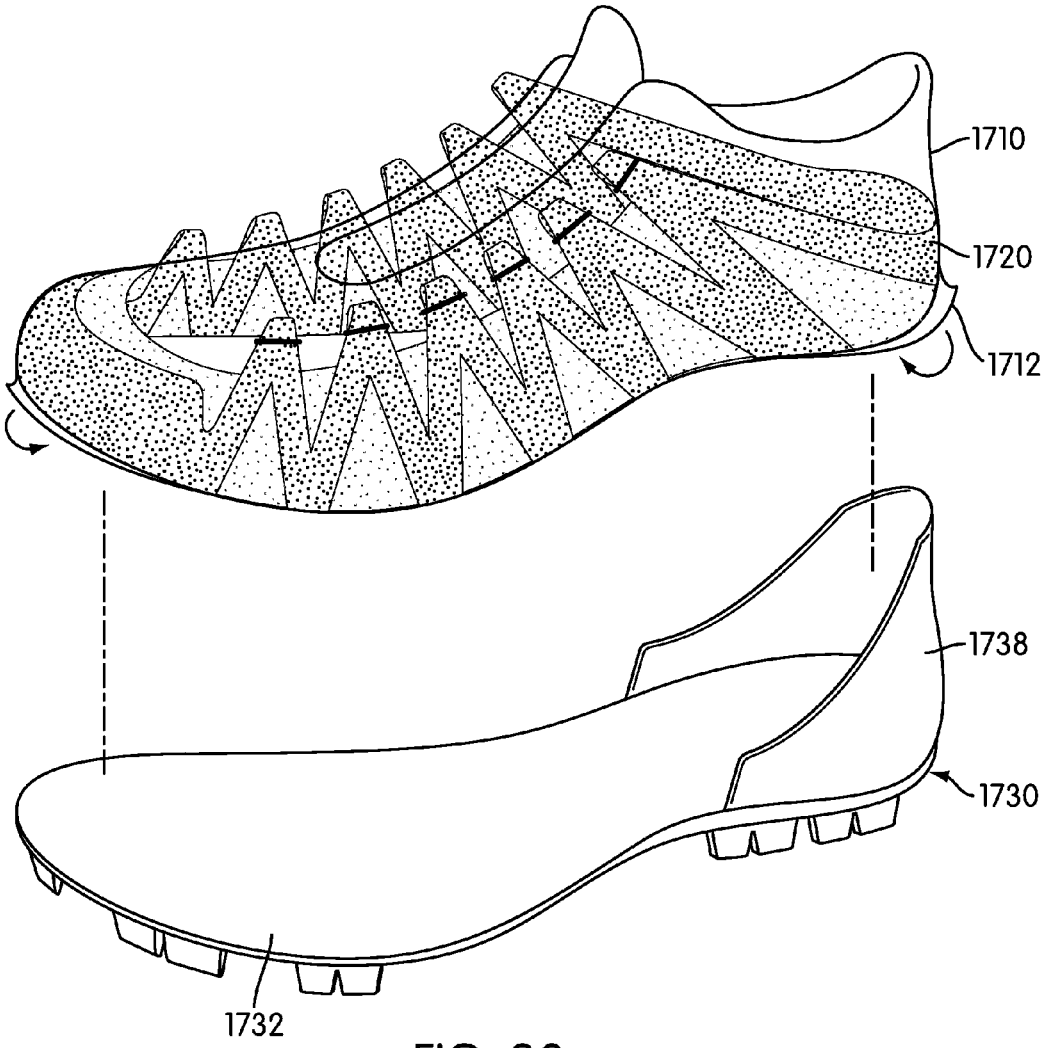
FIG. 20 is an exploded view of an alternate embodiment of an article of footwear including a decoupled foot stabilizer system showing folding of an upper to form a base portion.

Referring now to FIG. 20, in this embodiment, first folding portion 1712 and second folding portion 1714 of upper 1710 may be folded under article 1700 so as to enclose foot stabilizer system 1720 within the interior of upper 1710. In some embodiments, first folding portion 1712 and second folding portion 1714 of upper 1710 may be attached underneath upper 1710 to form a bottom surface. With this arrangement, bottom surface may serve a substantially similar function as base portion 130 and/or base portion 1130, described above. In an exemplary embodiment, bottom surface formed by first folding portion 1712 and second folding portion 1714 may be secured to a top surface 1732 of sole structure 1730. In different embodiments, bottom surface of upper 1710 may include one or more of a midsole and/or strobel, as described above.

Figure 21:
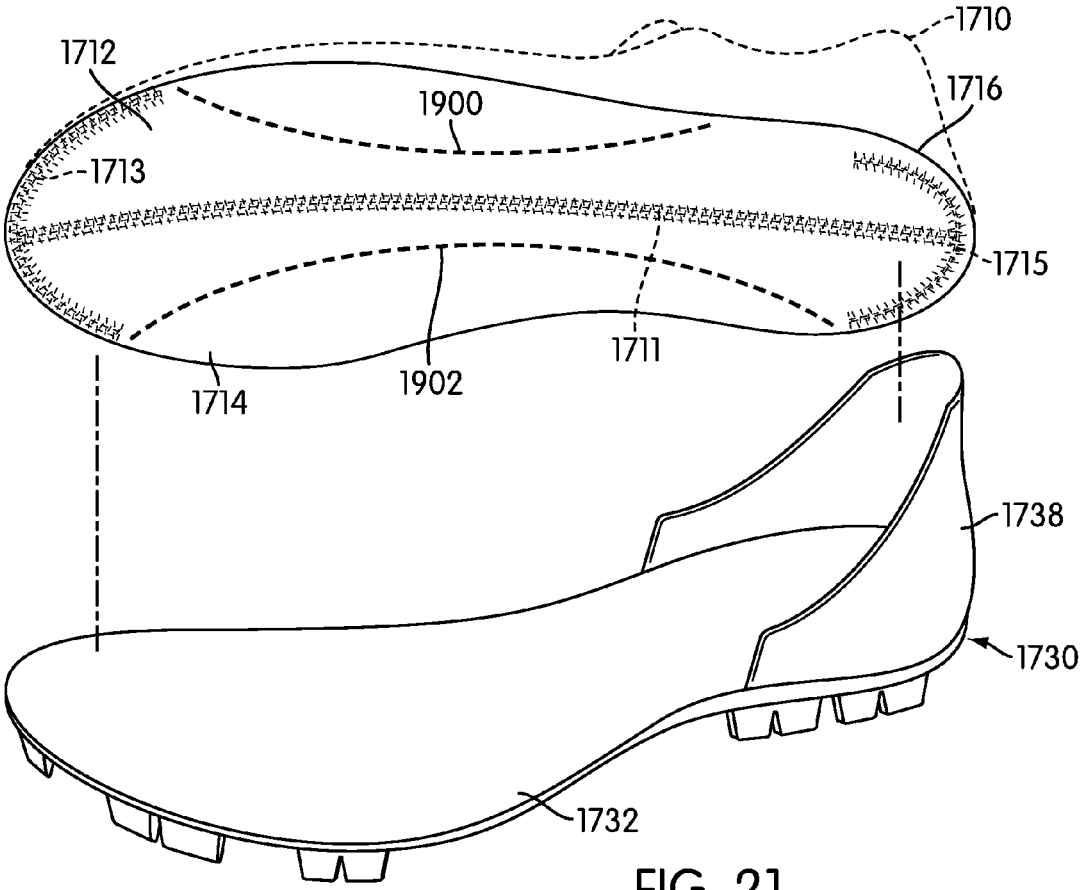
FIG. 21 is an exploded view of an alternate embodiment of a decoupled foot stabilizer system attached to a base portion.

FIG. 21 illustrates an exploded view of the bottom surface of upper 1710. In some embodiments, first folding portion 1712 and second folding portion 1714 of upper 1710 may be joined along a center seam 1711 to form the bottom surface. Similarly, first folding portion 1712 and second folding portion 1714 may also be joined along a toe seam 1713 and a heel seam 1715. Using center seam 1711, toe seam 1713, and/or heel seam 1715, first folding portion 1712 and second folding portion 1714 may enclose upper 1710 around foot stabilizer system 1720. With this arrangement, the bottom surface may serve a substantially similar function as base portion 130 and/or base portion 1130, described above. Bottom surface of upper 1710 may be generally positioned between the foot of a wearer and sole structure 1730. In some embodiments, the bottom surface of upper 1710 may be secured to a top surface 1732 of sole structure 1730.

In some embodiments, bottom surface of upper 1710 may be disposed between foot stabilizer system 1720 and sole structure 1730. In one embodiment, foot stabilizer system 1720 may be secured to bottom surface of upper 1710. In an exemplary embodiment, foot stabilizer system 1720 may be secured to bottom surface of upper 1710 in a manner such that foot stabilizer system 1720 is selectively decoupled from one or more portions of article 1700. In different embodiments, foot stabilizer system 1720 may be decoupled from bottom surface of upper 1710 using various attachment portions as described herein.

In an exemplary embodiment, foot stabilizer system 1720 may be secured to bottom surface of upper 1710 using a horseshoe shaped attachment area. As shown in FIG. 21, a horseshoe shaped attachment area may be defined by a first horseshoe attachment portion 1900 on a lateral side and a second horseshoe attachment portion 1902 on a medial side. In this embodiment, first horseshoe attachment portion 1900 and second horseshoe attachment portion 1902 may selectively decouple portions of foot stabilizer system 1720 from bottom surface of upper 1710. In one embodiment, each of first horseshoe attachment portion 1900 and/or second horseshoe attachment portion 1902 may start and terminate adjacent to outer periphery 1716 of upper 1710. In an exemplary embodiment, first horseshoe attachment portion 1900 and/or second horseshoe attachment portion 1902 may start and terminate adjacent to outer periphery 1716 associated with forefoot region 10 and/or heel region 14. As first horseshoe attachment portion 1900 and/or second horseshoe attachment portion 1902 extends through midfoot region 12, each of first horseshoe attachment portion 1900 and/or second horseshoe attachment portion 1902 is located closer to center seam 1711. With this arrangement, foot stabilizer system 1720 may be selectively decoupled from article 1700 at midfoot region 12.

Figure 22:
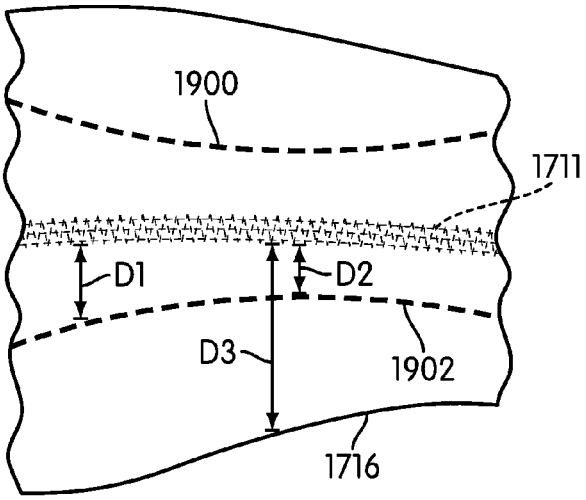
FIG. 22 is a close-up view of a decoupled foot stabilizer system attached to a base portion.

FIG. 22 illustrates a close up view of the horseshoe shaped attachment area of FIG. 21. In this embodiment, second horseshoe attachment portion 1902 may be located a first distance D1 from center seam 1711 at a location adjacent to forefoot region 10. In an exemplary embodiment, second horseshoe attachment portion 1902 at center of midfoot region 12 may be located a second distance D2 from center seam 1711. In this embodiment, second distance D2 may be smaller than first distance D1. Additionally, as shown in this embodiment, outer periphery 1716 may be located a third distance D3 from center seam 1711. In an exemplary embodiment, second distance D2 may be substantially smaller than third distance D3. In one embodiment, first distance D1 also may be substantially smaller than third distance D3. With this arrangement, foot stabilizer system 1720 may be selectively decoupled from article 1700 at widths corresponding to the difference between third distance D3 associated with bottom surface of upper 1711 and each of first distance D1 and second distance D2 associated with the horseshoe shaped attachment area of foot stabilizer system 1720. It should be understood that a corresponding arrangement may be provided with regard to first horseshoe attachment portion 1900.

Figure 23:
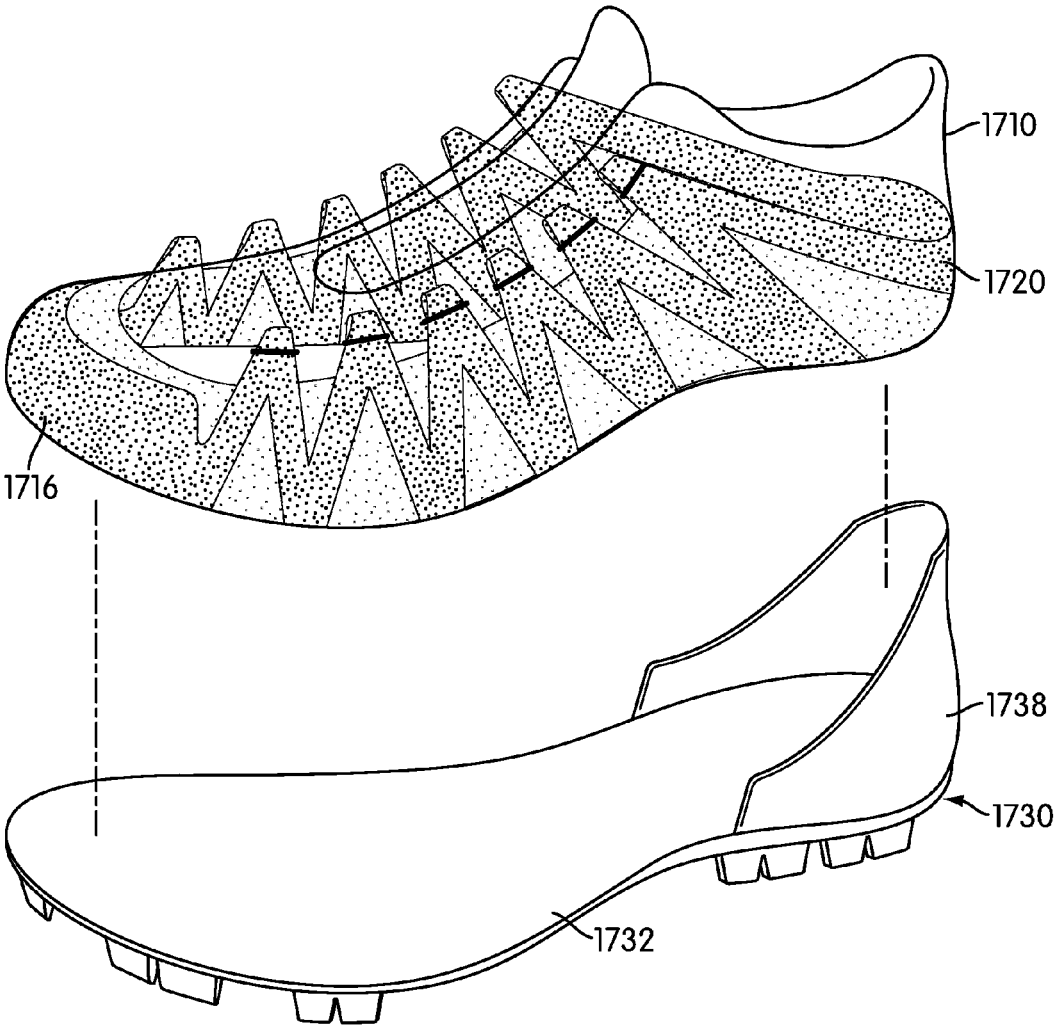
FIG. 23 is an exploded view of an alternate embodiment of an article of footwear including a decoupled foot stabilizer system.

Referring now to FIG. 23, foot stabilizer system 1720 is illustrated selectively decoupled from upper 1710. In some embodiments, bottom surface of upper 1710 may be secured to top surface 1732 of sole structure 1730. Top surface 1732 may be configured to attach bottom surface to sole structure 1730 using adhesive. In other embodiments, bottom surface of upper 1710 may be attached to top surface 1732 of sole structure 1730 using any suitable attachment mechanism, including, but not limited to one or more of adhesive, heat, pressure, stitching, and other methods of attachment.

Figure 24:
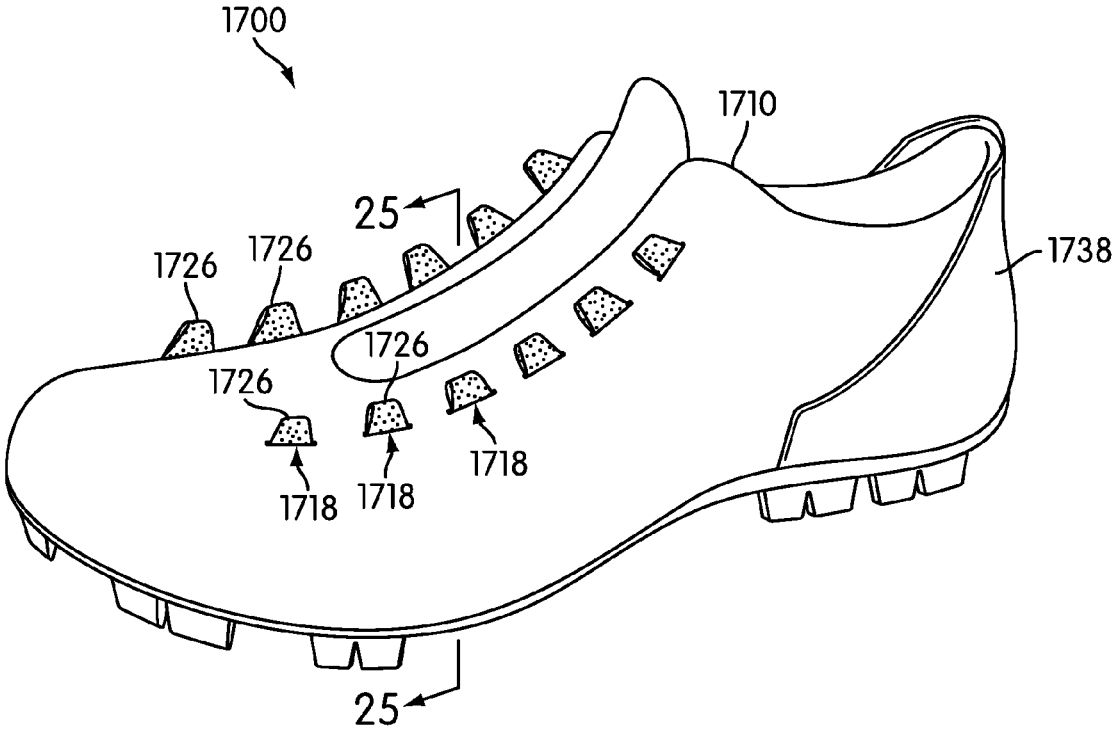
FIG. 24 is an isometric view of an alternate embodiment of an article of footwear including a decoupled foot stabilizer system.

FIG. 24 illustrates an assembled alternate exemplary embodiment of article 1700 including decoupled foot stabilizer system 1720. In this embodiment, plurality of strap members 1726 may extend out from interior of article 1700 through openings 1718 in upper 1710. In some embodiments, each plurality of strap members 1726 may include a lacing hole at the distal end for receiving a lace. In this exemplary embodiment, the lacing hole is a tab formed by attaching a folded over end of the strap member to itself. In different embodiments, the plurality of strap members may include lacing holes as discussed above.

In some embodiments, article of footwear 1700 may include a lace (not shown). In some embodiments, lace may run through plurality of tabs at the distal ends of the plurality of strap members 1726 extending out through the openings 1718 in upper 1710. In an exemplary embodiment, the lace allows article of footwear 1700 to tighten around the foot of a wearer. In other embodiments, the lace may allow one or more of plurality of strap members 1726 to conform foot stabilizer system 1720 to a portion of the wearer's foot. In different embodiments, a lace may be used as described above to tighten foot stabilizer system 1720 against a foot of a wearer.

Figure 25:
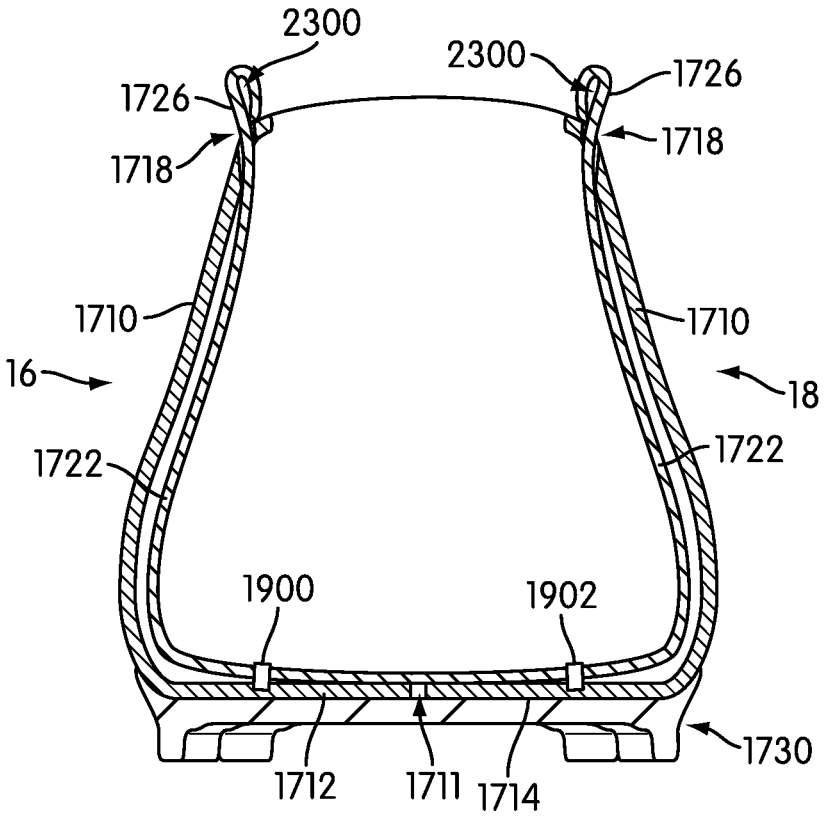
FIG. 25 is a cross-sectional view of an alternate embodiment of an article of footwear including a decoupled foot stabilizer system.
Figure 26:
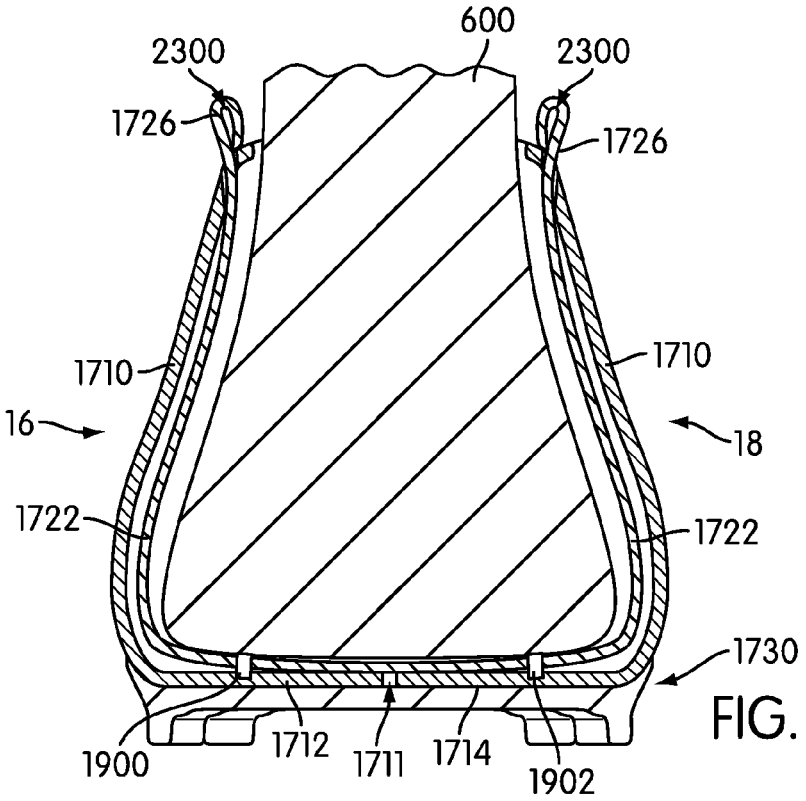
FIG. 26 is a cross-sectional view of an alternate embodiment of an article of including a decoupled foot stabilizer system with a foot disposed within.
Figure 27:
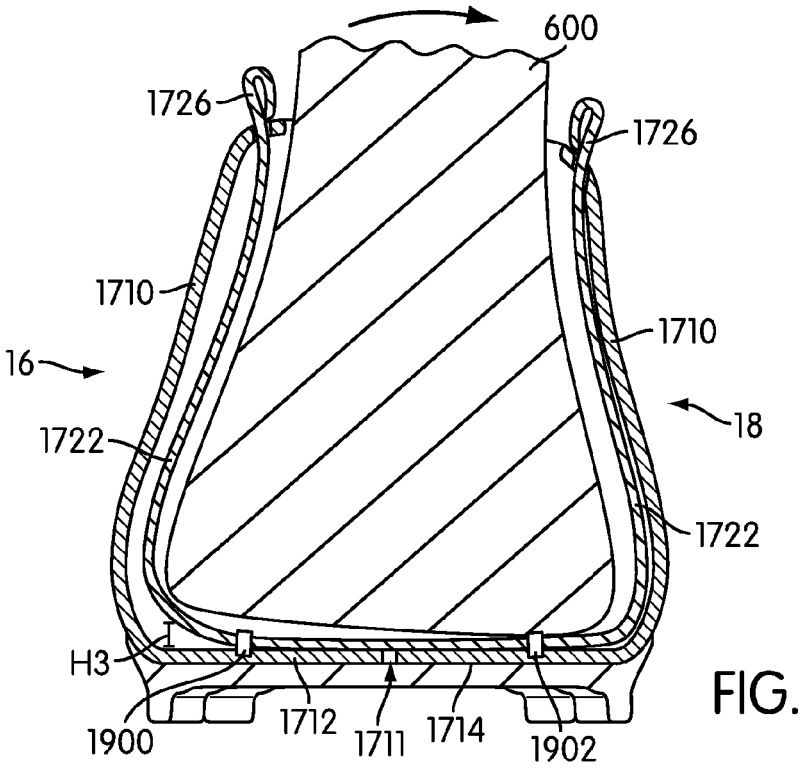
FIG. 27 is a cross-sectional view of an alternate embodiment of an article of including a decoupled foot stabilizer system with a foot disposed within applying a lateral force.

FIGS. 25 through 27 illustrate a cross-sectional view of an alternate exemplary embodiment of article of footwear 1700 incorporating decoupled foot stabilizer system 1720. As shown in FIG. 25, strap system 1722 of foot stabilizer system 1720 may be disposed within the interior of upper 1710. In this embodiment, plurality of strap members 1726 on opposing sides of article 1700 are disposed within the interior of upper 1710. In some embodiments, plurality of strap members 1726 may extend out from the interior of upper 1710 through openings 1718. Additionally, the distal ends of plurality of strap members 1726 may be associated with tabs 2300 formed by attaching a folded over end of each of plurality of strap members 1726 to itself. In an exemplary embodiment, tabs 2300 may be configured to receive a lace for tightening article 1700.

In some embodiments, strap system 1722 of foot stabilizer system 1720 may be attached to a bottom surface formed by first folding portion 1712 and second folding portion 1714 of upper 1710 joined along a center seam 1711. In this embodiment, foot stabilizer system 1720, including strap system 1722 and plurality of strap members 1726, may be secured to bottom surface along a horseshoe shaped attachment area formed by first horseshoe attachment portion 1900 and second horseshoe attachment portion 1902, as described above. In this embodiment, first horseshoe attachment portion 1900 extends through strap system 1722 and first folding portion 1712 of upper 1710 forming part of bottom surface. Similarly, second horseshoe attachment portion 1902 extends through strap system 1722 and second folding portion 1714 of upper 1710 forming part of bottom surface. In different embodiments, other attachment areas and/or attachment portions may be included to secure foot stabilizer system 1720 to a bottom surface of upper 1710 or a base portion, as described herein. In an exemplary embodiment, bottom surface of upper 1710 may be secured to sole structure 1730. In some cases, sole structure 1730 may include one or more of an insole, midsole, and/or outsole.

Referring now to FIG. 26, a cross-sectional view of an exemplary embodiment of article of footwear 1700 including decoupled foot stabilizer system 1720 is shown with foot 600 of a wearer disposed within. In some embodiments, foot stabilizer system 1720 may have one or more of plurality of strap members 1726 that surround and substantially conform to the shape of foot 600. In an exemplary embodiment, foot stabilizer system 1720 may be decoupled from bottom surface of upper 1710 at midfoot region 12. In different embodiments, various portions of foot stabilizer system 1720 may be decoupled from bottom surface of upper 1710 in one or more of forefoot region 10, midfoot region 12, and/or heel region 14.

As shown in FIG. 26, the decoupling of foot stabilizer system 1720 from bottom surface of upper 1710 at midfoot region 12 may allow foot 600 to have a degree of freedom of motion relative to article 1700. In some cases, the decoupling of foot stabilizer system 1720 may assist a wearer with a change in the direction of travel, including by "cutting" quickly to one side. For example, a wearer may cut to the right by pushing hard on his left foot.

FIG. 27 illustrates a cross-sectional view of the exemplary embodiment of FIG. 26 in the case where a wearer is making a cutting move. In this exemplary embodiment, foot stabilizer system 1720 is decoupled from bottom surface of upper 1710 at midfoot region 12. In this embodiment, plurality of strap members 1726 on opposing sides of article 1700 may stabilize foot 600 within upper 1710 during lateral movements. With this configuration, foot 600 may rotate inward towards medial side 18 when a wearer makes a cut to his right.

As shown in FIG. 27, foot stabilizer system 1720 may allow foot 600 to have freedom of motion to rotate towards medial side 18, while keeping sole structure 1730 of article 1700 in contact with the ground. In an exemplary embodiment, horseshoe shaped attachment area formed by first horseshoe attachment portion 1900 and second horseshoe attachment portion 1902 may provide decoupling to foot stabilizer system 1720 such that foot stabilizer system 1720 may move a third height H3 relative to interior of article 1700 when a wearer makes a lateral cutting move. In various embodiments, third height H3 may be larger or smaller in correspondence to the proximity of the attachment area to the outer periphery of article 1700. In this embodiment, third height H3 may be smaller than other embodiments of attachment areas with a narrower width, including, central attachment portion 131, as described above. In addition, in some cases, third height H3 may be larger than other embodiments where wider attachment areas are used to secure a foot stabilizer system.

In other embodiments, one or more portions of foot stabilizer system 1720 may provide additional stability for making lateral movements. In some cases, covered toe portion 1728 may provide support to foot 600 of a wearer during cutting movements. In other cases, foot stabilizer system 120 and/or one or more of a raised toe portion and/or a heel counter, as described above, may provide stability to foot 600 during other movements, including, but not limited to: moving in a forward or rearward direction, running, jumping and other athletic movements.

Figure 28:
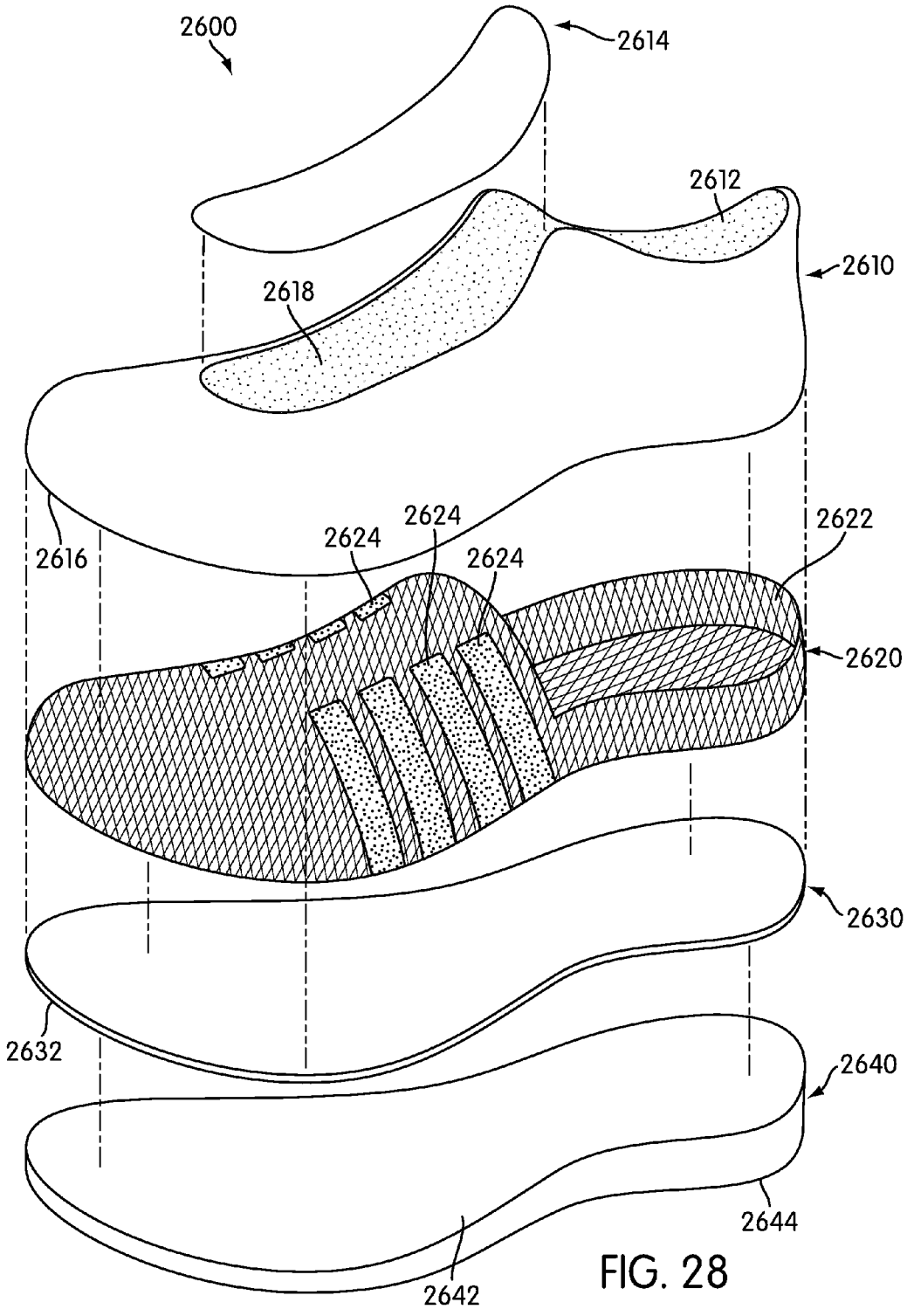
FIG. 28 is an exploded view of an alternate embodiment of an article of footwear including a decoupled foot stabilizer system.

FIGS. 28 through 35 illustrate an alternate exemplary embodiment of an article of footwear including a decoupled foot stabilizer system. In some embodiments, a foot stabilizer system may be configured for various sports and/or activities. In an exemplary embodiment, an article of footwear may include a decoupled foot stabilizer system that may be configured for tennis or other sports involving frequent lateral movements. FIG. 28 illustrates an exploded view of an alternate exemplary embodiment of an article of footwear 2600. In this embodiment, article 2600 may include a decoupled foot stabilizer system 2620. In this embodiment, foot stabilizer system 2620 includes a partial bootie or sock liner 2622. It should be understood, however, that foot stabilizer system 2620 may optionally include a bootie and/or sock liner as described in previous embodiments, or may omit any bootie or sock liner component. In one embodiment, foot stabilizer system 2620 may include a partial bootie 2622 configured to extend over the top of a foot and/or the toes of a wearer, while leaving an ankle of a wearer exposed. In other embodiments, partial bootie 2622 may extend over only a portion of a wearer's foot and may leave exposed one or more of the toes, heel, ankle, and any other part of a wearer's foot.

In an exemplary embodiment, partial bootie 2622 may be made from an elastic mesh material. In one exemplary embodiment, partial bootie 2622 may be made of an opaque or semi-transparent material. In another embodiment, partial bootie 2622 may be made of a lightweight material. In some cases, partial bootie 2622 may be made of a netting material. In different embodiments, partial bootie 2622 may be made from any one or a combination of elastic or stretchable materials, including, but not limited to: woven synthetic fibers, polyurethane, nylon, cotton, spandex, neoprene, and other natural and synthetic materials. In other embodiments, partial bootie 2622 may be made of any material used for any upper, bootie, and/or sock liner described herein.

In some embodiments, foot stabilizer system 2620 may be disposed in any one or more of forefoot region 10, midfoot region 12, and/or heel region 14 of a foot of a wearer. In an exemplary embodiment, foot stabilizer system 2620 may be disposed in only one region and/or a portion of one region. In the current embodiment, foot stabilizer system 2620 may be disposed in midfoot region 12. With this arrangement, foot stabilizer system 2620 may be configured to provide support and/or stability to an arch of a foot of a wearer. In some embodiments, foot stabilizer system 2620 may include a strap system. In various embodiments, the strap system may include any strap system described herein. In an exemplary embodiment, the strap system may include a plurality of strap members 2624. In one embodiment, plurality of strap members 2624 may include woven textile straps. In other embodiments, plurality of strap members 2624 may include any strap member of a type and/or material described herein. In an exemplary embodiment, plurality of strap members 2624 may be configured to distribute the load associated with supporting a foot of a wearer.

In an exemplary embodiment, plurality of strap members 2624 may be configured to support an arch of a foot of a wearer. In one embodiment, plurality of strap members 2624 may be disposed on opposite sides of partial bootie 2622. In an exemplary embodiment, plurality of strap members 2624 may be positioned on a lateral side and a medial side of foot stabilizer system 2620. In the embodiment shown in FIG. 28, foot stabilizer system 2620 may include four strap members 2624 disposed on each side of article 2600. In other embodiments, foot stabilizer system 2620 may include foot stabilizer system 2620 having more or less strap members 2624. In addition, while in the current embodiment, plurality of strap members 2624 are shown without any connecting material between each of the strap members, it should be understood that in other embodiments, plurality of strap members 2624 may be connected to each other using a webbing material that may be substantially similar to webbing 202 described above.

Additionally, in various embodiments, foot stabilizer system 2620 may optionally include one or more additional components associated with previous embodiments of a foot stabilizer system, including, but not limited to one or more of a raised toe portion, a covered toe portion, and/or a heel counter, as described above.

In some embodiments, article 2600 may include an upper 2610. Generally, upper 2610 provides a covering for the foot that comfortably receives and securely positions the foot with respect to a sole structure 2640. In some embodiments, upper 2610 may include one or more components. Typically, upper 2610 may be configured to receive a foot of a wearer. In some embodiments, upper 2610 may include an entry hole or throat opening configured to receive a foot of a wearer. With this arrangement, entry hole or throat opening may allow a foot to be inserted into an interior of article 2600.

In an exemplary embodiment, upper 2610 also may include a tongue area 2618. In this embodiment, tongue area 2618 may include a portion of upper 2610 that may be tightened around a foot of a wearer. In some embodiments, tongue area 2618 may include opposing sides of upper 2610 that may be pulled together using laces. In some cases, tongue area 2618 may include a tongue 2614. In an exemplary embodiment, tongue 2614 may be attached to upper 2610 at tongue area 2618, as described below. In other embodiments, tongue 2614 may be attached to upper 2610 in a manner as described in previous embodiments. In other cases, tongue area 2618 may include an elastic or stretchable region of upper 2610.

In some embodiments, article 2600 may include sole structure 2640. Sole structure 2640 may be generally positioned between a foot of a wearer and the ground. In some embodiments, sole structure 2640 may include one or more of an outsole, a midsole, a single piece sole, and/or any number of additional components associated with a conventional sole. In an exemplary embodiment, sole structure 2640 may include a cushioned sole structure for engaging with the ground. It should be understood, however, that article 2600 may include any type of sole structure 2640. Additionally, sole structure 2640 may optionally include one or more tread elements as described herein or known in the art.

Figure 29:
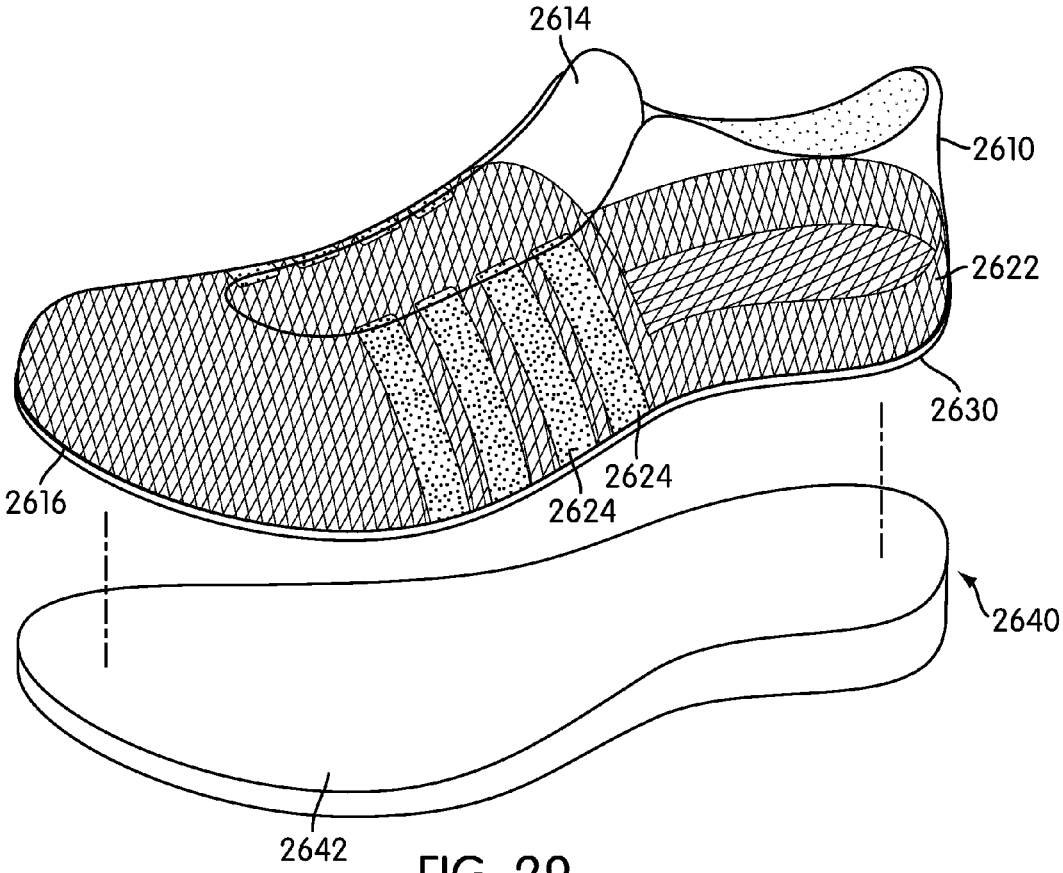
FIG. 29 is an exploded view of an alternate embodiment of an article of footwear including a decoupled foot stabilizer system attached to a base portion.

In some embodiments, article 2600 may include a base portion 2630. Base portion 2630 may be generally positioned between the foot of a wearer and sole structure 2640. In some embodiments, upper 2610 may be configured to be secured to base portion 2630. In an exemplary embodiment, base portion 2630 may be secured to a lower portion of upper 2610. In this embodiment, upper 2610 may be attached to base portion 2630 so as to enclose foot stabilizer system 2620 in the interior of article 2600, as shown in FIG. 29. In some cases, upper 2610 and base portion 2630 may be attached by stitching. In one embodiment, a lower periphery 2616 of upper 2610 may be strobel stitched to an outer periphery 2632 of base portion 2630. In other embodiments, other types of stitching may be used to attach upper 2610 and base portion 2630. In other cases, upper 2610 and base portion 2630 may be secured using other attachment mechanisms, including, but not limited to: adhesive, heat bonding, pressure, and any other method of attachment. In other embodiments, more or less of upper 2610 may be secured to base portion 2630.

In some embodiments, base portion 2630 may be configured to be secured sole structure 2640. In an exemplary embodiment, base portion 2630 may be secured to an upper portion of sole structure 2640. In this embodiment, base portion 2630 may be secured to a top surface 2642 of sole structure 2640. In different embodiments, base portion 2630 may include one or more of a midsole, strobel, and/or a portion of upper 2610 that is configured to be attached to sole structure 2640. In an exemplary embodiment, top surface 2642 may be configured to attach base portion 2630 to sole structure 2640 using adhesive. In other embodiments, base portion 2630 may be attached to top surface 2642 of sole structure 2640 using any suitable attachment mechanism, including, but not limited to one or more of adhesive, heat, pressure, stitching, and other methods of attachment.

In some embodiments, base portion 2630 may be disposed between foot stabilizer system 2620 and sole structure 2640. As shown in FIG. 29, in one embodiment, foot stabilizer system 2620 may be secured to base portion 2630. In an exemplary embodiment, foot stabilizer system 2620 may be secured to base portion 2630 in a manner such that foot stabilizer system 2620 is selectively decoupled from one or more portions of article 2600. In different embodiments, foot stabilizer system 2620 may be decoupled from base portion 2630 using various attachment portions as described herein. In one embodiment, foot stabilizer system 2620 may be attached to base portion 2630 using an hourglass shaped attachment portion, as described below. In other embodiments, foot stabilizer system 2620 may be attached to base portion 2630 using a similar arrangement as described in any of the previous embodiments.

Figure 30:
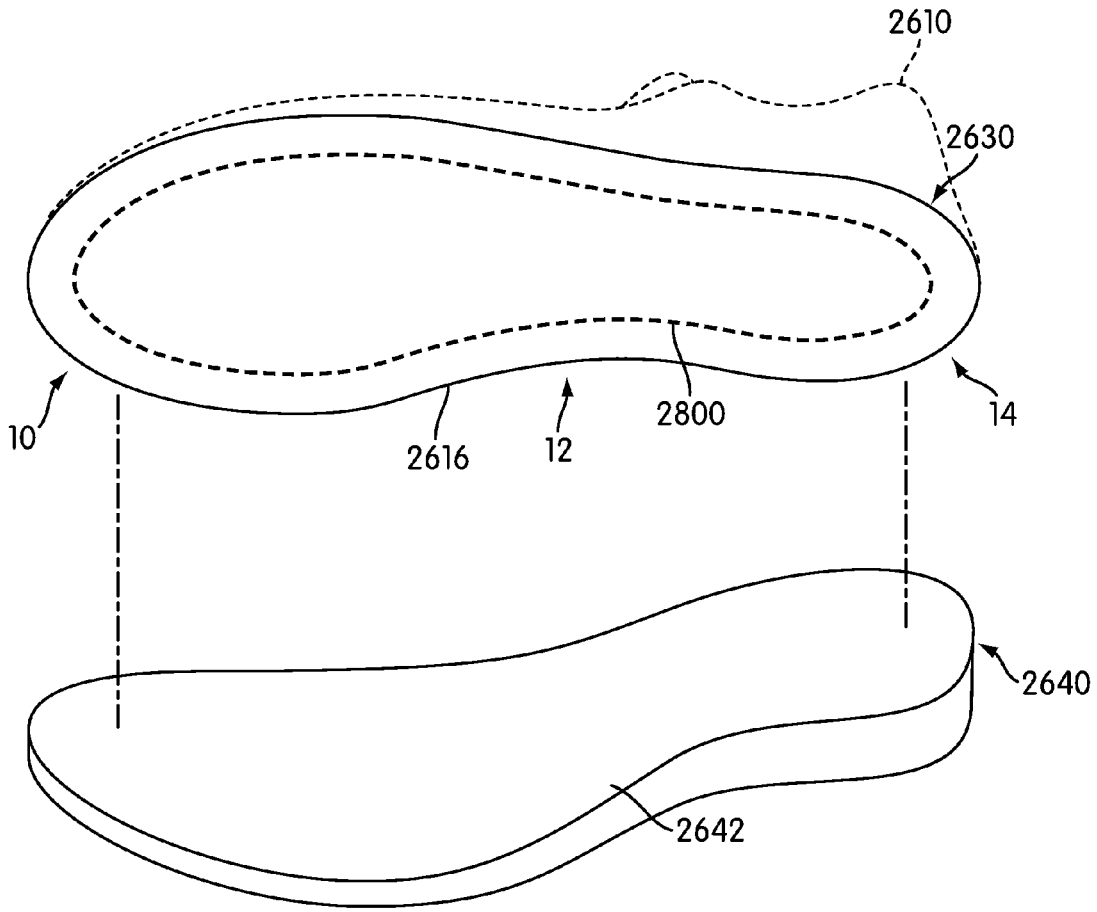
FIG. 30 is an exploded view of an alternate embodiment of a decoupled foot stabilizer system attached to a base portion.

FIG. 30 illustrates an exploded view of article 2600 including an underside of base portion 2630. In some embodiments, foot stabilizer system 2620 may be secured to base portion 2630 in a manner such that foot stabilizer system 2620 is selectively decoupled from one or more portions of article 2600. In different embodiments, foot stabilizer system 2620 may be decoupled from base portion 2630 using various attachment portions as described herein.

In an exemplary embodiment, foot stabilizer system 2620 may be secured to base portion 2630 using an hourglass shaped attachment area. As shown in FIG. 30, an hourglass shaped attachment area may be defined by an hourglass attachment portion 2800 extending around a perimeter of base portion 2300. In this embodiment, hourglass attachment portion 2800 may selectively decouple portions of foot stabilizer system 2620 from base portion 2630. In one embodiment, hourglass attachment portion 2800 may extend around the perimeter of base portion 2630 at a distance less than outer periphery 2616 of upper 2610. Additionally, hourglass attachment portion 2800 extends through midfoot region 12, hourglass attachment portion 2800 may become narrower, such that in this region hourglass attachment portion 2800 is located farther from outer periphery 2616. With this arrangement, foot stabilizer system 2620 may be selectively decoupled from article 2600 at midfoot region 12.

Figure 31:
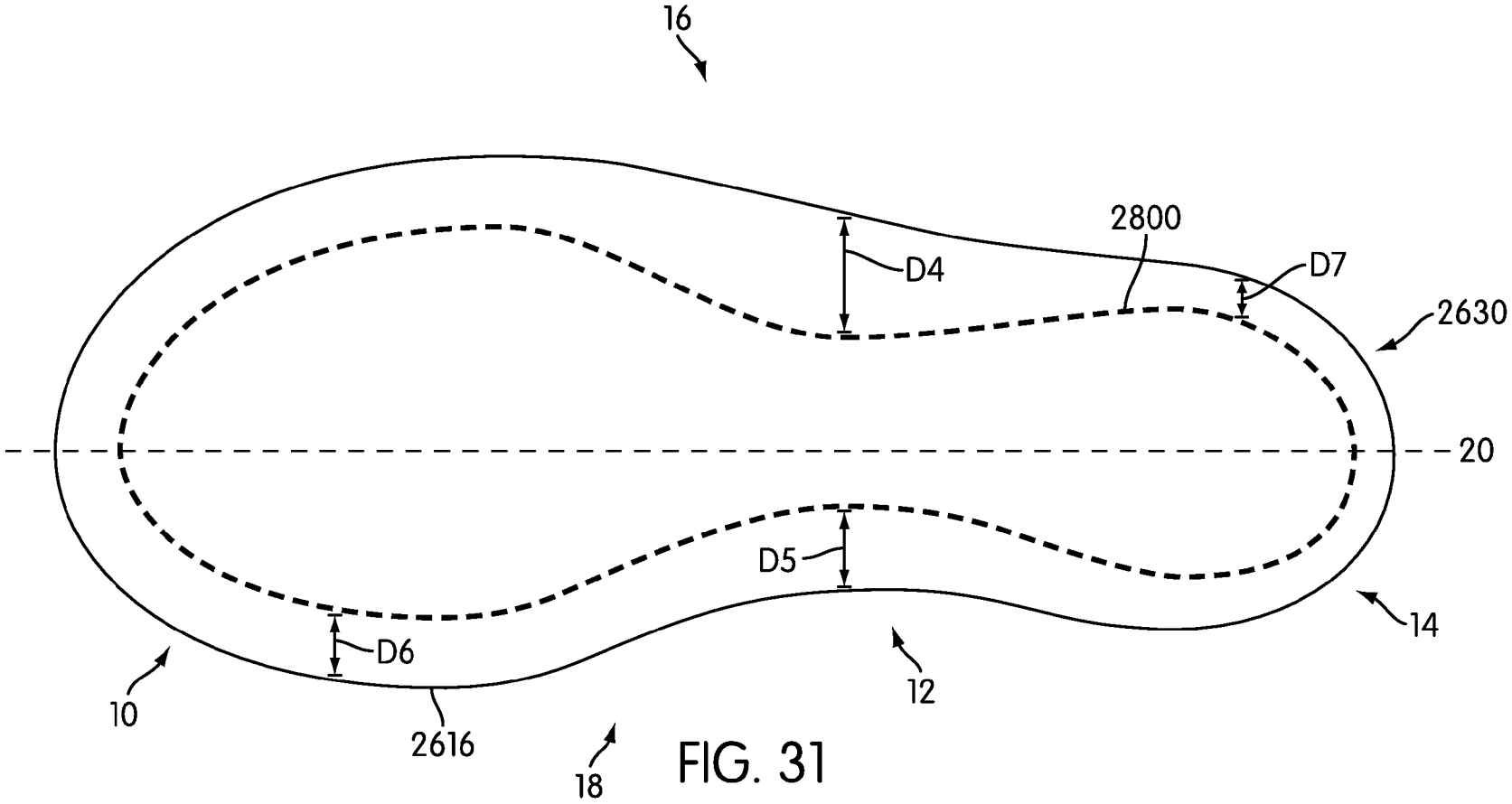
FIG. 31 is a bottom view of a decoupled foot stabilizer system attached to a base portion.

FIG. 31 illustrates a plan view of the hourglass shaped attachment area of FIG. 30. In some embodiments, foot stabilizer system 2620 may be selectively decoupled from a portion of article 2600 in one or more regions using an hourglass attachment area to secure foot stabilizer system 2620 to base portion 2630. In an exemplary embodiment, hourglass attachment portion 2800 may be narrower in midfoot region 12 than forefoot region 10 and/or heel region 14. In this embodiment, hourglass attachment portion 2800 may be located a fourth distance D4 from outer periphery 2616 of upper 2610 on lateral side 16. Similarly, hourglass attachment portion 2800 may be located a fifth distance D5 from outer periphery 2616 on medial side 18.

In some embodiments, fourth distance D4 and fifth distance D5 may be substantially similar. In some cases, fourth distance D4 and/or fifth distance D5 may be larger or smaller, to increase or decrease, respectively, the decoupling of foot stabilizer system 2620 to base portion 2630 and/or article 2600. With this arrangement, foot stabilizer system 2620 may be selectively decoupled at midfoot region 12 of article 2600.

In one embodiment, fourth distance D4 may be larger than fifth distance D5. In other embodiments, fifth distance D5 may be larger than fourth distance D4. By providing hourglass attachment portion 2800 with one of fourth distance D4 and fifth distance D5 that is larger than the other, foot stabilizer system 2620 may be configured to have a greater degree of decoupling on one of lateral side 16 and medial side 18. For example, in the case where fourth distance D4 of hourglass attachment portion 2800 from outer periphery 2616 on lateral side 16 is larger than fifth distance D5 of hourglass attachment portion 2800 from outer periphery on medial side 18, foot stabilizer system 2620 may have a greater degree of decoupling from article 2600 on lateral side 16. With this arrangement, a foot stabilizer system may be configured with a greater degree of decoupling on one of a lateral side and/or medial side for each article in a pair of footwear. In addition, in some embodiments, an article including a foot stabilizer system with a greater degree of decoupling on one of a lateral side and/or medial side may be configured for various sports.

In some embodiments, hourglass attachment portion 2800 may be configured to be located closer to outer periphery 2616 in one of forefoot region 10 and/or heel region 14 than in midfoot region 12. In an exemplary embodiment, hourglass attachment portion 2800 may be located a sixth distance D6 from outer periphery 2616 at forefoot region 10. Similarly, in this embodiment, hourglass attachment portion 2800 may be located a seventh distance D7 from outer periphery 2616 at heel region 14. In some embodiments, each of sixth distance D6 and seventh distance D7 may be smaller than fourth distance D4 and/or fifth distance D5 at midfoot region 12. In an exemplary embodiment, each of sixth distance D6 and seventh distance D7 may be substantially smaller than fourth distance D4 and/or fifth distance D5. Additionally, in some embodiments, sixth distance D6 and seventh distance D7 may be substantially similar. In other embodiments, one of sixth distance D6 and seventh distance D7 may be larger than the other. With this arrangement, the degree of decoupling of foot stabilizer system 2630 from article 2600 in forefoot region 10 and/or heel region 14 may be customized to be greater or smaller in correspondence to the distance of hourglass attachment portion from outer periphery 2616 in the respective regions. Further, hourglass attachment portion 2800 in forefoot region 10 and/or heel region 14 may also be varied in distance between lateral side 16 and medial side 18 to provide a greater or smaller degree of decoupling of foot stabilizer system 2620 from one side of article 2600, as discussed above in regard to midfoot region 12.

Figure 32:
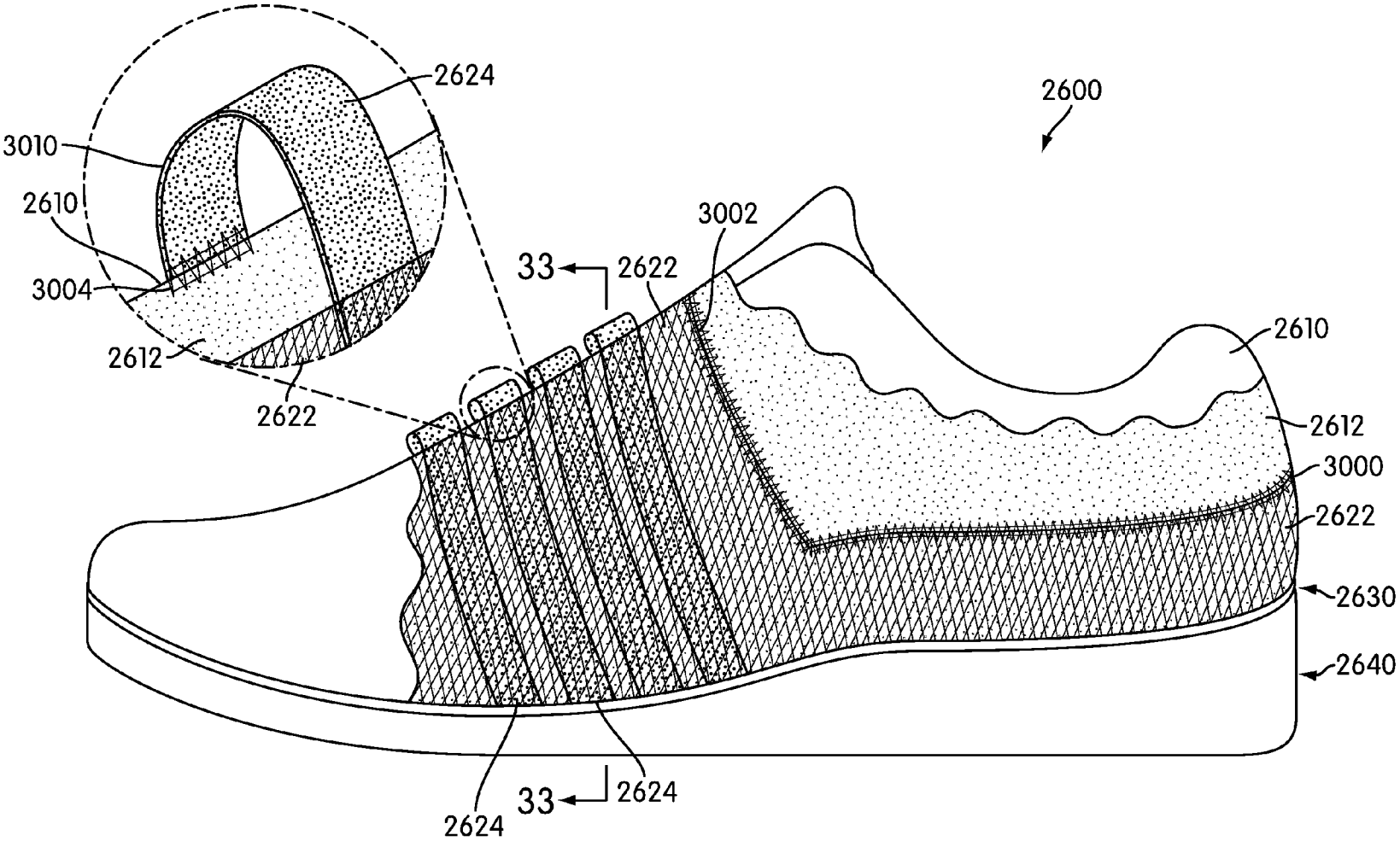
FIG. 32 is an interior view of an alternate embodiment of an article of footwear including a decoupled foot stabilizer system.

Referring now to FIG. 32, a cut-away view of article 2600 including foot stabilizer system 2620 is illustrated. As shown in FIG. 32, foot stabilizer system 2620 may be disposed in the interior of article 2600. In some embodiments, one or more portions of foot stabilizer system 2630 may be secured to upper 2610. In an exemplary embodiment, partial bootie 2622 of foot stabilizer system 2620 may be attached to a portion of upper 2610 located in the interior of article 2610. In one embodiment, upper 2610 may include a liner fabric 2612 or similar material disposed on an interior surface of upper 2610. In an exemplary embodiment, partial bootie 2622 may be attached to liner fabric 2612 at one or more attachment portions. In this embodiment, partial bootie 2622 may be attached to liner fabric 2612 along a first liner attachment portion 3000 extending along a longitudinal direction from heel region 14 towards midfoot region 12. Additionally, partial bootie 2622 may be attached to liner fabric 2612 along a second liner attachment portion 3002 extending along a vertical direction towards the top of article 2600. In other embodiments, first liner attachment portion 3000 and/or second liner attachment portion 3002 may extend more less distance to attach partial bootie 2622 and liner fabric 2612.

In some embodiments, one or more of plurality of strap members 2624 may be secured to a portion of upper 2610. In an exemplary embodiment, plurality of strap members 2624 may extend out from interior of article 2600 and attach to upper 2610. In one embodiment, a distal end 3010 of strap member 2624 may be attached to upper 2610 at a strap attachment portion 3004. In some embodiments, distal end 3010 of strap member 2624 may be folded over and attached to upper 2610 at strap attachment portion 3004 to form a loop. With this arrangement, plurality of strap members 2624 may be configured to form one or more loops in tongue area 2618 for receiving a lace.

Additionally, in some embodiments, tongue 2616 may be attached to upper 2610 using one or more of plurality of strap members 2624. In one exemplary embodiment, distal end 3010 of strap member 2624 may pass through a portion of tongue 2616 prior to distal end 3010 being attached to upper 2610 at strap attachment portion 3004. With this arrangement, tongue 2616 may be held in tongue area 2618 by one or more loops formed in plurality of strap members 2624.

Figure 33:
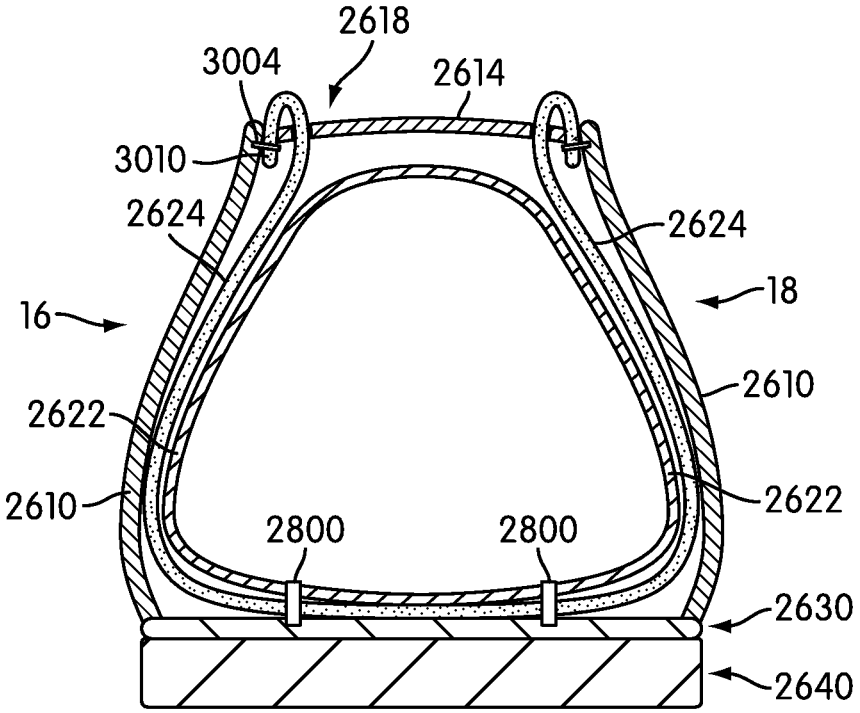
FIG. 33 is a cross-sectional view of an alternate embodiment of an article of footwear including a decoupled foot stabilizer system.
Figure 34:
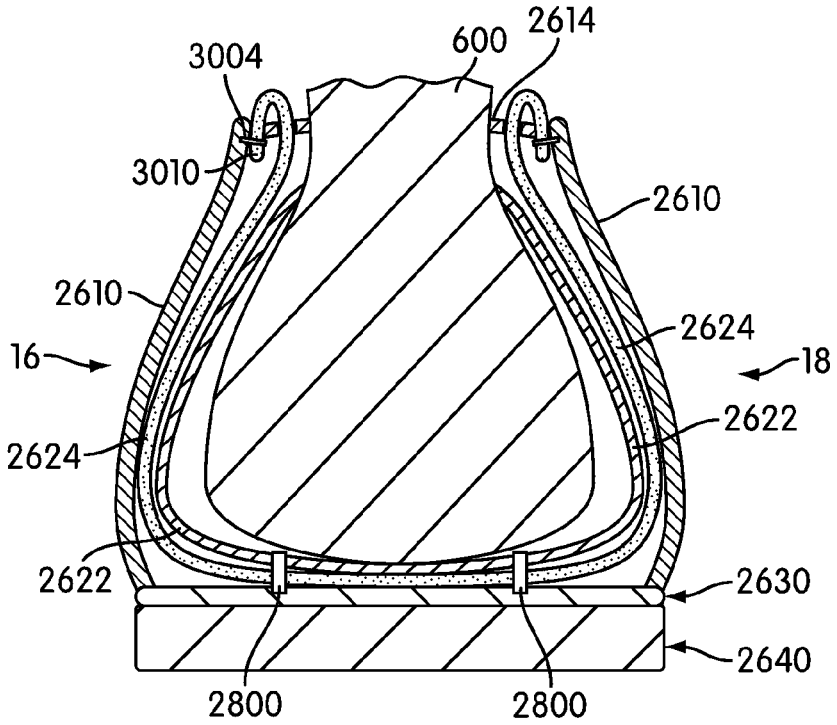
FIG. 34 is a cross-sectional view of an alternate embodiment of an article of including a decoupled foot stabilizer system with a foot disposed within.
Figure 35:
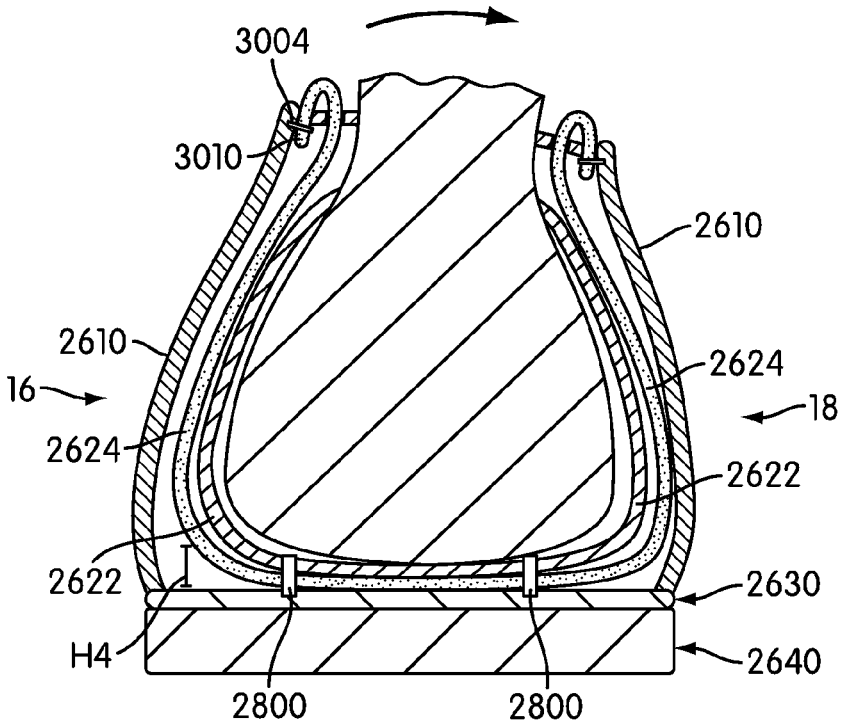
FIG. 35 is a cross-sectional view of an alternate embodiment of an article of including a decoupled foot stabilizer system with a foot disposed within applying a lateral force.

FIGS. 33 through 35 illustrate a cross-sectional view of an alternate exemplary embodiment of article of footwear 2600 incorporating decoupled foot stabilizer system 2620. As shown in FIG. 33, partial bootie 2622 may be disposed within the interior of upper 2610. In this embodiment, plurality of strap members 2624 on opposing sides may be disposed between partial bootie 2622 and upper 2610. In some embodiments, plurality of strap members 2624 may extend out from the interior of upper 2610 as described above. Additionally, distal end 3010 of strap members 2624 may be associated with loops formed by attaching the folded over distal end 3010 of each of plurality of strap members 2624 to upper 2610 at strap attachment portion 3004. In an exemplary embodiment, loops formed by distal end 3010 of strap members 2624 may be configured to receive a lace for tightening article 2600. Further, in some embodiments, strap members 2624 may pass through a portion of tongue 2614, as described above, to associate tongue 2614 with tongue area 2618.

In some embodiments, foot stabilizer system 2620 may be attached to base portion 2630, as described above. In this embodiment, foot stabilizer system 2620, including partial bootie 2622 and plurality of strap members 2624, may be secured to base portion 2630 along an hourglass shaped attachment area formed by hourglass attachment portion 2800, as described above. In different embodiments, other attachment areas and/or attachment portions may be included to secure foot stabilizer system 2620 to base portion 2630 or a portion of upper 2610, as described herein. In one embodiment, upper 2610 also may be secured to base portion 2630. In this embodiment, upper 2610 may be attached to base portion 2630 along an outer periphery of base portion 2630. In an exemplary embodiment, base portion 2630 may be secured to sole structure 2640. In some cases, sole structure 2640 may include one or more of an insole, midsole, and/or outsole.

Referring now to FIG. 34, a cross-sectional view of an exemplary embodiment of article of footwear 2600 including decoupled foot stabilizer system 2620 is shown with foot 600 of a wearer disposed within. In some embodiments, foot stabilizer system 2620 may have one or more of plurality of strap members 2624 and/or partial bootie 2622 that surround and substantially conform to the shape of foot 600. In an exemplary embodiment, foot stabilizer system 2620 may be decoupled from base portion 2630 at midfoot region 12. In different embodiments, various portions of foot stabilizer system 2620 may be decoupled from base portion 2630 in one or more of forefoot region 10, midfoot region 12, and/or heel region 14.

As shown in FIG. 34, the decoupling of foot stabilizer system 2620 from base portion 2630 at midfoot region 12 may allow foot 600 to have a degree of freedom of motion relative to article 2600. In some cases, the decoupling of foot stabilizer system 2620 may assist a wearer with a change in the direction of travel, including by "cutting" quickly to one side. For example, a wearer may cut to the right by pushing hard on his left foot.

FIG. 35 illustrates a cross-sectional view of the exemplary embodiment of FIG. 34 in the case where a wearer is making a cutting move. In this exemplary embodiment, foot stabilizer system 2620 is decoupled from base portion 2630 at midfoot region 12. In this embodiment, plurality of strap members 2624 on opposing sides of article 2600 may stabilize foot 600 within upper 2610 during lateral movements. With this configuration, foot 600 may rotate inward towards medial side 18 when a wearer makes a cut to his right.

As shown in FIG. 35, foot stabilizer system 2620 may allow foot 600 to have freedom of motion to rotate towards medial side 18, while keeping sole structure 2640 of article 2600 in contact with the ground. In an exemplary embodiment, an hourglass shaped attachment area formed by hourglass attachment portion 2800 may provide decoupling to foot stabilizer system 2620 such that foot stabilizer system 2620 may move a fourth height H4 relative to interior of article 2600 when a wearer makes a lateral cutting move. In various embodiments, fourth height H4 may be larger or smaller in correspondence to the proximity of the attachment area to the outer periphery of article 2600. In this embodiment, fourth height H4 may be smaller than other embodiments of attachment areas with a narrower width, including central attachment portion 131, as described above. In addition, in some cases, fourth height H4 may be larger than other embodiments where wider attachment areas are used to secure a foot stabilizer system, including a horseshoe attachment area, as described above.

Figure 36:
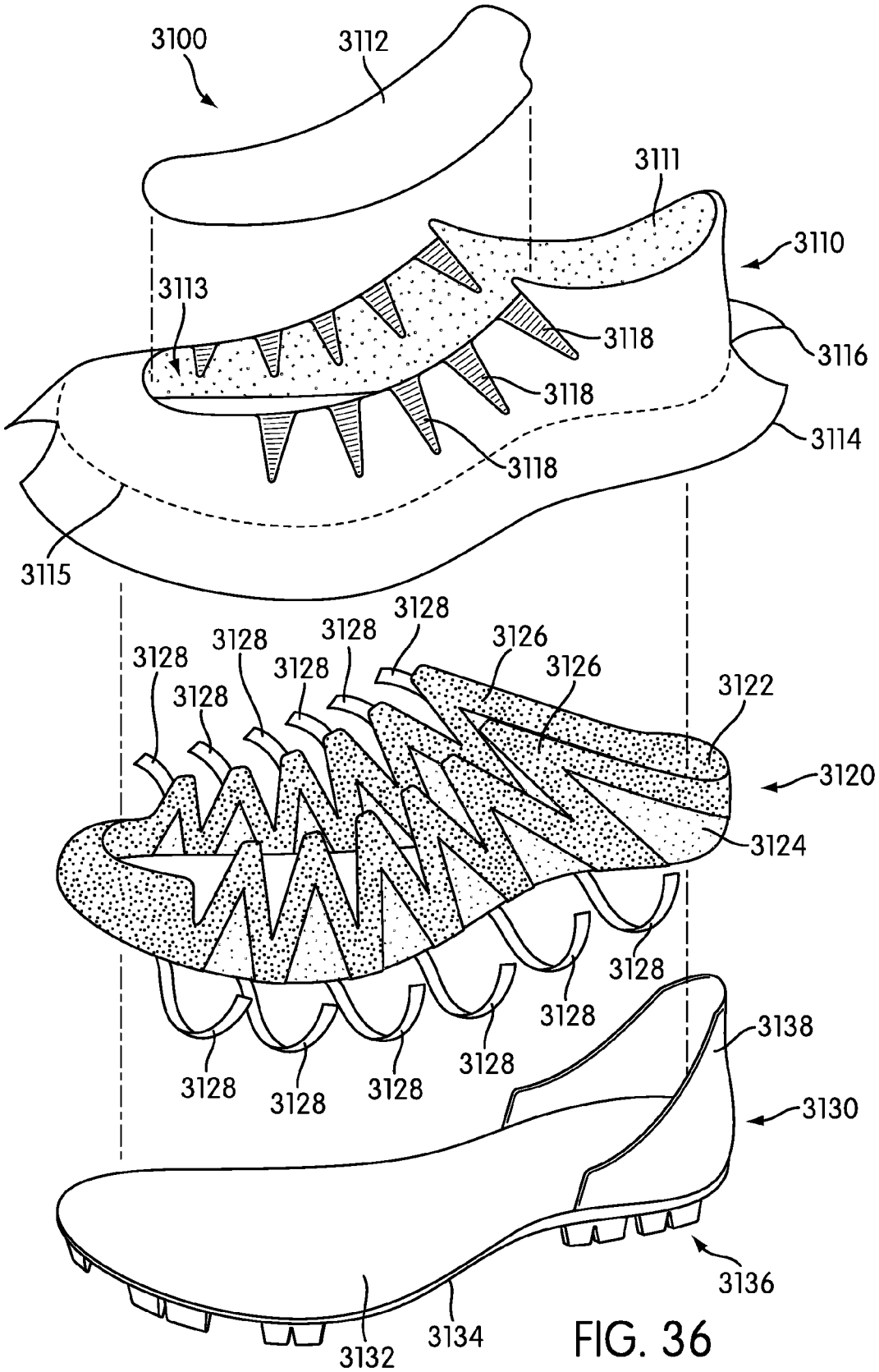
FIG. 36 is an exploded view of an alternate embodiment of an article of footwear including a decoupled foot stabilizer system.

FIGS. 36 through 44 illustrate an alternate exemplary embodiment of an article of footwear including a decoupled foot stabilizer system. In some embodiments, a foot stabilizer system may be associated with a portion of an upper of an article of footwear. FIG. 36 illustrates an exploded view of an alternate exemplary embodiment of an article of footwear 3100. In some embodiments, article 3100 may include an upper 3110. Generally, upper 3110 provides a covering for the foot that comfortably receives and securely positions the foot with respect to a sole structure 3130. In some embodiments, one or more portions of upper 3110 may be configured to fold under the top of upper 3110 to provide a surface for attaching to sole structure 3130. In exemplary embodiment, upper 3110 may be provided with extra material on a medial side and a lateral side for forming a bottom surface to be secured to sole structure 3130. In one embodiment, upper 3110 may include a first folding portion 3114 and a second folding portion 3116 located at the bottom of opposing sides of upper 3110. In this embodiment, each of first folding portion 3114 and second folding portion 3116 may be folded along an outer periphery 3115 of upper 3110 to form a bottom surface and enclose upper 3110.

In some embodiments, upper 3110 may include a tongue opening 3113. In this embodiment, tongue opening 3113 may include a portion of upper 3110 that may be tightened around a foot of a wearer. In some embodiments, tongue opening 3113 may include opposing sides of upper 3110 that may be pulled together using laces. In some cases, tongue opening 3113 may be associated with a tongue 3112. In other cases, tongue opening 3113 may include an elastic or stretchable region of upper 3110.

In some embodiments, upper 3110 may be comprised of one or more materials. In an exemplary embodiment, upper 3110 may include a plurality of articulated regions 3118. In one embodiment, articulated regions 3118 may be comprised of a different material than the material used for the remaining portion of upper 3110. In an exemplary embodiment, articulated regions 3118 may be made of a material that is configured to stretch in one direction and remain substantially inflexible in another direction. In this embodiment, articulated regions 3118 may be made from a material that remains substantially inflexible in a direction along the longitudinal axis of article 3100, but that is configured to stretch in a direction along the lateral and/or vertical axes.

In some cases, articulated regions 3118 of upper 3110 may be made from elastic or stretchable materials, including, but not limited to any one or a combination of: woven synthetic fibers, polyurethane, nylon, cotton, spandex, neoprene, and other natural and synthetic materials. In other cases, articulated regions 3118 may be made from any material used to make upper 3110, including but not limited to any one or a combination of: nylon, natural leather, synthetic leather, natural rubber, or synthetic rubber, or any suitable knitted, woven or non-woven material.

In some embodiments, articulated regions 3118 in upper 3110 may provide flexibility to article 3100. In this embodiment, articulated regions 3118 are arranged within triangular cut-outs or slits on upper 3110. With this arrangement, upper 3110 may be configured to bend to a greater degree than an upper without articulated regions 3118. In other embodiments, articulated regions 3118 may be any type of opening in upper 3110 that allows a greater degree of bending or flexibility to article 3100. In still other embodiments, articulated regions 3118 may be a portion of upper 3110 that is substantially free of any material.

In this embodiment, article 3100 may include an upper 3110 with articulated regions 3118 that is associated with a foot stabilizer system 3120. In this embodiment, foot stabilizer system 3120 does not include a separate bootie or sock liner component, as included in some previous embodiments. It should be understood, however, that foot stabilizer system 3120 may optionally include a bootie and/or sock liner. In one embodiment, foot stabilizer system 3120 may be configured to extend to a height below an ankle of a wearer.

In some embodiments, foot stabilizer system 3120 may include a strap system 3122. In an exemplary embodiment, strap system 3122 may include a plurality of strap members 3126. In an exemplary embodiment, plurality of strap members 3126 may be configured to provide stability and/or support to foot stabilizer system 3120. In one embodiment, strap members 3126 may have a triangular shape. In an exemplary embodiment, strap members 3126 having a triangular shape may be configured to distribute the load associated with supporting a foot of a wearer. In other embodiments, strap members 3126 may have other shapes, including a substantially similar shape as plurality of strap members 200 described above.

In an exemplary embodiment, strap members 3126 may be configured to support a foot of a wearer. In one embodiment, strap system 3122 may include a number of plurality of strap members 3126 on opposite sides. In an exemplary embodiment, plurality of strap members 3126 may be positioned on a lateral side and a medial side of foot stabilizer system 3120. In the embodiment shown in FIG. 36, foot stabilizer system 3120 may include strap system 3122 having six strap members 3126 disposed on each side of article 3100. In other embodiments, foot stabilizer system 3120 may include strap system 3122 having more or less strap members 3126.

In some embodiments, plurality of strap members 3126 may be connected to each other using a webbing material 3124. Webbing material 3124 may be substantially similar to webbing 202 described above. As shown in FIG. 36, webbing material 3124 may connect plurality of strap members 3126 along the sides of foot stabilizer system 3120. In some cases, webbing material 3124 may be disposed between fewer strap members. In other cases, webbing material 3124 may be disposed between two or more strap members on a single side of foot stabilizer system 3120. In different embodiments, webbing material 3124 may be disposed between two or more strap members associated with one or more of forefoot region 10, midfoot region 12, and heel region 14 of article 3100.

In some embodiments, article 3100 may also include provisions to associate foot stabilizer system 3120 and upper 3110. In an exemplary embodiment, article 3100 may include one or more support members 3128 that are associated with upper 3110 and foot stabilizer system 3120. In this embodiment, a plurality of support members 3128 may be disposed underneath a foot stabilizer system 3120. As shown in FIG. 36, support members 3128 extend under foot stabilizer system 3120 from the lateral side to the medial side. In some cases, an individual support member 3128 may be associated with each pair of strap members 3126 on foot stabilizer system 3120. With this arrangement, support members 3128 may be associated with strap members 3126 of strap system 3122 to provide additional support to foot stabilizer system 3120 of article 3100. In other cases, more or less support members 3128 may be provided to associate one or more portions of foot stabilizer system 3120 with portions of upper 3110. In different embodiments, support members 3128 need not be associated with strap members 3126 and may instead be associated with other portions of foot stabilizer system 3120.

In some embodiments, foot stabilizer system 3120 may include additional components configured to protect and/or provide stability and support to various portions of a foot of a wearer, including toes and/or heel of a wearer as discussed above in previous embodiments.

In some embodiments, article 3100 may include sole structure 3130. Sole structure 3130 may be generally positioned between a foot of a wearer and the ground. In some embodiments, sole structure 3130 may include one or more of an outsole, a midsole, a single piece sole, and/or any number of additional components associated with a conventional sole. In other embodiments, sole structure 3130 may include one or more tread elements for engaging with the ground. In some embodiments, sole structure 3130 may include one or more components. In some embodiments, sole structure 3130 includes a top surface 3132. Top surface 3132 may be provided to attach bottom surface of upper 3110 to sole structure 3130.

In some embodiments, sole structure 3130 may include an outsole 3134. Outsole 3134 may be any conventional outsole used with an article of footwear. In an exemplary embodiment, outsole 3134 of sole structure 3130 may include one or more tread elements 3136 for engaging with the ground. Tread elements 3136 may be any conventional tread elements used with an article of footwear, including, but not limited to a cleat. In other embodiments, sole structure 3130 may not include tread elements 3136. While FIGS. 36 through 44 illustrate sole structure 3130 having one or more tread elements, including a cleat, it should be understood that article 3100 may include sole structure 3130 as described herein without limitation to any specific type of tread element.

In some embodiments, sole structure 3130 may optionally include a heel cup 3138. In an exemplary embodiment, heel cup 3138 may be made of a rigid material to firmly support the heel of a foot of a wearer.

Figure 37:
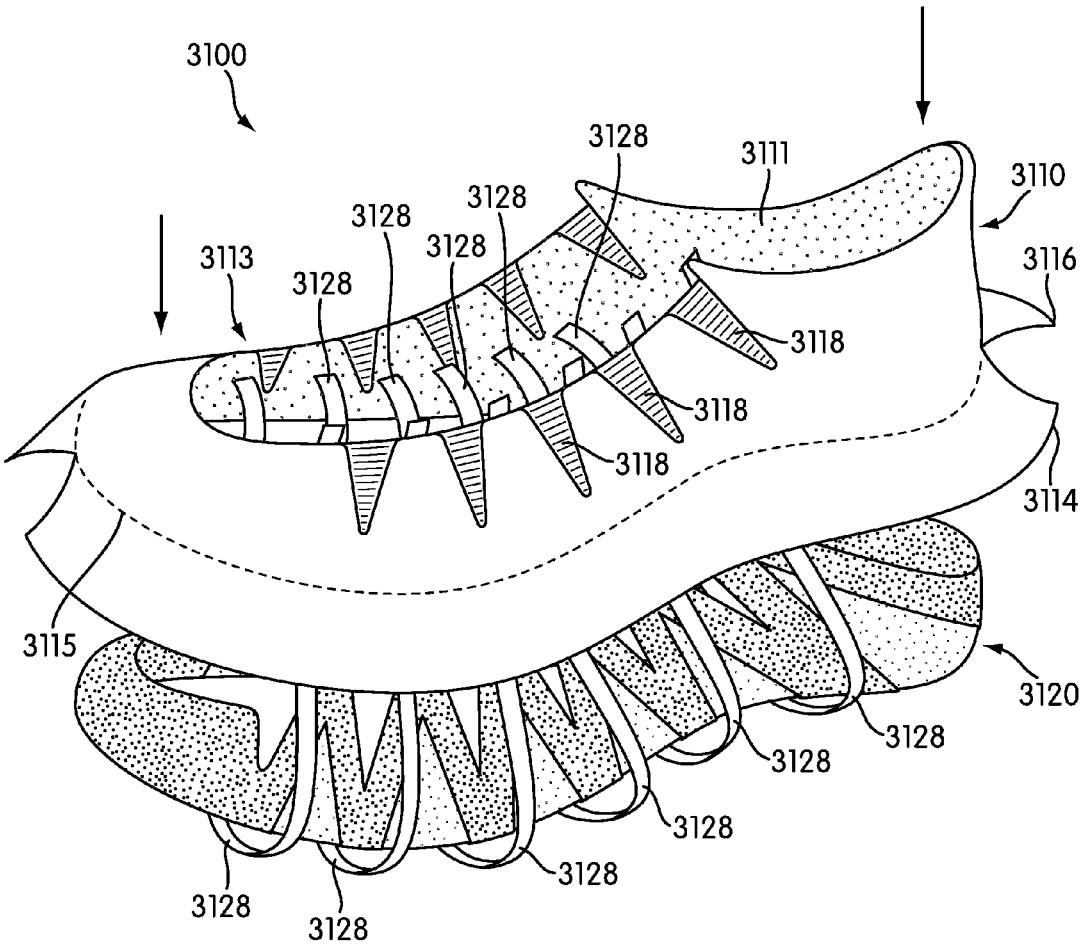
FIG. 37 is an exploded view of an alternate embodiment of an article of footwear including a decoupled foot stabilizer system showing assembly of the foot stabilizer system within an upper.

Referring now to FIG. 37, foot stabilizer system 3120 is illustrated being enclosed within upper 3110. In some embodiments plurality of support members 3128 are arranged to pass under foot stabilizer system 3120 and to extend out of upper 3110. In an exemplary embodiment, the ends of support members 3128 may pass through tongue opening 3113 of upper 3110. With this arrangement, plurality of support members 3128 may be disposed underneath foot stabilizer system 3120 within interior 3111 of upper 3110.

In some embodiments, first folding portion 3114 and second folding portion 3116 of upper 3110 may be folded under article 3100 so as to enclose foot stabilizer system 3120 within interior 3111 of upper 3110. In some embodiments, first folding portion 3114 and second folding portion 3116 of upper 3110 may be attached underneath upper 3110 to form a bottom surface. With this arrangement, bottom surface may serve a substantially similar function as base portion 130 and/or base portion 1130, described above. In an exemplary embodiment, bottom surface formed by first folding portion 3114 and second folding portion 3116 may be secured to top surface 3132 of sole structure 3130.

In different embodiments, bottom surface of upper 3110 may include one or more of a midsole and/or strobel, as described above.

Figure 38:
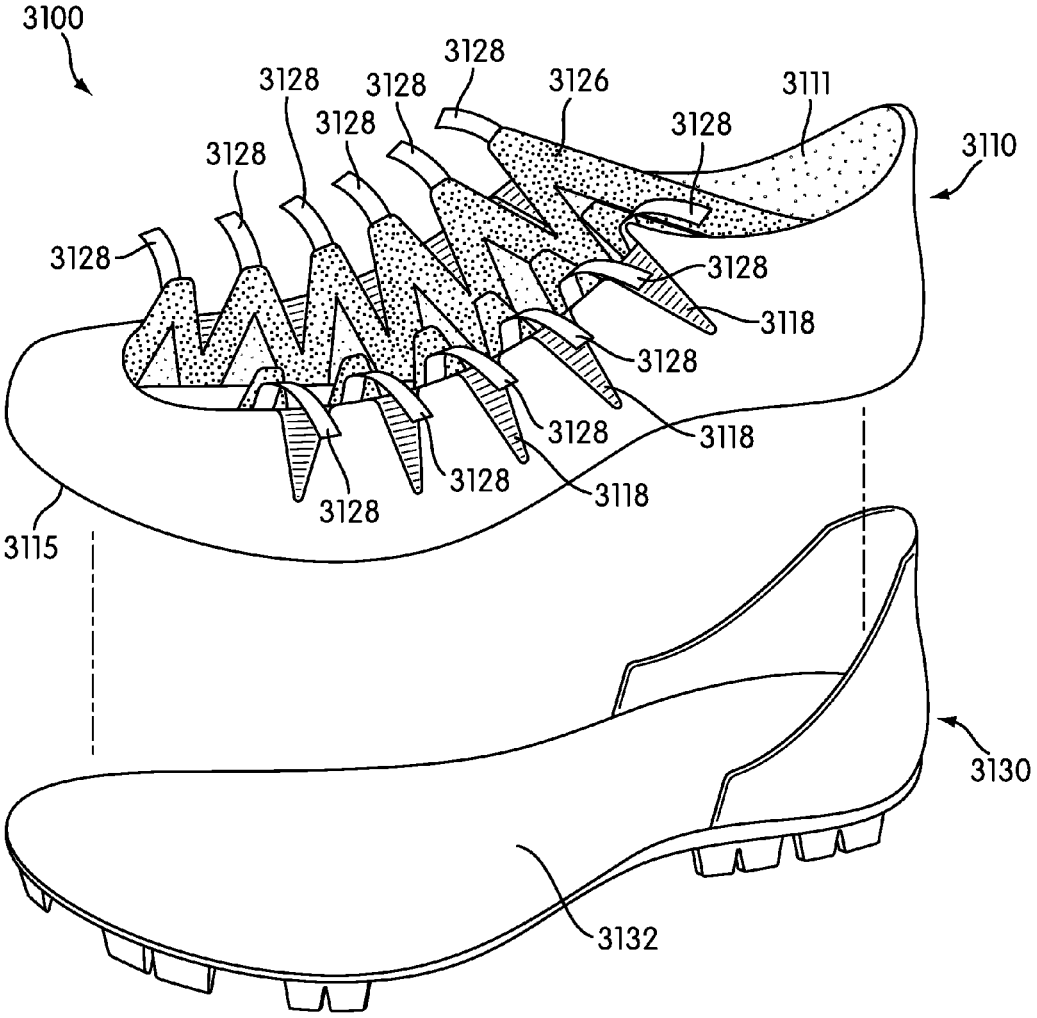
FIG. 38 is an exploded view of an alternate embodiment of an article of footwear including a decoupled foot stabilizer system being attached to a sole structure.

Referring now to FIG. 38, foot stabilizer system 3120 is shown enclosed with interior 3111 of upper 3110. In this embodiment, plurality of support members 3128 extend out from interior 3111 of upper 3110 through tongue opening 3113. In one embodiment, foot stabilizer system 3120 may be secured to bottom surface of upper 3110. In an exemplary embodiment, foot stabilizer system 3120 may be secured to bottom surface of upper 3110 in a manner such that foot stabilizer system 3120 is selectively decoupled from one or more portions of article 3100. In different embodiments, foot stabilizer system 3120 may be decoupled from bottom surface of upper 3110 using various attachment portions as described herein.

In some embodiments, upper 3110 including foot stabilizer system 3120 and plurality of support members 3128 disposed within interior 3111 may be secured to sole structure 3130. In some embodiments, bottom surface of upper 3110 may be disposed between foot stabilizer system 3120 and sole structure 3130. In one embodiment, bottom surface of upper 3110 may be attached to top surface 3132 of sole structure 3130 using adhesive. In other embodiments, bottom surface of upper 3110 may be attached top surface 3132 of sole structure 3130 using any suitable attachment mechanism, including, but not limited to one or more of adhesive, heat, pressure, stitching, and other methods of attachment.

Figure 39:
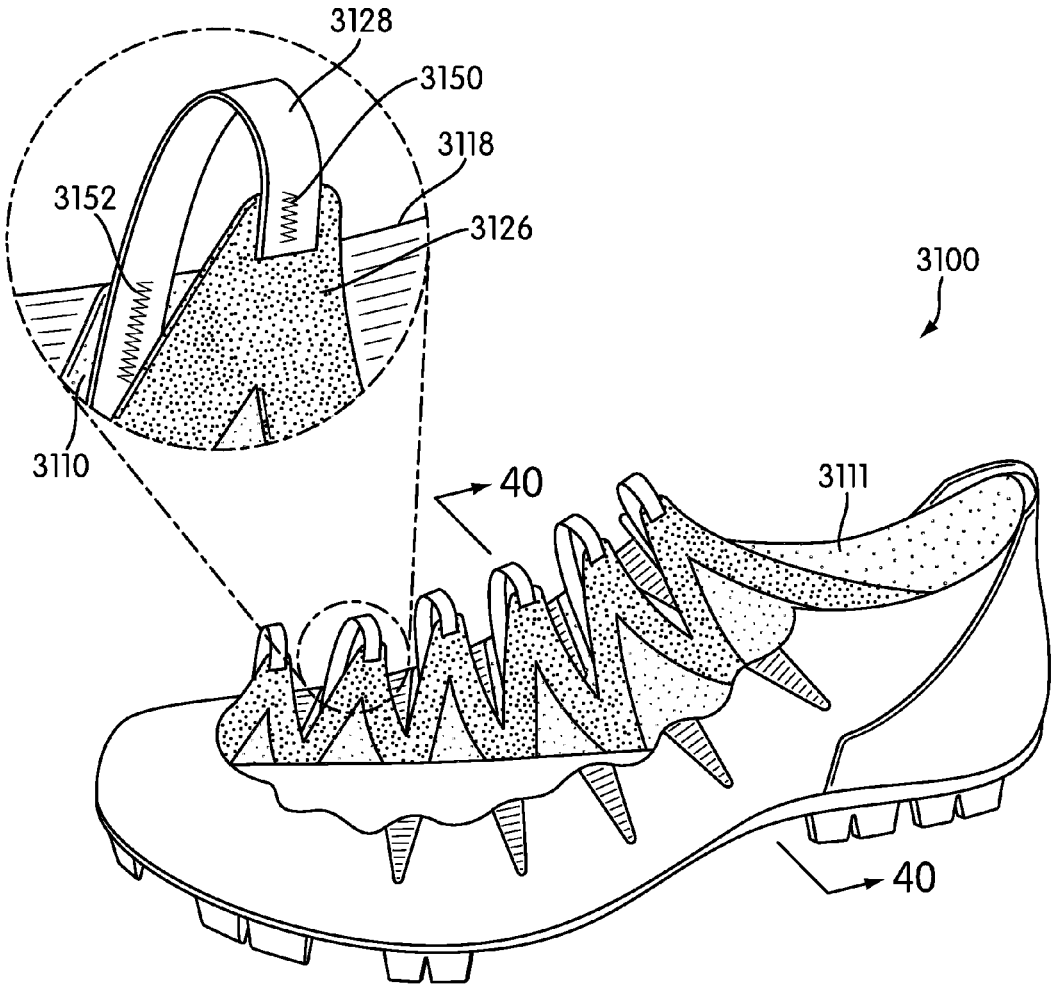
FIG. 39 is a cut away view of an interior of an alternate embodiment of an article of footwear showing a decoupled foot stabilizer system including support members attached to an upper.

Referring now to FIG. 39, a cut-away view of an assembled alternate exemplary embodiment of article 3100 including foot stabilizer system 3120 associated with upper 3110 is shown. In this embodiment, plurality of support members 3128 may be secured to portions of foot stabilizer system 3120 and upper 3110. As shown in the close-up view in FIG. 39, support member 3128 may extend out of interior 3111 of upper 3110. In some embodiments, support member 3128 may be attached to upper 3110 and/or portions of foot stabilizer system 3120.

In one embodiment, one or more support members 3128 may be attached to both upper 3110 and portions of foot stabilizer system 3120. In this embodiment, support member 3128 is attached to strap member 3126 of foot stabilizer system 3120 at a first attachment point 3150. Similarly, in this embodiment, support member 3128 may also be attached to upper 3110 at a second attachment point 3152. As shown in this embodiment, support member 3128 may form a loop spanning between first attachment point 3150 on strap member 3126 and second attachment point 3152 on upper 3110. In some cases, first attachment point 3150 and second attachment point 3152 may be a stitch or stitching. In other cases, other attachment mechanisms may be used to secure support member 3128 to portions of foot stabilizer system 3120 and/or upper 3110.

While the present embodiment illustrates first attachment point 3150 and second attachment point 3152 for attaching support member 3128 to, respectively, strap member 3126 and upper 3110, additional attachment points may be provided on foot stabilizer system 3120 and/or upper 3110 to provide a secure connection with support member 3128. Additionally, one or more support members 3128 may be attached to foot stabilizer system 3120 and/or upper 3110 in a similar manner on lateral side and medial side of article 3100. In other embodiments, one or more support members 3128 may be secured to other portions of upper 3110, including articulated regions 3118.

Figure 40:
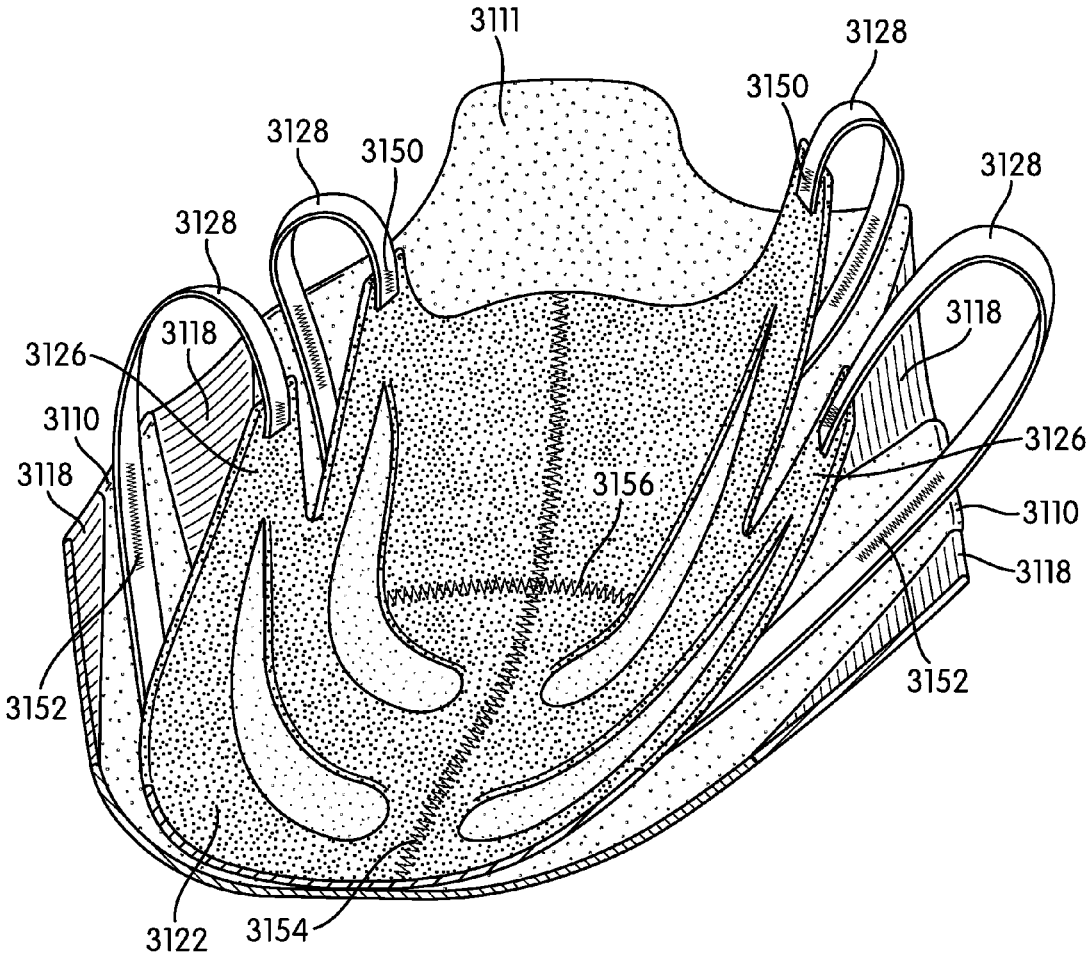
FIG. 40 is a cross-sectional view of an alternate embodiment of an article including a foot stabilizer system with support members.

FIG. 40 illustrates a cross-sectional view of foot stabilizer system 3120 and upper 3110 associated with each other by one or more support members 3128. In this embodiment, it should be understood that article 3100 may include a number of other components typically associated with an article of footwear, including sole structure 3130, that have not been included in this view for the purposes of illustration.

In this embodiment, strap system 3122 of foot stabilizer system 3120 is shown disposed within interior 3111 of upper 3110. A plurality of support members 3128 may be disposed beneath strap system 3122 between foot stabilizer system 3120 and interior 3111 of upper 3110. In this embodiment, plurality of support members 3128 may be attached to plurality of strap members 3126 of strap system 3122 at a number of first attachment points 3150. Similarly, plurality of support members 3128 also may be attached to upper 3110 at a number of second attachment points 3152. Additionally, in this embodiment, foot stabilizer system 3120 may be secured to a bottom surface of upper 3110 at a central attachment portion 3154 and at a heel attachment portion 3156. With this arrangement, lateral and medial portions of foot stabilizer system 3120 may be decoupled from upper 3110 at areas other than along central attachment portion 3154. In some embodiments, foot stabilizer system 3120 may additionally be attached to bottom surface of upper 3110 at a forefoot attachment portion (not shown). In different embodiments, foot stabilizer system 3120 may be attached to a portion of upper 3110 and/or a base portion using any attachment area to provide selective decoupling as discussed herein.

Figure 41:
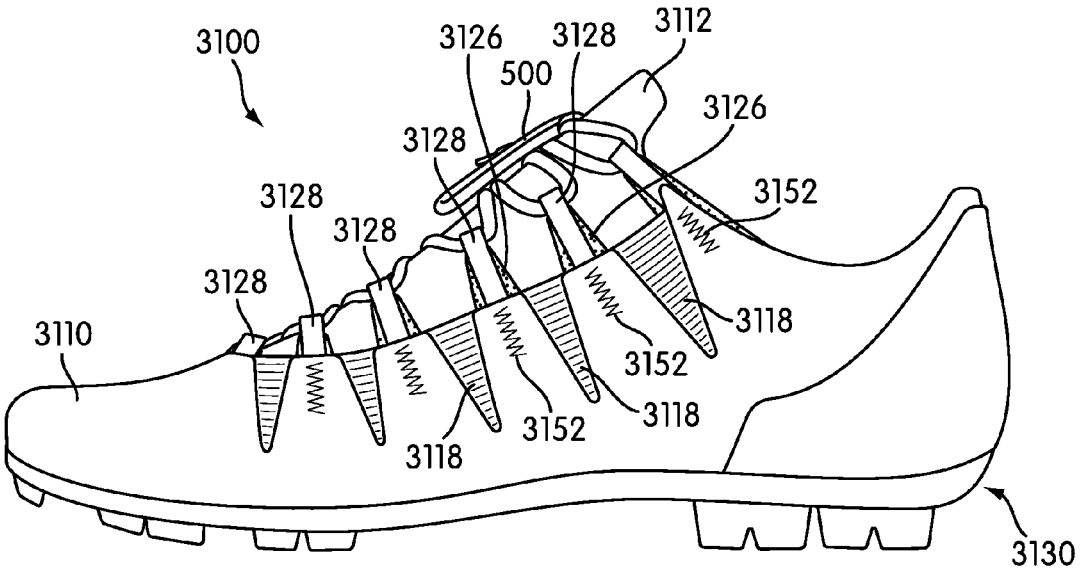
FIG. 41 is a side view of an alternate embodiment of an article of footwear including a decoupled foot stabilizer system with an articulated upper.
Figure 42:
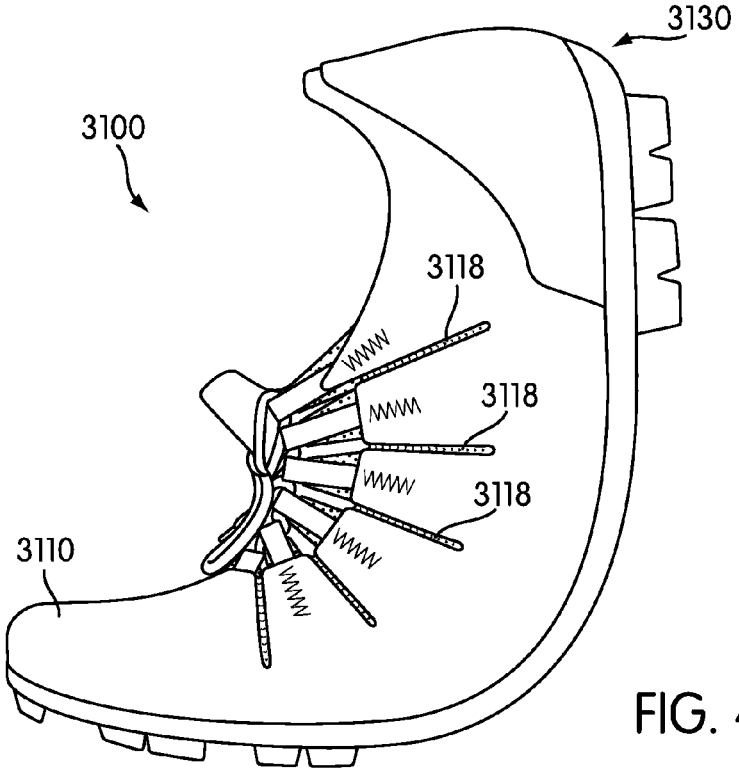
FIG. 42 is a side view of an alternate embodiment of an article of footwear including a decoupled foot stabilizer system showing bending of an articulated upper.

FIGS. 41 and 42 illustrate an assembled embodiment of article 3100 including upper 3110 with articulated regions 3118. In this embodiment, plurality of support members 3128 associate foot stabilizer system 3120 and upper 3110 with articulate regions 3118. In an exemplary embodiment, support members 3128 may be attached to strap members 3126 and to upper 3110 at second connection point 3152. In some embodiments, article 3100 may include tongue 3112. In some embodiments, tongue 3112 may be secured to one or more portions of upper 3110 and/or foot stabilizer system 3120. In an exemplary embodiment, article 3100 further includes a lace 500. In some embodiments, lace 500 may run through loops formed by the attachment of support members 3128 between upper 3110 and foot stabilizer system 3120. Additionally, in some embodiments, lace 500 run through loops formed by support members 3128 may assist in securing tongue 3112 to article 3100. In other embodiments, lace 500 may run through one or more lacing holes, as described above, disposed in portions of support members 3128, strap members 3126, and/or portions of upper 3110.

Referring now to FIG. 42, as described above, articulated regions 3118 disposed in upper 3110 may be configured to allow article 3100 to have a greater degree of flexibility or bending. In this embodiment, article 3100 is shown undergoing bending associated with articulated regions 3118 of upper 3110. As shown in FIG. 42, articulated regions 3118 arranged within cut-outs or slits of upper 3110 may allow upper 3110 to bend. With this arrangement, bending of article 3100 closes the gap in the cut-outs in upper 3110 corresponding to articulated regions 3118. As a result, the gap in upper 3110 becomes smaller and allows greater flexibility to article 3100. In some embodiments, articulated regions 3118 include elastic or stretchable materials, as described above, that are configured to provide bending of upper 3110 at articulated regions 3118. Additionally, in some embodiments, article 3100 may include other components that provide a greater degree of flexibility or bending, including, for example, an articulated sole associated with sole structure 3130.

Figure 43:
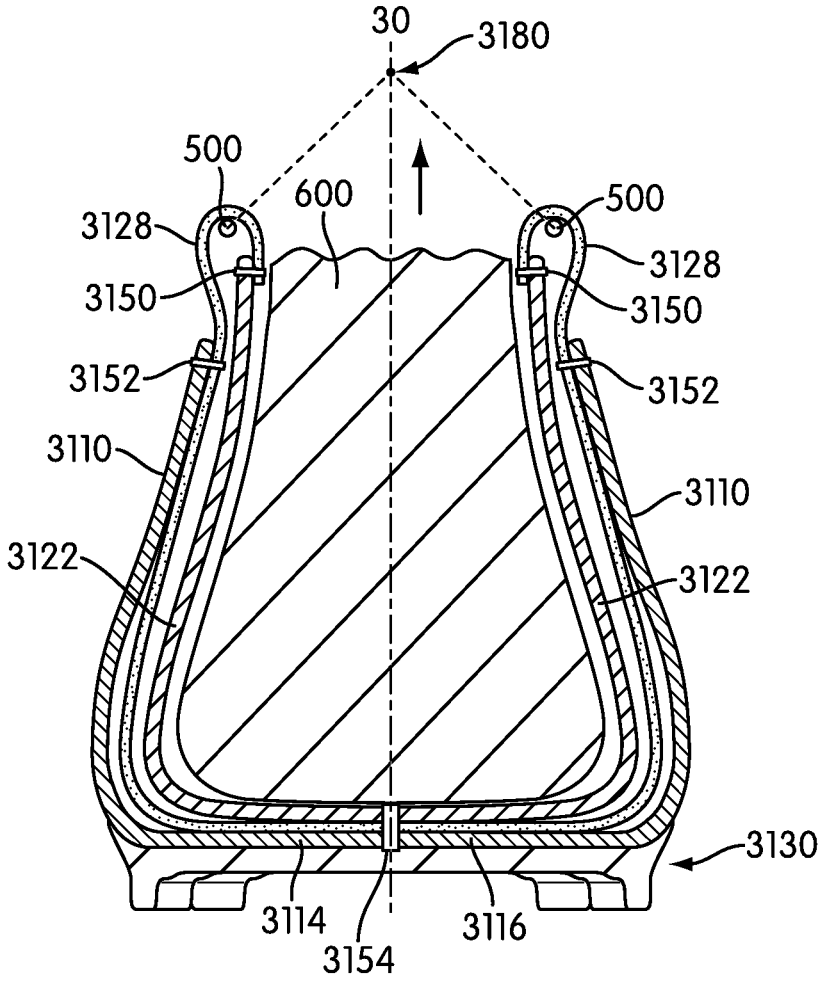
FIG. 43 is a cross-sectional view of an alternate embodiment of an article of footwear including a decoupled foot stabilizer system with an articulated upper.
Figure 44:
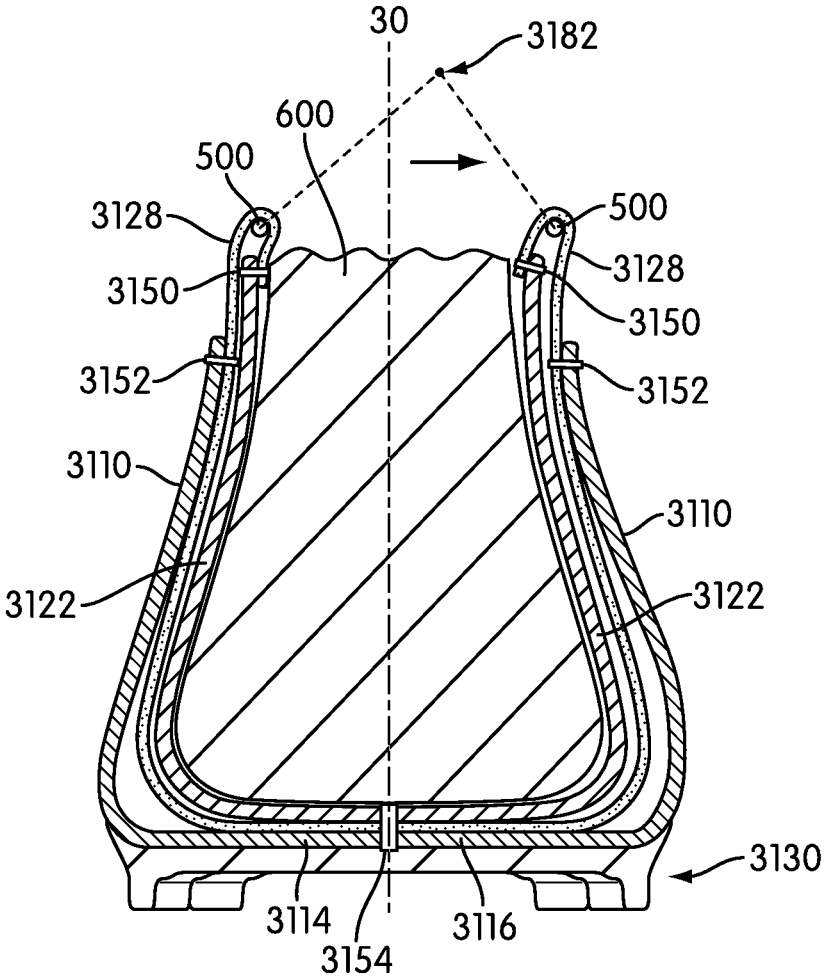
FIG. 44 is a cross-sectional view of an alternate embodiment of an article of footwear illustrating cinching of a foot stabilizer system of FIG. 43.

FIGS. 43 and 44 illustrate a cross-sectional view of article 3100 with foot stabilizer system 3120 and upper 3110 associated with each other by one or more support members 3128. In this embodiment, foot 600 is disposed within interior 3111 of upper 3110. As shown in the cross-sectional view, strap system 3122 of foot stabilizer system 3120 may be attached to a bottom surface of upper 3110 formed by first folding portion 3114 and second folding portion 3116 at central attachment portion 3154. Also shown in this view is first connection point 3150 attaching support member 3128 to strap member 3126 and second connection point 3152 attaching support member 3128 to upper 3110.

In some embodiments, lace 500 may be disposed through loops formed by support members 3128 attached between upper 3110 and foot stabilizer system 3120. In an exemplary embodiment, lace 500 disposed through loops formed by support members 3128 may be pulled to tighten or cinch foot stabilizer system 3120 to foot 600. As shown in FIG. 43, a wearer may pull up on lace 500 in a vertical direction along vertical axis 30 from a point 3180 above article 3100. With this arrangement, lace 500 may be used to provide a customized or improved fit to foot 600 of a wearer within article 3100. Additionally, by associating foot stabilizer system 3120 and upper 3110 with support members 3128, a load may be distributed more evenly between upper 3110 and strap members 3126.

Similarly, as shown in FIG. 44, a wearer may pull up on lace 500 in a direction to one side of vertical axis 30 from an offset point 3182. In this embodiment, lace 500 disposed through loops formed by support members 3128 may be pulled in a direction corresponding to offset point 3182 to tighten or cinch foot stabilizer system 3120 to foot 600. With this arrangement, a greater amount of support and/or stability may be provided to foot 600 within article 3100 by foot stabilizer system 3120 conforming to the shapes and/or contours of foot 600. In other embodiments, lace 500 may be pulled in other directions to tighten or cinch foot stabilizer system 3120 to foot 600.

In different embodiments, an attachment area that attaches a foot stabilizer system to a base portion and/or a portion of an upper may be arranged with various configurations to provide a greater or smaller degree of decoupling to the foot stabilizer system relative to an article of footwear. FIGS. 45 through 48 illustrate various alternate exemplary embodiments of attachment configurations including different types and/or arrangements of attachment areas used to provide a decoupled foot stabilizer system relative to one or more portions of an article.

Figure 45:
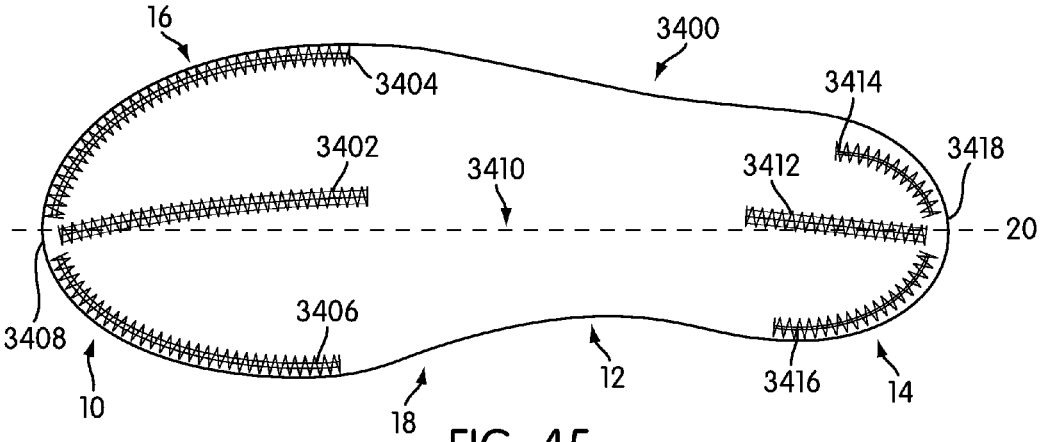
FIG. 45 is a schematic view of various attachment mechanisms for attaching a decoupled foot stabilizer system to a base portion.

Referring now to FIG. 45, in this embodiment, an attachment area 3400 using one or more central attachment portions may secure a foot stabilizer system to a base portion and/or a portion of an upper. In some embodiments, a foot stabilizer system may be attached to a base portion at a central attachment portion that extends substantially along longitudinal axis 20. In one embodiment, a central attachment portion may be substantially similar to central attachment portion 131, as discussed above. In other embodiments, the central attachment portion may extend essentially from heel region 14 to forefoot region 10. In an exemplary embodiment, the central attachment portion may include a forefoot central attachment portion 3402. Forefoot central attachment portion 3402 may extend a distance from a location adjacent to front edge 3408 in forefoot region 10 towards midfoot region 12. Similarly, the central attachment portion may include a heel central attachment portion 3412. Heel central attachment portion 3412 may extend a distance from a location adjacent to rear edge 3418 in heel region 14 towards midfoot region 12. In some cases, forefoot central attachment portion 3402 and/or heel central attachment portion 3412 may extend through a portion of midfoot region. In other cases, the central attachment portion may be completely decoupled at a center portion 3410 of the midfoot region 12.

In some embodiments, attachment area 3400 may attach a foot stabilizer system to a base portion at one or more portions of near a periphery of the base portion in forefoot region 10. In an exemplary embodiment, attachment area 3400 may include a forefoot attachment portion. In one embodiment, a lateral forefoot attachment portion 3404 may extend along a portion of forefoot region 10 of the base portion associated with lateral side 16. Similarly, a medial forefoot attachment portion 3406 may extend along a portion of forefoot region 10 of the base portion associated with medial side 18. In some cases, lateral forefoot attachment portion 3404 and medial forefoot attachment portion 3406 may extend from one side to join with the other around front edge 3408 of the base portion near the periphery of forefoot region 10. In other cases, the forefoot attachment portion may include only one of lateral forefoot attachment portion 3404 and medial forefoot attachment portion 3406, associated, respectively, with lateral side 16 and medial side 18.

In some embodiments, attachment area 3400 may attach a foot stabilizer system to a base portion at one or more portions of near a periphery of the base portion in heel region 14. In an exemplary embodiment, attachment area 3400 may include a heel attachment portion. In one embodiment, a lateral heel attachment portion 3414 may extend along a portion of heel region 14 of the base portion associated with lateral side 16. Similarly, a medial heel attachment portion 3416 may extend along a portion of heel region 14 of the base portion associated with medial side 18. In some cases, lateral heel attachment portion 3414 and medial heel attachment portion 3416 may extend from one side to join with the other around rear edge 3418 of the base portion near the periphery of heel region 14. In other cases, the heel attachment portion may include only one of lateral heel attachment portion 3414 and medial heel attachment portion 3416, associated, respectively, with lateral side 16 and medial side 18.

Using various attachment portions associated with attachment area 3400, one or more of forefoot central attachment portion 3402, lateral forefoot attachment portion 3404, medial forefoot attachment portion 3406, heel central attachment portion 3412, lateral heel attachment portion 3414, and/or medial heel attachment portion 3416, as well as an optional central attachment portion corresponding to center portion 3410, may allow the foot stabilizer system to conform to the shape of and/or provide freedom of motion to the wearer's foot along lateral side 16 and/or medial side 18.

Figure 46:
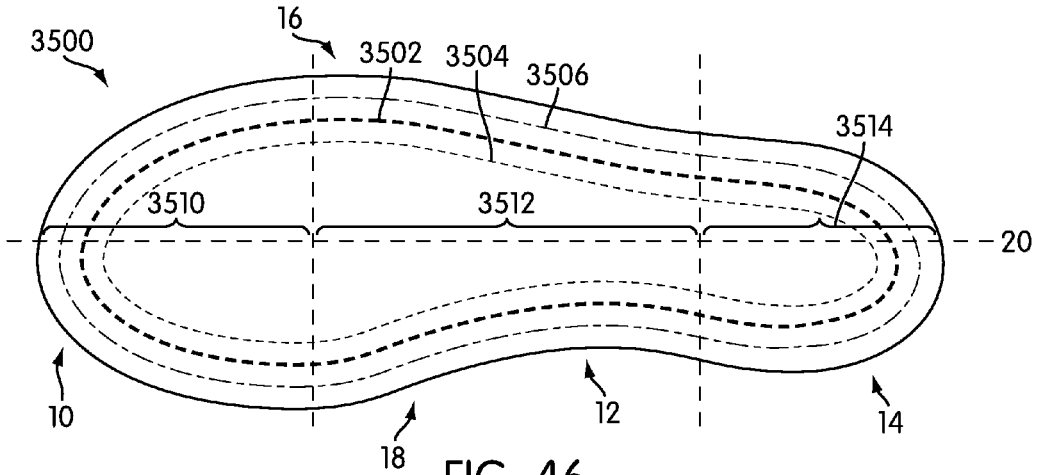
FIG. 46 is a schematic view of various attachment mechanisms for attaching a decoupled foot stabilizer system to a base portion.

Referring now to FIG. 46, an attachment area 3500 for securing a foot stabilizer system to a base portion and/or a portion of an upper may be associated with an hourglass shape. In some embodiments, hourglass shaped attachment area 3500 may be defined by various hourglass attachment portions. In some embodiments, a first hourglass attachment portion 3502 may extend around a perimeter of a base portion. In this embodiment, first hourglass attachment portion 3502 may selectively decouple portions of a foot stabilizer system from a base portion of an article. In one embodiment, first hourglass attachment portion 3502 may extend around the perimeter at a distance away from the outer periphery of the base portion of the article. In an exemplary embodiment, first hourglass attachment portion 3502 may be substantially similar to hourglass attachment portion 2800, as described above.

In some embodiments, hourglass shaped attachment area 3500 may include an hourglass attachment portion that may be disposed at a distance that is closer or farther from the outer periphery of the base portion of the article than first hourglass attachment portion 3502. In one embodiment, a second hourglass attachment portion 3504 may extend around a perimeter of the base portion of article at a distance that is farther from the outer periphery than first hourglass attachment portion 3502. In this embodiment, second hourglass attachment portion 3504 may define a narrower width for attachment area 3500. With this arrangement, second hourglass attachment portion 3504 may be configured to increase the degree of decoupling provided between a foot stabilizer system and an article.

In another embodiment, a third hourglass attachment portion 3506 may extend around a perimeter of the base portion of article at a distance that is closer to the outer periphery than first hourglass attachment portion 3502. In this embodiment, third hourglass attachment portion 3506 may define a wider width for attachment area 3500. With this arrangement, third hourglass attachment portion 3506 may be configured to decrease the degree of decoupling provided between a foot stabilizer system and an article.

In some embodiments, hourglass shaped attachment area 3500 may be configured to vary between any one or more regions of an article, including forefoot region 10, midfoot region 12, and/or heel region 14. In one embodiment, a combination of first hourglass attachment portion 3502, second hourglass attachment portion 3504, and/or third hourglass attachment portion 3506 may be used in any one or more of forefoot region 10, midfoot region 12, and/or heel region 14.

For example, in an exemplary embodiment, a forefoot hourglass attachment area 3510 may be associated with third hourglass attachment portion 3506 in forefoot region 10, while a midfoot hourglass attachment area 3512 may be associated with a different hourglass attachment portion, including first hourglass attachment portion 3502 or second hourglass attachment portion 3504. Similarly, a heel hourglass attachment area 3514 may be associated with any one of first hourglass attachment portion 3502, second hourglass attachment portion 3504, and/or third hourglass attachment portion 3506, which may be different from the hourglass attachment portion associated with forefoot hourglass attachment area 3510 and/or midfoot hourglass attachment area 3512. With this arrangement, the degree of decoupling of the foot stabilizer system from the article may be customized across one or more regions of the article.

Additionally, in some embodiments, hourglass shaped attachment area 3500 may be configured to vary between lateral side 16 and medial side 18 of an article. In an exemplary embodiment, a combination of first hourglass attachment portion 3502, second hourglass attachment portion 3504, and/or third hourglass attachment portion 3506 may be used in any one or more of forefoot region 10, midfoot region 12, and/or heel region 14 on lateral side 16 and/or medial side 18 of an article. With this arrangement, a foot stabilizer system may be selectively decoupled from an article in greater or smaller degree across various regions and/or sides of the article. In various embodiments, using different variations of hourglass shaped attachment area 3500, a foot stabilizer system may be configured for various sports and activities with different amounts of support and/or stability.

Figure 47:
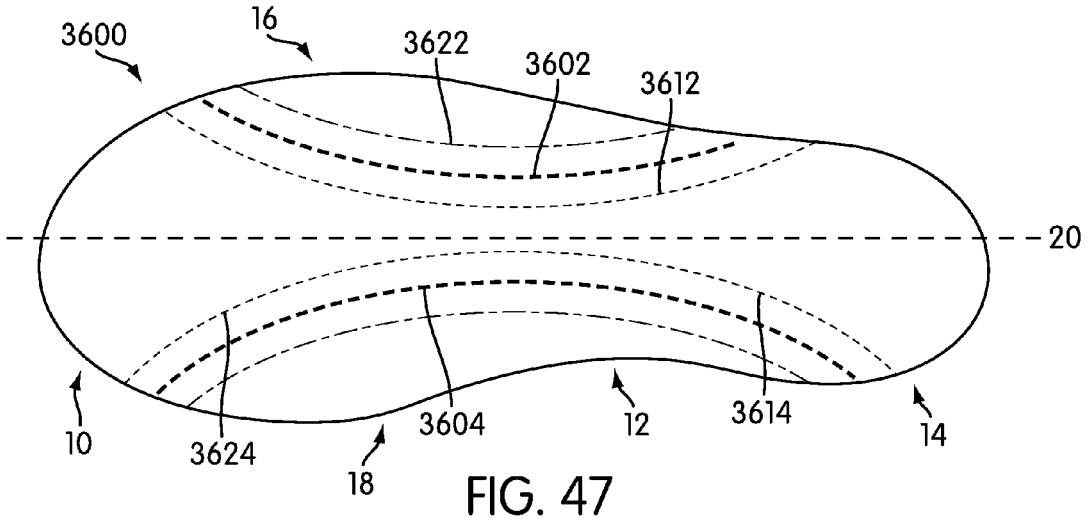
FIG. 47 is a schematic view of various attachment mechanisms for attaching a decoupled foot stabilizer system to a base portion.

Referring now to FIG. 47, an attachment area 3600 for securing a foot stabilizer system to a base portion and/or a portion of an upper may be associated with a horseshoe shape. In some embodiments, horseshoe shaped attachment area 3600 may be defined by various horseshoe attachment portions. In some embodiments, horseshoe shaped attachment area 3600 may be defined by a first horseshoe attachment portion 3602 on lateral side 16 and a second horseshoe attachment portion 3604 on medial side 18. In this embodiment, first horseshoe attachment portion 3602 and second horseshoe attachment portion 3604 may selectively decouple portions of a foot stabilizer system from a base portion and/or a portion of an upper.

In one embodiment, each of first horseshoe attachment portion 3602 and/or second horseshoe attachment portion 3604 may start and terminate adjacent to an outer periphery of the base portion at forefoot region 10 and heel region 14, respectively. As first horseshoe attachment portion 3602 and/or second horseshoe attachment portion 3604 extend through midfoot region 12, each of first horseshoe attachment portion 3602 and/or second horseshoe attachment portion 3604 is located closer to the center of the base portion. With this arrangement, a foot stabilizer system may be selectively decoupled from an article at midfoot region 12. In an exemplary embodiment, first horseshoe attachment portion 3602 and second horseshoe attachment portion 3604 may be substantially similar, respectively, to first horseshoe attachment portion 1900 and second horseshoe attachment portion 1902, as described above.

In some embodiments, horseshoe shaped attachment area 3600 may include one or more horseshoe attachment portions on lateral side 16 and/or medial side 18 that may be disposed at a distance that is closer or farther from the outer periphery of the base portion of the article than first horseshoe attachment portion 3602 and/or second horseshoe attachment portion 3604. In one embodiment, a third horseshoe attachment portion 3612 may extend through midfoot region 12 of the base portion at a distance that is farther from the outer periphery than first horseshoe attachment portion 3602. Similarly, a fourth horseshoe attachment portion 3614 may extend through midfoot region 12 of the base portion at a distance that is farther from the outer periphery than second horseshoe attachment portion 3604. In this embodiment, third horseshoe attachment portion 3612 and fourth horseshoe attachment portion 3614 may define a narrower width for attachment area 3600. With this arrangement, third horseshoe attachment portion 3612 and/or fourth horseshoe attachment portion 3614 may be configured to increase the degree of decoupling provided between a foot stabilizer system and an article.

In another embodiment, a fifth horseshoe attachment portion 3622 may extend through midfoot region 12 of the base portion at a distance that is closer to the outer periphery than first horseshoe attachment portion 3602. Similarly, a sixth horseshoe attachment portion 3624 may extend through midfoot region 12 of the base portion at a distance that is closer to the outer periphery than second horseshoe attachment portion 3604. In this embodiment, fifth horseshoe attachment portion 3622 and sixth horseshoe attachment portion 3624 may define a wider width for attachment area 3600. With this arrangement, fifth horseshoe attachment portion 3622 and/or sixth horseshoe attachment portion 3624 may be configured to decrease the degree of decoupling provided between a foot stabilizer system and an article.

In some embodiments, horseshoe shaped attachment area 3600 may be configured to vary between lateral side 16 and medial side 18 of an article. In an exemplary embodiment, a combination any one or more of first horseshoe attachment portion 3602, second horseshoe attachment portion 3604, third horseshoe attachment portion 3612, fourth horseshoe attachment portion 3614, fifth horseshoe attachment portion 3622, and/or sixth horseshoe attachment portion 3624 may be used in any one or more of forefoot region 10, midfoot region 12, and/or heel region 14 on lateral side 16 and/or medial side 18 of an article. With this arrangement, a foot stabilizer system may be selectively decoupled from an article in greater or smaller degree across various regions and/or sides of the article. In various embodiments, using different variations of horseshoe shaped attachment area 3600, a foot stabilizer system may be configured for various sports and activities with different amounts of support and/or stability.

In different embodiments, the arrangement of various attachment areas, including any one or more of attachment area 3400, hourglass shaped attachment area 3500, and/or horseshoe shaped attachment area 3600, as described in the previous embodiments, on lateral side 16 and/or medial side 18 in forefoot region 10, midfoot region 12, and/or heel region 14, as well as the intentional decoupling of portions of a foot stabilizer system from a base portion and/or a portion of an upper, may be designed for particular performance parameters associated with different athletic movements. For example, midfoot region 12 of the foot stabilizer may be decoupled from the base portion in articles of footwear used in sports with frequent lateral movements. In other cases, a pair of footwear may have different arrangements of attachment areas for the foot stabilizer system on each of the left and right articles of footwear.

Figure 48:
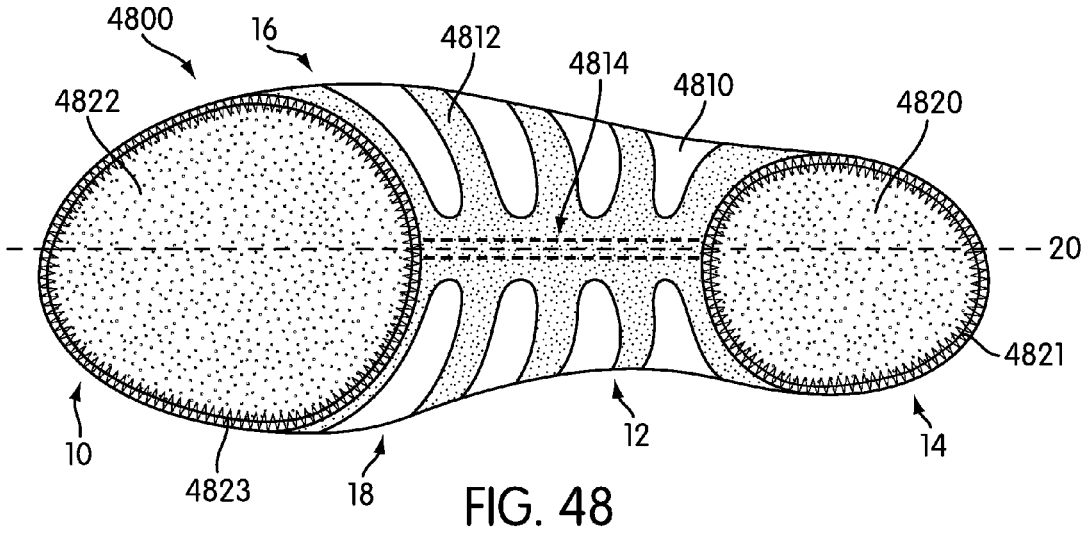
FIG. 48 is a schematic view of an alternate embodiment of a base portion for attaching a foot stabilizer system.

In some embodiments, attachment areas may be provided for securing a foot stabilizer system to a combination of different types of base portions. Referring now to FIG. 48, in this embodiment, pod attachment area 4800 may include attachment portions associated with one or more base portions, as described in the various embodiments above. In this embodiment, one base portion including a bottom surface

4810 formed by folded over portions of an upper may be provided substantially in midfoot region 12. Additionally, one or more base portions, including a heel base portion 4820 and/or a forefoot base portion 4822 may be provided, respectively, at heel region 14 and forefoot region 10.

In some embodiments, pod attachment area 4800 may include a first center attachment portion 4814 attaching a foot stabilizer system 4812 to bottom surface 4810 substantially along longitudinal axis 20 at midfoot region 12. In an exemplary embodiment, pod attachment area 4800 may include a heel pod attachment portion 4821 attaching foot stabilizer system 4812 to heel base portion 4820 at heel region 14. Similarly, pod attachment area 4800 may include a forefoot pod attachment portion 4823 attaching foot stabilizer system 4812 to forefoot base portion 4822 at forefoot region 10. In an exemplary embodiment, first center attachment portion 4814, heel pod attachment portion 4821, and/or forefoot pod attachment portion 4823 may be attached using any type of stitching, as described above, or other attachment mechanisms described herein.

In this embodiment, heel base portion 4820 and/or forefoot base portion 4822 may be a strobel, as discussed above. Bottom surface 4810 may be a portion of an upper that has been folded under, as discussed above. With this arrangement, foot stabilizer system 4812 may be attached to heel base portion 4820 and/or forefoot base portion 4822 in regions of an article where no decoupling is to be provided, but may be attached to bottom surface 4810 in a specific region or portion of a region in a manner so as to provide selective decoupling in the desired region of the article. In different embodiments, any of the attachment areas described herein may include one or more combinations of base portions and/or portions of an upper arranged in a pod arrangement corresponding to different regions of article, as shown in FIG. 48.

In different embodiments, pod attachment area 4800 may be attached to a sole structure using any attachment mechanism described herein. In one embodiment, heel base portion 4820 and/or forefoot base portion 4822 may be attached to a sole structure by using adhesive along substantially all of heel base portion 4820 and/or forefoot base portion 4822 to attach the foot stabilizer system to heel region 14 and/or forefoot region 10 of the article. In one embodiment, bottom surface 4810 may be attached to a sole structure by using adhesive along a narrow center portion or strip along longitudinal axis 20 to selectively decouple the foot stabilizer system at midfoot region 12 of the article. In various embodiments, one or more portions of pod attachment area 4800 may be attached to a sole structure along forefoot region 10, midfoot region 12, heel region 14, as well as lateral side and medial side to selectively decouple different portions of a foot stabilizer system from an article as described herein.

In different embodiments, one or more strap members of a foot stabilizer system may be arranged with various configurations for being associated with a component for fastening an article of footwear. In some embodiments, one or more distal ends of strap members may be configured to receive a lace. FIGS. 49 through 52 illustrate various alternate exemplary embodiments of different types and/or arrangements of distal ends of strap members that may be configured to receive a lace or similar fastening component.

Figure 49:
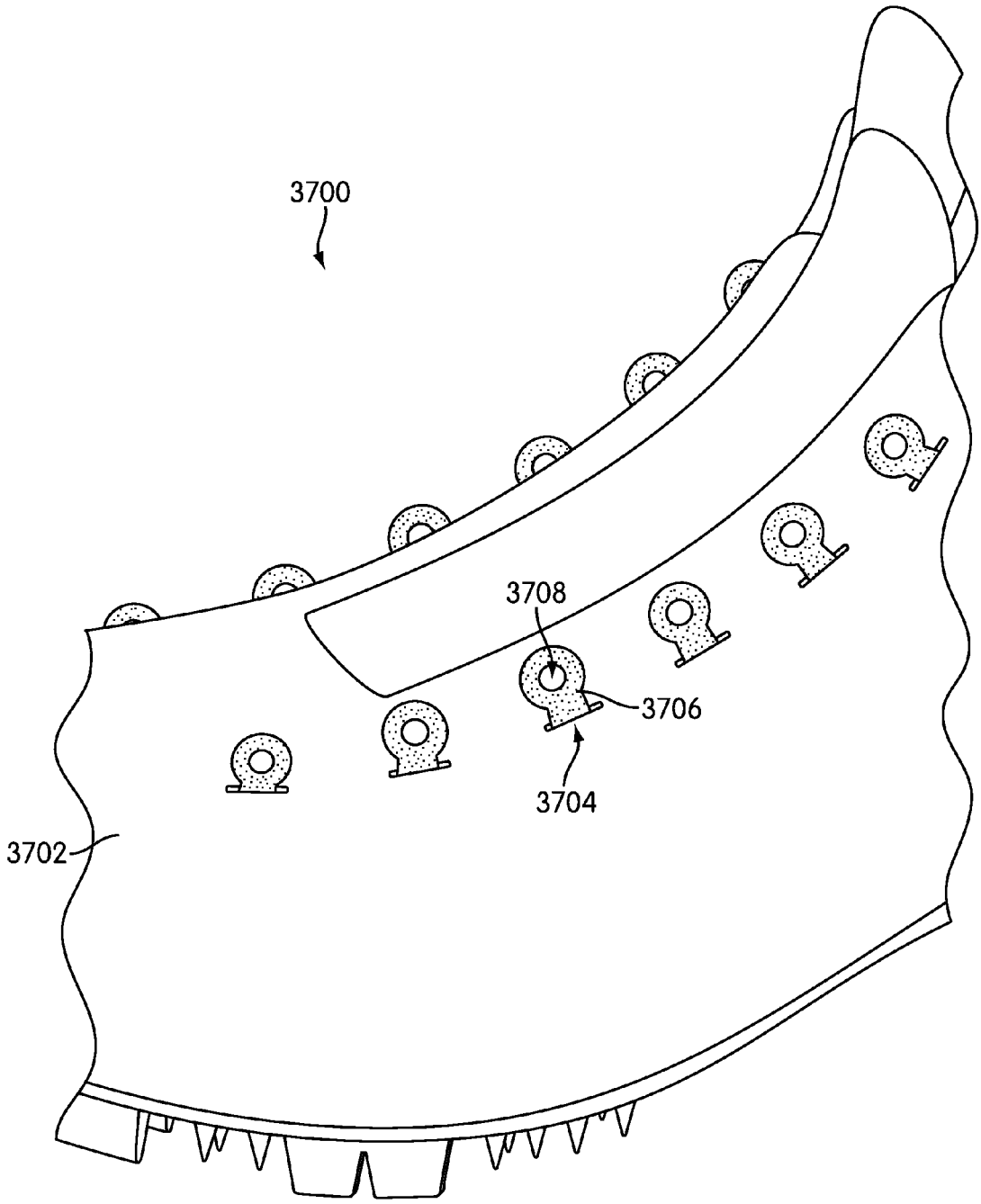
FIG. 49 is a close-up isometric view of an exemplary embodiment of strap members disposed through an upper.

Referring now to FIG. 49, in this embodiment, an upper 3702 includes a plurality of openings, which may be represented by a first opening 3704. First opening 3704 may include any opening in an upper, including openings discussed above, including plurality of openings 116. In some embodiments, a first fastening arrangement 3700 may be provided at the distal ends of strap members of a foot stabilizer system. In this embodiment, first fastening arrangement 3700 may include a plurality of strap members, which may be represented by first strap member 3706. Each of the plurality of strap members may have a lacing hole, which may be represented by first lacing hole 3708 disposed at the distal end of first strap member 3706. In some embodiments, first lacing hole 3708 may be an eyelet. In some cases, first lacing hole 3708 may be die-cut or stamped in the strap member. In other cases, first lacing hole 3708 may include a grommet. In this embodiment, first lacing hole 3708 associated with first strap member 3706 may extend out through first opening 3704 in upper 3702 from the interior of the article.

Figure 50:
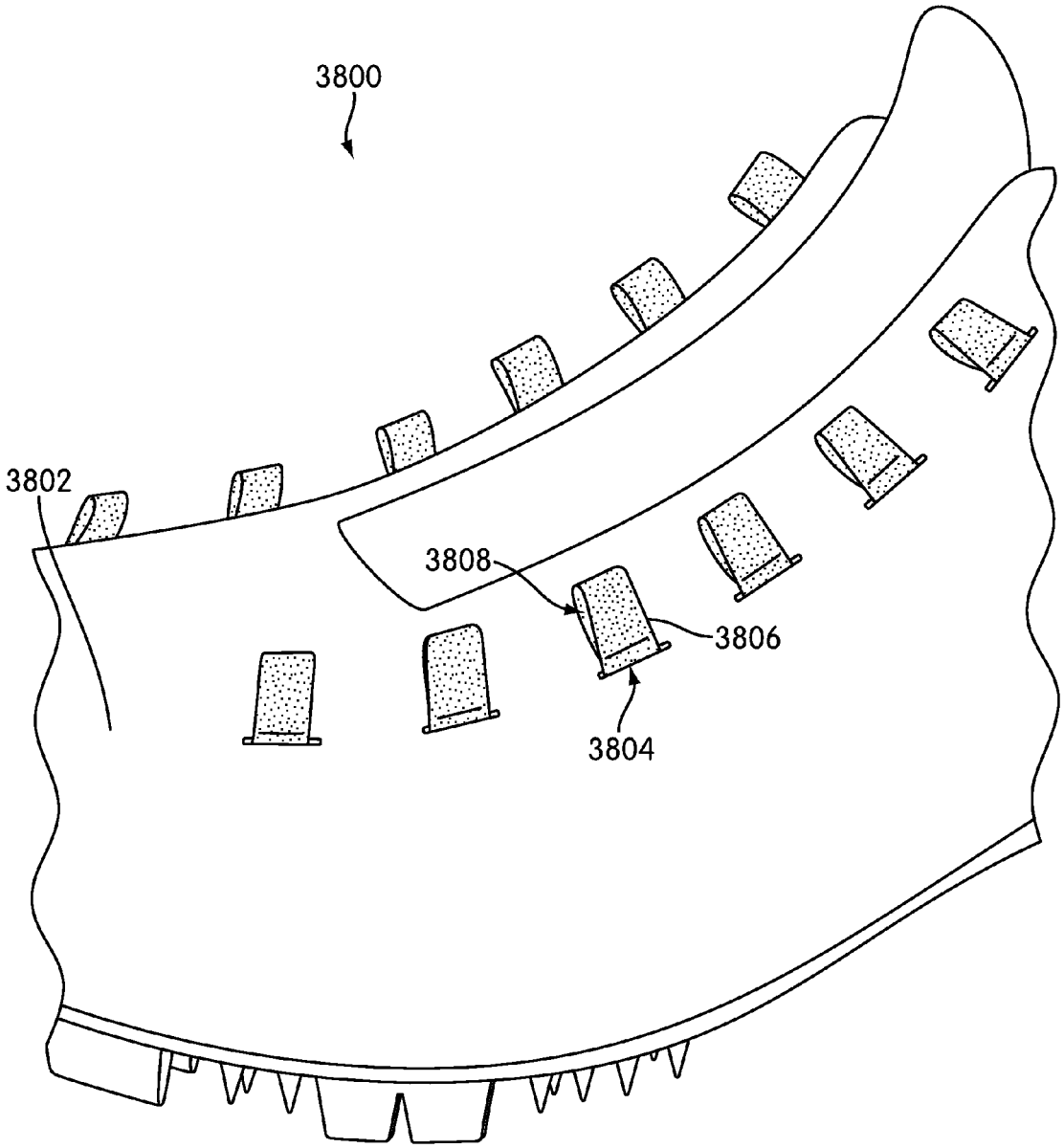
FIG. 50 is a close-up isometric view of an alternate embodiment of strap members disposed through an upper.

Referring now to FIG. 50, in this embodiment, an upper 3802 includes a plurality of openings, which may be represented by a first opening 3804. First opening 3804 may include any opening in an upper, including openings discussed above, including plurality of openings 116. In some embodiments, a second fastening arrangement 3800 may be provided at the distal ends of strap members of a foot stabilizer system. In this embodiment, second fastening arrangement 3800 may include a plurality of strap members, which may be represented by first strap member 3806. Each of the plurality of strap members may have a lacing hole, which may be represented by first lacing hole 3808 disposed at the distal end of first strap member 3806. In this exemplary embodiment, lacing hole 3808 may be a tab formed by attaching a folded over end of first strap member 3806 to itself.

Figure 51:
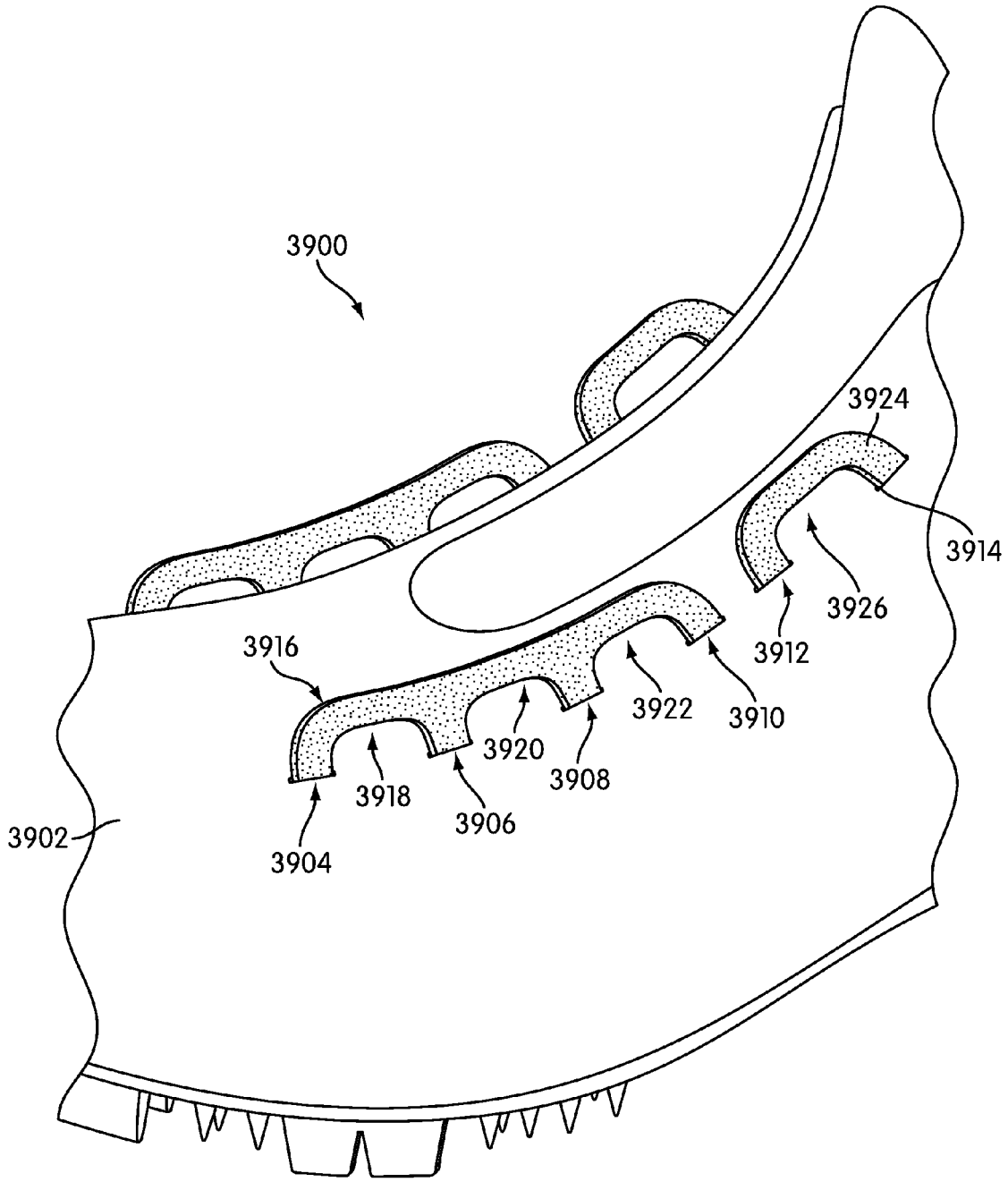
FIG. 51 is a close-up isometric view of an exemplary embodiment of joined strap members disposed through an upper.
Figure 52:
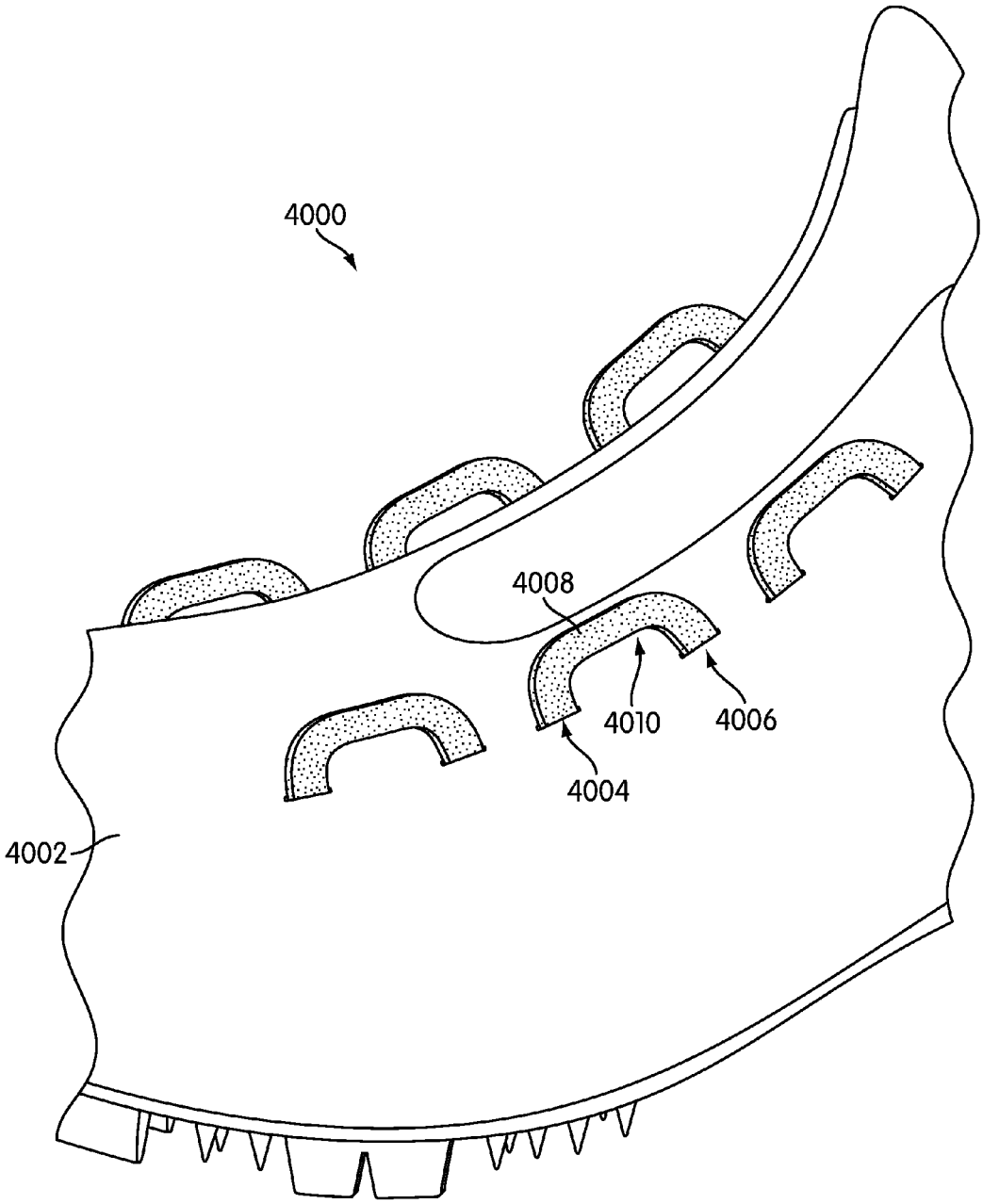
FIG. 52 is a close-up isometric view of an alternate embodiment of joined strap members disposed through an upper.

FIGS. 51 and 52 illustrate alternate exemplary embodiments of distal ends of a plurality of strap members where one or more strap members may be coupled together to form a joined member. Referring now to FIG. 51, in this embodiment, a third fastening arrangement 3900 may include one or more groups of joined strap members. In one embodiment, third fastening arrangement 3900 may include a first joined member 3916 formed by the joined distal ends of a plurality of strap members extending out through a plurality of openings in upper 3902. In this embodiment, upper 3902 includes a first opening 3904, a second opening 3906, a third opening 3908, and a fourth opening 3910 for allowing the individual strap members forming first joined member 3916 to pass through the outer surface of the article. In some embodiments, third fastening arrangement 3900 may include a second joined member 3924. In this embodiment, second joined member 3924 may be formed by the distal ends of strap members extending out through a fifth opening 3912 and a sixth opening 3914 in upper 3902. Similarly, a plurality of corresponding strap members may form additional joined members on the opposing side of the article.

In some cases, first joined member 3916 may be associated with a first number of strap members and second joined member 3924 may be associated with a second number of strap members. In this embodiment, first joined member 3916 may be formed by coupling four individual strap members and second joined member 3924 may be formed by coupling two individual strap members. In different embodiments, each of first joined member 3916 and second joined member 3924 may be associated with various numbers of individual strap members coupled together to form a joined strap member.

In some embodiments, one or more joined members may receive a lace in the hollows between each of the plurality of individual strap members that extend out from openings in upper 3900. In this embodiment, first joined member 3916 may include a first hollow 3918, a second hollow 3920, and a third hollow 3922 disposed between the strap members forming first joined member 3916. Similarly, second joined member 3924 may include a fourth hollow 3926 disposed between the strap members forming second joined member 3924. In an exemplary embodiment, a lace may be run through one or more of first hollow 3918, second hollow 3920, third hollow 3922, and/or fourth hollow 3926, as well as corresponding hollows on the opposing side of the article. With this arrangement, a lace may fasten an article around a foot of a wearer. In other embodiments, the joined members and/or each of the strap members may include one or more lacing holes for receiving a lace. In different embodiments, the joined members and/or each of the strap members may include lacing holes as discussed in various embodiments above.

Referring now to FIG. 52, in this embodiment, a fourth fastening arrangement 4000 may include one or more groups of joined pairs of strap members. In this embodiment, the distal ends of a pair of strap members extend out through openings in upper 4002 to form a first joined member 4008. In this embodiment, upper 402 includes a first opening 4004 and a second opening 4006 for allowing the individual strap members forming first joined member 4008 to pass through the outer surface of the article. Similarly, distal ends of additional pairs of strap members may extend out through corresponding openings in upper 4002 to form additional joined strap members. In this embodiment, first joined strap member 4008 may include a hollow 4010 for receiving a lace, as described above. In other embodiments, first joined member and/or each of the individual strap members may include one or more lacing holes for receiving a lace, as discussed in various embodiments above.

In some embodiments, one or more joined members may be associated with strap members located in different regions of the article of footwear, including, but not limited to a forefoot region, a midfoot region, and/or a heel region. In some embodiments, one or more joined members on the lateral and medial side of the article may correspond to the same regions of the article. In other embodiments, one or more joined members on the lateral and medial side of the article may correspond to different regions of the article.

Referring to FIGS. 51 and 52, in some embodiments, joined members may be formed by coupling a plurality of strap members together. In some cases, the plurality of strap members may be attached to each other to form a joined member. In other cases, the plurality of strap members may be integrally formed together to form a joined member. In one exemplary embodiment, the plurality of strap members may be attached by stitching to form a joined member. In another exemplary embodiment, the plurality of strap members may include additional material used to join together the individual strap members to form a joined strap member.

Figure 53:
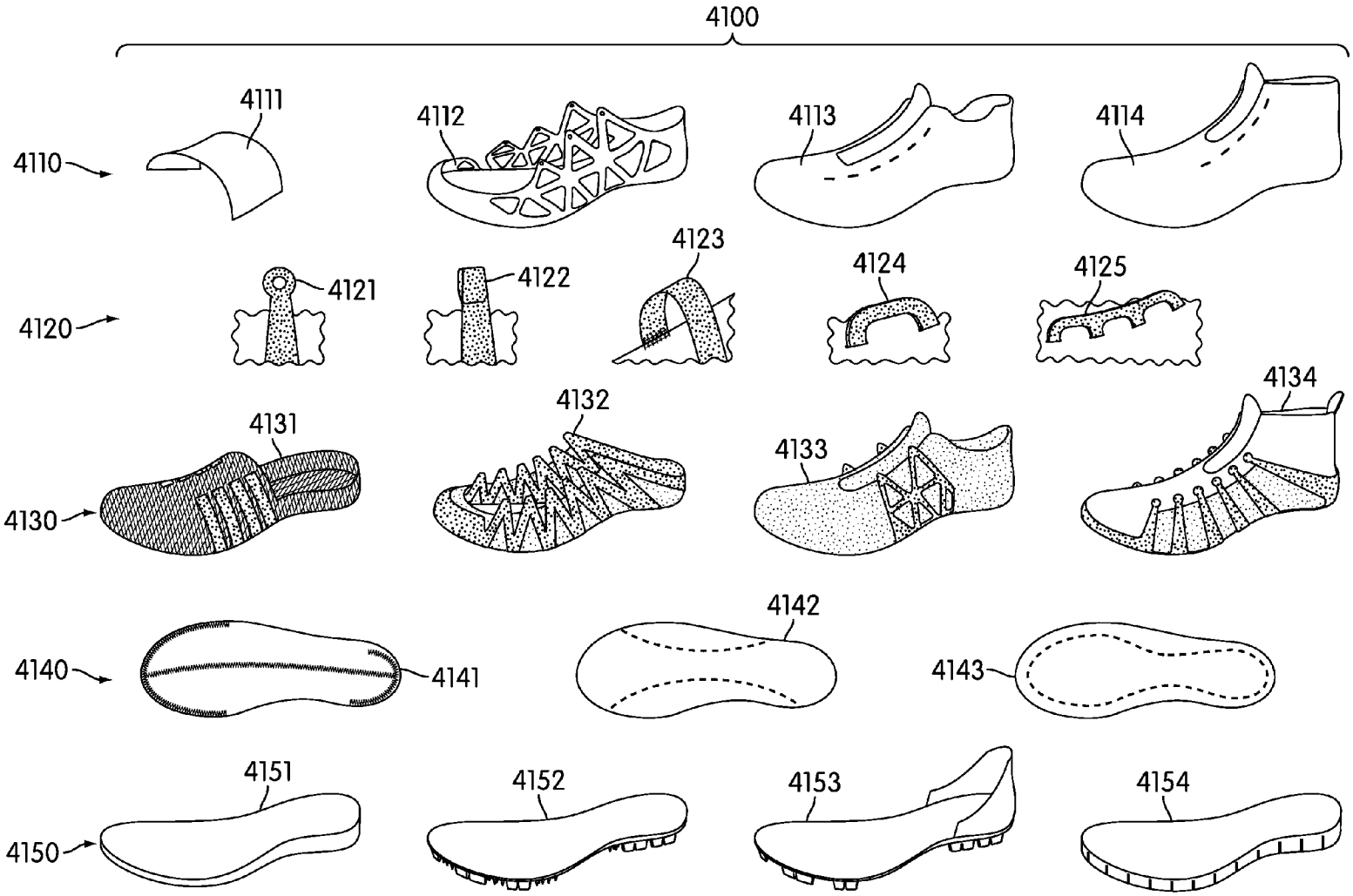
FIG. 53 is a schematic view of various components for assembling an article of footwear with a decoupled foot stabilizer system.

While various embodiments of the invention have been described, it should be understood that any of the features of the various embodiments may be used in combination with any of the other embodiments to assemble different articles of footwear with a decoupled foot stabilizer system. FIG. 53 illustrates a schematic view of various components 4100 for assembling an article of footwear with a decoupled foot stabilizer system. In this embodiment, a number of options may be available for each of the various components 4100. In an exemplary embodiment, one or more types of uppers 4110 may be provided. In this embodiment, types of uppers 4110 may include a sandal upper 4111, a skeletonized upper 4112, a low-top upper 4113, and/or a high-top upper 4114. Types of uppers 4110 may include one or more embodiments of uppers described herein, including, but not limited to: upper 110, upper 1110, upper 1710, and/or upper 2610, as well as any other type of conventional upper used for an article of footwear.

In an exemplary embodiment, various components 4100 may include one or more types of lacing arrangements 4120 for a foot stabilizer system. In this embodiment, types of lacing arrangements 4120 may include an eyelet 4121, a tab 4122, a loop 4123, a hollow 4124, and/or multiple hollows 4125. Types of lacing arrangements 4120 may include one or more embodiments of lacing arrangements described herein, including, but not limited to: distal end 3010 described in FIG. 32, first lacing arrangement 3700, second lacing arrangement 3800, third lacing arrangement 3900, and/or fourth lacing arrangement 4000, as well as any other type of conventional lacing arrangement used for an article of footwear.

In an exemplary embodiment, various components 4100 also may include one or more types of foot stabilizer systems 4130. In this embodiment, types of foot stabilizer systems 4130 may include a partial bootie with a midfoot strap system 4131, a triangular shaped strap system without a bootie 4132, a low-top sock liner with a midfoot triangular shaped strap system 4133, and/or an ankle-length bootie with strap system 4134. Types of foot stabilizer systems 4130 may include one or more embodiments of foot stabilizer systems described herein, including, but not limited to: foot stabilizer system 120, foot stabilizer system 1120, foot stabilizer system 1720, foot stabilizer system 2620, as well as any combination of individual booties and/or strap systems described in any of the various embodiments.

In an exemplary embodiment, various components 4100 may include one or more types of attachment areas 4140 for securing a foot stabilizer system to a base portion and/or a portion of an upper to selectively decouple the foot stabilizer system from an article. In this embodiment, types of attachment areas 4140 may include a central attachment area 4141, a horseshoe shaped attachment area 4142, and/or an hourglass shaped attachment area 4143. Types of attachment areas 4140 may include one or more embodiments of attachment areas described herein, including, but not limited to: attachment area 3400, hourglass shaped attachment area 3500, and/or horseshoe shaped attachment area 3600, as well as any other type of attachment area and/or combination of attachment areas described in any of the various embodiments.

In an exemplary embodiment, various components 4100 may include one or more types of sole structures 4150 for an article of footwear including a decoupled foot stabilizer system. In this embodiment, types of sole structures 4150 may include a conventional sole 4151, a cleated sole 4152, a cleated sole with a heel cup 4153, and/or an articulated sole 4154. Types of sole structures 4150 may include one or more embodiments of sole structures described herein, including, but not limited to: sole structure 140, sole structure 1140, sole structure 1730, and/or sole structure 2640, as well as any other type of conventional sole structure used for an article of footwear.

Additionally, an article of footwear may include one or more components described in the various embodiments herein or included in conventional footwear.

With this arrangement, various components 4100 may be combined with different choices of one or more of types of uppers 4110, types of lacing arrangements 4120, types of foot stabilizer systems 4130, types of attachment areas 4140, and/or types of sole structures 4150, as well as choice of a base portion and any other additional components, to assemble an article of footwear with a decoupled foot stabilizer system.

Figure 54:
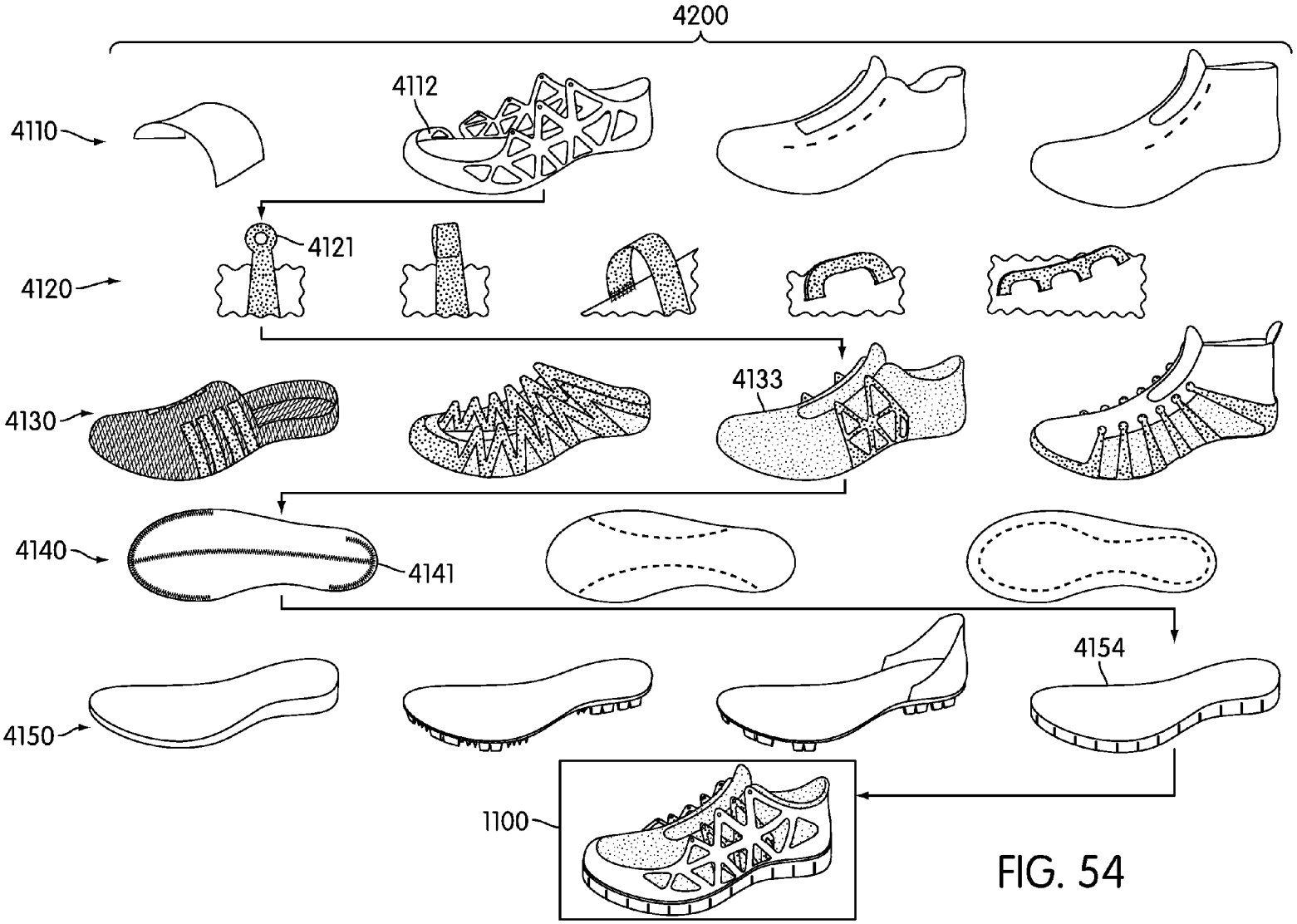
FIG. 54 is a schematic view of an exemplary embodiment of assembling components to form the alternate embodiment of an article of footwear including a decoupled foot stabilizer system of FIG. 13.

Referring now to FIG. 54, a schematic view of a choice of components 4200 is illustrated to assemble alternate exemplary embodiment of an article of footwear 1100, as described above. In this embodiment, skeletonized upper 4112 may be combined with an eyelet 4121 lacing arrangement, a low-top sock liner with a midfoot triangular shaped strap system 4133, a central attachment area 4141, and an articulated sole 4154 to form article 1100.

Figure 55:
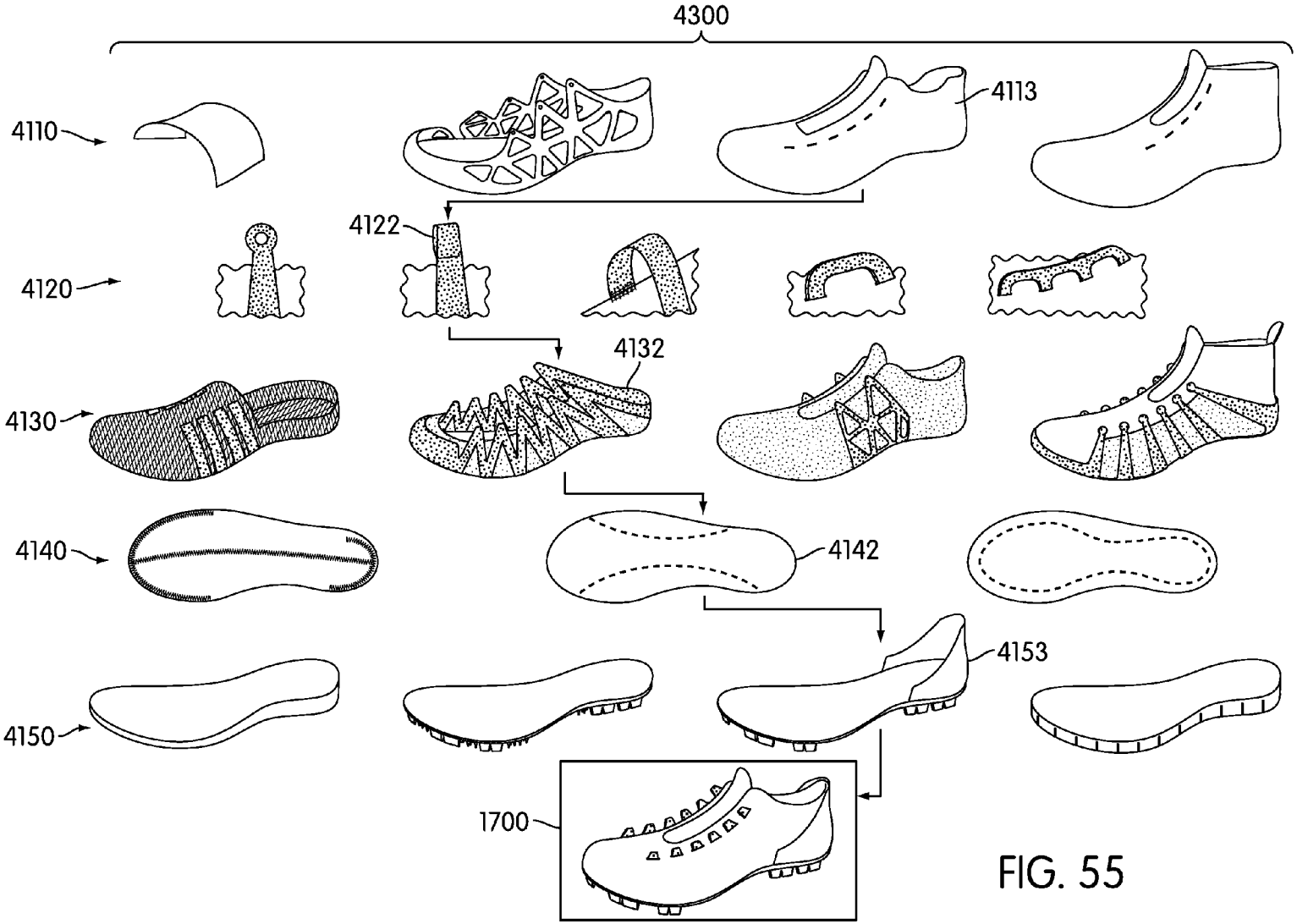
FIG. 55 is a schematic view of an exemplary embodiment of assembling components to form the alternate embodiment of an article of footwear including a decoupled foot stabilizer system of FIG. 19.

In a similar manner, FIG. 55 illustrates a schematic view of a choice of components 4300 to assemble alternate exemplary embodiment of an article of footwear 1700, as described above. In this embodiment, low-top upper 4113 may be combined with a tab 4122 lacing arrangement, a triangular shaped strap system without a bootie 4132, a horseshoe shaped attachment area 4142, and a cleated sole with a heel cup 4153 to form article 1700.

While specific examples of embodiments of articles with decoupled foot stabilizer systems have been described, it should be understood that by combining the various components as described herein, other embodiments of articles with decoupled foot stabilizer systems including one or more features of the present embodiments may be formed.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear, comprising:
an upper;
a sole structure;
a base portion attached to the sole structure;
a foot stabilizer system disposed within an interior of the upper, the foot stabilizer system including a bootie and a plurality of strap members, the foot stabilizer system being attached to the base portion at an attachment area that extends longitudinally along the base portion;
wherein the foot stabilizer system is further attached to the base portion at a heel region and a forefoot region; and
wherein the foot stabilizer system is decoupled from an outer perimeter of the base portion along a lateral side and a medial side of a midfoot region.

2. The article of footwear according to claim 1, wherein the midfoot region of the foot stabilizer system that is decoupled from the outer perimeter of the base portion along the lateral side and the medial side consists essentially of being attached to the base portion at the attachment area only.

3. The article of footwear according to claim 1, wherein the foot stabilizer system is attached to the base portion at a first portion of the forefoot region and a second portion of the heel region.

4. The article of footwear according to claim 1, wherein the plurality of strap members further comprise:
at least one forefoot member; and
at least one arch member;
wherein the at least one arch member is disposed on the foot stabilizer system at a portion of the midfoot region that is decoupled from the outer perimeter of the base portion.

5. The article of footwear according to claim 1, wherein the plurality of strap members further comprises at least one heel member disposed on the foot stabilizer system at the heel region.

6. The article of footwear according to claim 1, wherein the plurality of strap members includes at least one pair of strap members disposed along the lateral side and the medial side of the midfoot region.

7. The article of footwear according to claim 1, wherein the base portion further comprises a strobel.

8. The article of footwear according to claim 1, wherein the base portion further comprises a portion of the upper.

9. The article of footwear according to claim 1, wherein the attachment area includes at least one of a central attachment portion, a horseshoe attachment portion, and an hourglass attachment portion.

10. An article of footwear, comprising:
an upper;
a sole structure;
a base portion attached to the sole structure;
a foot stabilizer system disposed within an interior of the upper, the foot stabilizer system including a bootie and a plurality of strap members, the foot stabilizer system being attached to the base portion at an attachment area that extends longitudinally along the base portion;
wherein the foot stabilizer system is further attached to the base portion on a lateral side of a heel region and a lateral side of a forefoot region; and
wherein the foot stabilizer system is decoupled from an outer perimeter of the base portion along a medial side of the forefoot region and a medial side of the heel region.

11. The article of footwear according to claim 10, wherein the foot stabilizer system is further decoupled from the outer perimeter of the base portion along a lateral side and a medial side of a midfoot region.

12. The article of footwear according to claim 10, wherein the plurality of strap members further comprise:
at least one forefoot member; and
at least one arch member;
wherein the at least one arch member is disposed on the foot stabilizer system at a midfoot region that is decoupled from the outer perimeter of the base portion along at least one of a lateral side and a medial side.

13. The article of footwear according to claim 12, wherein the plurality of strap members further comprises at least one heel member disposed on the foot stabilizer system at the heel region.

14. The article of footwear according to claim 12, wherein the plurality of strap members includes at least one pair of heel members forming a heel counter.

15. The article of footwear according to claim 10, wherein the foot stabilizer system is attached to the base portion at the attachment area at a first portion of the forefoot region and a second portion of the heel region.

16. The article of footwear according to claim 10, wherein the foot stabilizer system is attached to the base portion with stitching.

17. The article of footwear according to claim 10, wherein the base portion further comprises a strobel.

18. The article of footwear according to claim 10, wherein the base portion further comprises a portion of the upper.

19. The article of footwear according to claim 10, wherein the attachment area includes at least one of a central attachment portion, a horseshoe attachment portion, and an hourglass attachment portion.

20. An article of footwear, comprising:
an upper having a plurality of slits;
a sole structure;
a base portion attached to the sole structure;
a foot stabilizer system including a bootie and a plurality of strap members, the foot stabilizer system being disposed in an interior of the upper;
wherein the plurality of strap members extend out from the interior of the upper through the plurality of slits; and wherein at least one of the plurality of strap members is decoupled from an outer perimeter of the base portion along a portion of a midfoot region to allow movement of the at least one of the plurality of strap members to conform the bootie to an arch of a wearer.

21. The article of footwear according to claim 20, wherein at least one of the plurality of strap members disposed on the foot stabilizer system at the midfoot region is decoupled from the outer perimeter of the base portion on at least one of a lateral side and a medial side.

22. An article of footwear according to claim 20, wherein each of the plurality of strap members further comprises:

a lacing hole disposed on an end of the strap member extending through a corresponding one of the plurality of slits; and wherein the foot stabilizer system is tightened around a foot of a wearer using a lace disposed through one or more lacing holes.

23. The article of footwear according to claim 22, wherein the at least one of the plurality of strap members disposed on the foot stabilizer system at the midfoot region moves from a first position to a second position using the lace.

24. The article of footwear according to claim 23, wherein the second position is essentially associated with the arch of the wearer.

25. The article of footwear according to claim 20, wherein the plurality of strap members further comprises at least one heel member disposed on the foot stabilizer system at the heel region.

26. The article of footwear according to claim 20, wherein the base portion further comprises at least one of a portion of the upper and a strobel.

* * * * *